US007637737B2

(12) United States Patent
Furner et al.

(10) Patent No.: US 7,637,737 B2
(45) Date of Patent: Dec. 29, 2009

(54) CANDLE ASSEMBLY WITH LIGHT EMITTING SYSTEM

(75) Inventors: Paul E. Furner, Racine, WI (US); Mary Beth Adams, Antioch, IL (US); William R. Kissner, Muskego, WI (US); Chris A. Kubicek, East Troy, WI (US); Cory J. Nelson, Racine, WI (US); Jose Porchia, Greenfield, WI (US); Raechell M. Thuot, Racine, WI (US); Nathan R. Westphal, Union Grove, WI (US); Rene Maurice Beland, Waterford, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 228 days.

(21) Appl. No.: 11/821,002

(22) Filed: Jun. 21, 2007

(65) Prior Publication Data

US 2007/0292812 A1 Dec. 20, 2007

Related U.S. Application Data

(63) Continuation-in-part of application No. 11/485,585, filed on Jul. 12, 2006, which is a continuation-in-part of application No. 11/355,585, filed on Feb. 16, 2006, (Continued)

(51) Int. Cl.
*F23Q 2/32* (2006.01)

(52) U.S. Cl. ..... 431/253; 431/288; 431/289; 431/291; 362/228

(58) Field of Classification Search ..... 431/253, 431/291, 288, 289; 362/228
See application file for complete search history.

(56) References Cited

U.S. PATENT DOCUMENTS 574,376 A 1/1897 Baumer (Continued)

FOREIGN PATENT DOCUMENTS

CA 2208145 12/1998

(Continued)

OTHER PUBLICATIONS www.epartyunlimited.com/luna-candles.html.

(Continued)

*Primary Examiner*—Kenneth B Rinehart
*Assistant Examiner*—Daniel A Bernstein

(57) ABSTRACT

A candle assembly includes a support base with a melting plate upon which a meltable solid fuel rests and a wick holder to hold a wick and engage the meltable solid fuel. The candle assembly further includes a control unit having at least one electrical component to control a light emitting system.

7 Claims, 65 Drawing Sheets

Related U.S. Application Data which is a continuation-in-part of application No. 10/780,028, filed on Feb. 17, 2004, now Pat. No. 7,247,017, which is a continuation-in-part of application No. 09/747,525, filed on Dec. 20, 2000, now Pat. No. 6,802,707, which is a continuation-in-part of application No. 09/468,970, filed on Dec. 21, 1999, application No. 11/821,002, which is a continuation-in-part of application No. 11/140,683, filed on May 31, 2005, which is a continuation-in-part of application No. 10/780,028, and a continuation-in-part of application No. 10/978,744, filed on Nov. 1, 2004, now Pat. No. 7,229,280, which is a continuation-in-part of application No. 10/938,434, filed on Sep. 10, 2004, application No. 11/821,002, which is a continuation-in-part of application No. 11/291,280, filed on Dec. 1, 2005, which is a continuation-in-part of application No. 10/938,453, filed on Sep. 10, 2004, now Pat. No. 7,413,435, and a continuation-in-part of application No. 11/123,372, filed on May 6, 2005, now Pat. No. 7,467,945, and a continuation-in-part of application No. 11/124,313, filed on May 6, 2005, now Pat. No. 7,318,724, and a continuation-in-part of application No. 11/123,461, filed on May 6, 2005, now Pat. No. 7,442,036, which is a continuation-in-part of application No. 10/978,744, filed on Nov. 1, 2004, now Pat. No. 7,229,280, application No. 11/821,002, which is a continuation-in-part of application No. 10/938,453, and a continuation-in-part of application No. 11/096,753, filed on Mar. 31, 2005, and a continuation-in-part of application No. 11/185,174, filed on Jul. 20, 2005, now Pat. No. 7,497,685.

(56) References Cited

U.S. PATENT DOCUMENTS

| | | | | |
|---|---|---|---|---|
| 1,226,850 | A | 5/1917 | Booty | |
| 1,309,545 | A | 7/1919 | Reicher | |
| 1,390,389 | A | 9/1921 | Rosenfeld | |
| 2,462,440 | A | 2/1949 | Tierney | |
| 2,494,995 | A | 1/1950 | Gardner | |
| 2,630,297 | A * | 3/1953 | Hunz | 254/109 |
| 3,117,763 | A * | 1/1964 | Musser | 251/165 |
| 3,183,688 | A | 5/1965 | Sobelson | |
| 3,741,711 | A | 6/1973 | Bryant | |
| 3,749,904 | A | 7/1973 | Graff | |
| 3,761,702 | A | 9/1973 | Andeweg | |
| 3,762,857 | A * | 10/1973 | Andeweg | 431/253 |
| 3,767,910 | A | 10/1973 | Harrigan | |
| 3,890,085 | A * | 6/1975 | Andeweg | 431/125 |
| 3,910,753 | A | 10/1975 | Lee | |
| 3,994,502 | A | 11/1976 | Lombardi | |
| 4,206,500 | A | 6/1980 | Neil | |
| 4,224,017 | A | 9/1980 | Kayne | |
| 4,477,249 | A | 10/1984 | Ruzek et al. | |
| 4,551,794 | A | 11/1985 | Sandell | |
| 4,566,055 | A | 1/1986 | Klees et al. | |
| 4,568,269 | A | 2/1986 | Lin | |
| 4,686,425 | A | 8/1987 | Havel | |
| 4,734,619 | A | 3/1988 | Havel | |
| 4,755,135 | A | 7/1988 | Kwok | |
| 4,804,323 | A | 2/1989 | Kim | |
| 4,804,890 | A | 2/1989 | Havel | |
| 4,845,481 | A | 7/1989 | Havel | |
| 4,887,074 | A | 12/1989 | Simon et al. | |
| 4,929,866 | A | 5/1990 | Murata et al. | |
| 4,983,119 | A | 1/1991 | Lin | |
| 4,992,704 | A | 2/1991 | Stinson | |
| 5,015,175 | A | 5/1991 | Lee | |
| 5,057,005 | A | 10/1991 | Kwok | |
| 5,069,617 | A | 12/1991 | Lin | |
| D325,077 | S | 3/1992 | Kearnes | |
| 5,134,387 | A | 7/1992 | Smith et al. | |
| 5,194,854 | A | 3/1993 | Havel | |
| 5,226,723 | A | 7/1993 | Chen | |
| 5,298,871 | A | 3/1994 | Shimohara | |
| 5,363,590 | A | 11/1994 | Lee | |
| 5,569,983 | A | 10/1996 | McGuire et al. | |
| 5,619,182 | A | 4/1997 | Robb | |
| 5,656,935 | A | 8/1997 | Havel | |
| D393,910 | S | 4/1998 | Chambers et al. | |
| D394,910 | S | 6/1998 | Volker | |
| 5,791,774 | A | 8/1998 | Briles | |
| 5,797,739 | A | 8/1998 | Lioi | |
| 5,807,096 | A | 9/1998 | Shin et al. | |
| 5,808,592 | A | 9/1998 | Mizutani et al. | |
| 5,812,105 | A | 9/1998 | Van de Ven | |
| 5,851,063 | A | 12/1998 | Doughty et al. | |
| 5,890,790 | A | 4/1999 | Osawa | |
| 5,894,196 | A | 4/1999 | McDermott | |
| 5,921,767 | A | 7/1999 | Song | |
| 5,924,784 | A | 7/1999 | Chliwnyi et al. | |
| 5,939,005 | A | 8/1999 | Materna | |
| 5,952,680 | A | 9/1999 | Strite | |
| 5,955,958 | A | 9/1999 | Lu | |
| 6,016,038 | A | 1/2000 | Mueller et al. | |
| 6,017,139 | A | 1/2000 | Lederer | |
| 6,033,209 | A | 3/2000 | Shin et al. | |
| 6,050,812 | A | 4/2000 | Chuang | |
| 6,062,847 | A | 5/2000 | Pappas | |
| 6,074,199 | A | 6/2000 | Song | |
| D433,168 | S | 10/2000 | Cousins | |
| 6,153,981 | A | 11/2000 | Thomas et al. | |
| 6,211,626 | B1 | 4/2001 | Lys et al. | |
| RE37,168 | E | 5/2001 | St. Louis | |
| 6,241,362 | B1 * | 6/2001 | Morrison | 362/231 |
| 6,267,584 | B1 | 7/2001 | Zou | |
| 6,270,339 | B1 | 8/2001 | Zou | |
| 6,273,710 | B1 | 8/2001 | Zou | |
| 6,285,140 | B1 | 9/2001 | Ruxton | |
| D450,865 | S | 11/2001 | Bellenger et al. | |
| 6,328,935 | B1 | 12/2001 | Buccellato | |
| 6,354,710 | B1 | 3/2002 | Nacouzi | |
| 6,361,311 | B1 * | 3/2002 | Smith | 431/291 |
| D455,486 | S | 4/2002 | Makino | |
| 6,377,164 | B1 | 4/2002 | Fulmer | |
| 6,398,544 | B2 | 6/2002 | Wright et al. | |
| 6,439,471 | B2 | 8/2002 | Ehrlich et al. | |
| 6,454,561 | B1 | 9/2002 | Colthar et al. | |
| 6,468,071 | B2 | 10/2002 | Zou | |
| 6,488,494 | B2 | 12/2002 | Lee | |
| 6,491,516 | B1 | 12/2002 | Tal et al. | |
| D469,893 | S | 2/2003 | Shen | |
| 6,520,770 | B2 | 2/2003 | Zou | |
| 6,533,828 | B1 | 3/2003 | Calzada | |
| 6,543,268 | B2 | 4/2003 | Wright et al. | |
| 6,544,303 | B2 | 4/2003 | Calzada | |
| 6,554,448 | B2 | 4/2003 | Carpenter et al. | |
| 6,575,613 | B2 | 6/2003 | Brown et al. | |
| 6,577,080 | B2 | 6/2003 | Lys et al. | |
| 6,595,771 | B2 | 7/2003 | Chu | |
| 6,616,308 | B2 | 9/2003 | Jensen et al. | |
| 6,627,857 | B1 | 9/2003 | Tanner et al. | |
| 6,628,249 | B1 | 9/2003 | Kamikawa et al. | |
| 6,648,631 | B2 | 11/2003 | Wright et al. | |
| 6,676,284 | B1 | 1/2004 | Wynne Willson | |
| 6,690,120 | B2 | 2/2004 | Oskorep et al. | |
| 6,716,026 | B1 * | 4/2004 | Beougher | 431/290 |
| 6,719,443 | B2 | 4/2004 | Gutstein et al. | |
| 6,733,279 | B2 | 5/2004 | Thigpen et al. | |
| 6,744,223 | B2 | 6/2004 | Laflamme et al. | |

| | | | | |
|---|---|---|---|---|
| 6,747,420 | B2 | 6/2004 | Barth et al. | |
| 6,780,382 | B2 | 8/2004 | Furner et al. | |
| 6,799,965 | B1 | 10/2004 | Gaudioso | |
| 6,800,996 | B2 | 10/2004 | Nagai et al. | |
| 6,802,707 | B2 | 10/2004 | Furner et al. | |
| 6,805,452 | B2 | 10/2004 | Okuyama et al. | |
| 6,808,388 | B2 | 10/2004 | Lee | |
| 6,822,403 | B2 | 11/2004 | Horiuchi et al. | |
| 6,827,466 | B2 | 12/2004 | Tsai | |
| 6,827,474 | B2 | 12/2004 | Clapper | |
| 6,836,081 | B2 * | 12/2004 | Swanson et al. | 315/307 |
| 6,858,870 | B2 | 2/2005 | Lee | |
| 6,863,525 | B2 | 3/2005 | Byrd | |
| 6,888,322 | B2 | 5/2005 | Dowling et al. | |
| 6,897,489 | B1 | 5/2005 | Peng et al. | |
| 6,897,622 | B2 | 5/2005 | Lister | |
| 6,909,234 | B2 | 6/2005 | Chen | |
| 6,923,639 | B2 | 8/2005 | Pesu et al. | |
| 6,933,680 | B2 | 8/2005 | Oskorep et al. | |
| 6,946,805 | B2 | 9/2005 | Segan et al. | |
| 6,949,892 | B2 | 9/2005 | Horiuchi et al. | |
| 6,954,039 | B2 | 10/2005 | Lin et al. | |
| 6,960,076 | B2 | 11/2005 | Yu | |
| 6,963,175 | B2 | 11/2005 | Archenhold et al. | |
| 6,963,180 | B2 | 11/2005 | Rose | |
| 6,964,498 | B2 | 11/2005 | Wu | |
| 6,967,448 | B2 | 11/2005 | Morgan et al. | |
| 7,014,819 | B2 | 3/2006 | Hart et al. | |
| 7,015,825 | B2 | 3/2006 | Callahan | |
| 7,023,147 | B2 | 4/2006 | Colby et al. | |
| 7,052,161 | B2 | 5/2006 | Lichtenstein et al. | |
| 7,063,526 | B2 * | 6/2006 | Ham et al. | 431/253 |
| 7,064,498 | B2 | 6/2006 | Dowling et al. | |
| 7,067,772 | B2 | 6/2006 | Tanner et al. | |
| 7,098,600 | B2 | 8/2006 | Li et al. | |
| 7,121,686 | B1 | 10/2006 | Chu | |
| 2001/0031438 | A1 | 10/2001 | Hannington et al. | |
| 2002/0093834 | A1 | 7/2002 | Yu et al. | |
| 2002/0119413 | A1 | 8/2002 | Cheng | |
| 2003/0027091 | A1 | 2/2003 | Brandt | |
| 2003/0134246 | A1 | 7/2003 | Gray et al. | |
| 2004/0029061 | A1 | 2/2004 | Dibnah et al. | |
| 2004/0033463 | A1 | 2/2004 | Pesu et al. | |
| 2004/0037069 | A1 | 2/2004 | Blackbourn | |
| 2004/0052076 | A1 | 3/2004 | Mueller et al. | |
| 2004/0128879 | A1 | 7/2004 | Lu | |
| 2004/0160764 | A1 | 8/2004 | Lee | |
| 2004/0229180 | A1 | 11/2004 | Furner | |
| 2005/0007035 | A1 | 1/2005 | Sloan et al. | |
| 2005/0037306 | A1 | 2/2005 | Nakatsu | |
| 2005/0111217 | A1 | 5/2005 | Feng | |
| 2005/0204372 | A1 | 9/2005 | Lee | |
| 2005/0208447 | A1 | 9/2005 | Kubicek et al. | |
| 2005/0214704 | A1 | 9/2005 | Pappas et al. | |
| 2005/0227190 | A1 | 10/2005 | Pappas | |
| 2005/0231133 | A1 | 10/2005 | Lys | |
| 2005/0271994 | A1 | 12/2005 | Furner | |
| 2006/0002102 | A1 | 1/2006 | Leonard | |
| 2006/0018786 | A1 | 1/2006 | Tolman et al. | |
| 2006/0084020 | A1 | 4/2006 | Nakatsu et al. | |
| 2006/0084021 | A1 | 4/2006 | Kubicek | |
| 2006/0120080 | A1 | 6/2006 | Sipinski et al. | |
| 2006/0172239 | A1 | 8/2006 | Tsai | |
| 2006/0176703 | A1 | 8/2006 | Cayton et al. | |
| 2006/0177786 | A1 | 8/2006 | Hu | |
| 2006/0272199 | A1 | 12/2006 | Licciardello | |

FOREIGN PATENT DOCUMENTS

| | | |
|---|---|---|
| DE | 3302591 | 8/1984 |
| DE | 34 03 604 | 8/1985 |
| DE | 201 09 808 | 11/2001 |
| DE | 102004011919 | 6/2005 |
| EP | 0146247 | 6/1985 |
| EP | 1359373 | 5/2003 |
| EP | 1 336 799 | 8/2003 |
| FR | 2628825 | 3/1988 |
| GB | 161342 | 4/1921 |
| GB | 2 230 888 | 10/1990 |
| JP | 62-220594 | 9/1987 |
| JP | 6212189 | 8/1994 |
| JP | 08185710 | 7/1996 |
| JP | 2003-213292 | 7/2003 |
| WO | WO 01/46618 | 6/2001 |
| WO | WO 01/48420 | 7/2001 |
| WO | WO 02/33315 | 4/2002 |
| WO | WO 2004/083718 | 10/2003 |
| WO | WO 2004/008026 | 1/2004 |
| WO | WO 2004/090417 | 10/2004 |

OTHER PUBLICATIONS www.musicalcandlecompany.com.
www.allproducts.com/manufacture98/hkalita/product4.html.
www.unicahome.com/catalog/item.asp?id=14639.
www.harrietcarter.com.
www.theglowcompany.co.uk/acatalog/LOUNGE_LIGHTS.html.
www.lumenae.com.
www.colorfusioncandles.com.
*International Candle House catalog* (1966-67); *Bobeshes* pp. 54-55.
Pourette Catalog 1998; p. 12.
Prices London Candlemakers; http:www.prices-candles.co.uk/mainpage.htm; 1 page, printed Apr. 21, 2005.
Prices London Candlemakers; http:www.prices-candles.co.uk/catalogue/Accessories/Accessories%20Page%2008.jpg; 1 page; printed Apr. 21, 2005.
Two (2) photos of Price's "Coral Bay Fragranced Bathroom" product taken Jan. 1, 1999.
Stephanie Reiser Wrought Iron—"Welcome to CourtingCandle.com!" http://www/courtingcandle.com; 1 page printed on May 12, 2004.
Intl. Search Report dated Jul. 27, 2006, Appl. No. PCT/US 2005/032266 (4033 PCT).
U.S. Appl. No. 09/742,631, Office Action dated Aug. 18, 2003.
U.S. Appl. No. 09/747,525, Office Action dated Oct. 1, 2001.
U.S. Appl. No. 09/747,525, Office Action dated Sep. 9, 2003.
U.S. Appl. No. 09/747,525, Office Action dated May 20, 2003.
U.S. Appl. No. 09/747,525, Office Action dated Jan. 10, 2003.
U.S. Appl. No. 09/747,525, Office Action dated Jul. 2, 2002.
U.S. Appl. No. 10/780,028, Office Action dated Apr. 11, 2006.
U.S. Appl. No. 10/938,434, Office Action dated Jul. 17, 2006.
U.S. Appl. No. 10/978,744, Office Action dated Jul. 19, 2006.
U.S. Appl. No. 10/780,028, Office Action dated Oct. 4, 2006.
U.S. Appl. No. 10/780,028, Office Action dated Oct. 18, 2005.
U.S. Appl. No. 10/978,744, Office Action dated Nov. 13, 2006.
U.S. Appl. No. 10/938,434, Final Office Action dated Nov. 20, 2006.
Intl Search Report and Written Opinion dated Jun. 1, 2007, Appl. No. PCT/US2006/048319.
U.S. Appl. No. 11/123,372, Office Action dated Feb. 27, 2007.
U.S. Appl. No. 11/124,313, Office Action dated Feb. 28, 2007.
Intl. Search Report and Written Opinion dated Mar. 13, 2007, Appl. No. PCT/US2006/042787.
Intl. Search Report and Written Opinion dated Mar. 21, 2007, Appl. No. PCT/US2006/046057.
U.S. Appl. No. 11/123,461, Office Action dated Mar. 7, 2007.
U.S. Appl. No. 11/123,809, Office Action dated Mar. 7, 2007.
U.S. Appl. No. 10/978,646, Office Action dated May 4, 2007.
International Search Report and Written Opinion in PCT/US2006/048373 dated May 7, 2007.
Intl. Search Report and Written Opinion dated Oct. 2, 2008, Appl. No. PCT/US 08/07718.

* cited by examiner

CANDLE ASSEMBLY WITH LIGHT EMITTING SYSTEM

CROSS REFERENCE TO RELATED APPLICATIONS

This application is a continuation-in-part of U.S. patent application Ser. No. 11/485,585, filed Jul. 12, 2006, which is a continuation-in-part of U.S. patent application Ser. No. 11/355,585, filed Feb. 16, 2006, which is a continuation-in-part of U.S. patent application Ser. No. 10/780,028, filed Feb. 17, 2004, now U.S. Pat. No. 7,247,017 which is continuation-in-part of U.S. patent application Ser. No. 09/747,525, filed Dec. 20, 2000, now U.S. Pat. No. 6,802,707, which is a continuation-in-part of U.S. patent application Ser. No. 09/468,970, filed Dec. 21, 1999. This application is also a continuation-in-part of U.S. patent application Ser. No. 11/140,683, filed May 31, 2005, which is a continuation-in-part of U.S. patent application Ser. No. 10/780,028, filed Feb. 17, 2004, now U.S. Pat. No. 7,247,017 and U.S. patent application Ser. No. 10/978,744, filed Nov. 1, 2004, now U.S. Pat. No. 7,229,280 which is a continuation-in-part of U.S. patent application Ser. No. 10/938,434, filed Sep. 10, 2004. This application is also a continuation-in-part of U.S. patent application Ser. No. 11/291,280, filed Dec. 1, 2005, which is a continuation-in-part of U.S. patent application Ser. No. 10/938,453, filed Sep. 10, 2004, now U.S. Pat. No. 7,413,435 U.S. patent application Ser. No. 11/123,372, filed May 6, 2005, now U.S. Pat. No. 7,467,945 U.S. patent application Ser. No. 11/124,313, filed May 6, 2005, now U.S. Pat. No. 7,318,724 and U.S. patent application Ser. No. 11/123,461, filed May 6, 2005, now U.S. Pat. No. 7,442,036 which are continuations-in-part of U.S. patent application Ser. No. 10/978,744, filed Nov. 1, 2004 now U.S. Pat. No. 7,229,280. This application is also a continuation-in-part of U.S. patent application Ser. No. 10/938,453, filed Sep. 10, 2004 now U.S. Pat. No. 7,413,435. This application is also a continuation-in-part of U.S. patent application Ser. No. 11/096,753, filed Mar. 31, 2005. This application is also a continuation-in-part of U.S. patent application Ser. No. 11/185,174, filed Jul. 20, 2005 now U.S. Pat. No. 7,497,685. This application also claims the benefit of U.S. provisional application Ser. No. 60/754,088, filed Dec. 21, 2005. This application claims the benefit of all such previous applications, and such applications are hereby incorporated herein by reference in their entireties.

REFERENCE REGARDING FEDERALLY SPONSORED RESEARCH OR DEVELOPMENT

Not applicable

SEQUENTIAL LISTING

Not applicable

BACKGROUND

1. Technical Field

The present invention relates generally to wick-holder assemblies, and more particularly to wick-holder assemblies having a light show.

2. Background

Many different multi-sensory candle assemblies that emit sound and/or light are known. In one instance, a candle assembly has a wicked candle disposed inside a cylindrical container having a recessed stepped ring encircling an open top end thereof. A circular shade body fits within the open top end and has an outer peripheral flange that rests on the recessed stepped ring.

In another instance, a candleholder has a standard for receiving a candlestick, which extends from a base of the candleholder. The standard has a socket with an out-turned flange at an upper end thereof for receiving the candlestick therein. A funneled split tube is disposed in the socket. The split tube has an out-turned peripheral flange that rests on the out-turned flange of the socket. A cap spans the out-turned flange of the socket and rests on a peripheral edge thereof spaced above the split tube.

An electric candle is known that has a hollow cylindrical body portion extending up from a mounting base. A votive candle is carried within an open upper end of the body portion by a bracket having a plurality of arms extending radially outwardly from a central frustoconical rim. The votive is carried inside the rim, and the peripheral edges of the arms rest on a recessed inner annular rim at the open upper end of the body portion.

In some instances, a candle has a constant elevation flame with a wax body contained within a tubular outer casing. A spring urges the wax body upwardly toward a wick carried over an open end of the outer casing by a thermally-insulated cover. The wick extends through a central aperture in the cover and is retained at a constant elevational position by a wire. An outturned peripheral lip of the cover rests in a peripheral recess in the tubular casing.

In one instance, a decorated luminary product has a candle or candleholder containing a candle. The luminary product has a decorative web of a heat-shrinkable polymer conforming to the shape of the luminary product. The web is decorated with a thermochromatic ink or pigmentation that reacts to heat generated by burning a candle to provide a visual effect when the candle is burned.

In other instances, a melody candle has an optical fiber embedded in the candle in parallel with a wick. The optical fiber is connected to a photo sensor that controls a melody-producing unit, such that when the candle is lit, light is transferred through the optical fiber to the photo sensor, which causes a melody to be played. The optical fiber is coated with a dark colored color change pigment that prevents ambient light transfer to the photo sensor when the candle is not lit. Upon lighting of the wick, heat from the lit wick causes the color change pigment to become transparent allowing light to travel down the optical fiber to activate the melody-producing unit to initiate a melody.

Another melodic candle assembly has a candle with a wick axially disposed therewithin and a thermoresponsive, piezoelectric strip disposed alongside the wick. When the wick is lit, heat from a flame translated by the thermoresponsive strip initiates a melody, song, or vocal rendition by activating electronics in the candle base.

Still another melody-producing candle has an embedded integrated circuit that produces music. A fiber optic strand transfers light from a lit wick to a light sensor operatively connected to the integrated circuit. The candle further includes a light reflector that adjusts the sensitivity of the light sensor to light transferred to the sensor via the fiber optic strand.

A further melody candle assembly has a candle with one or more recesses on a bottom surface and a wick with a lower end extending to a bottom surface of the candle. The candle also has an optical fiber embedded axially therein. The candle assembly further also has a candlestick element with a top surface provided with one or more apertures and a center hole into which the wick extends. The candle assembly has a melody reproducing unit and a photosensor fitted in the center hole opposite of the lower end of the wick to sense light from the wick to prepare the melody producing unit for operation.

Another melody candle uses a color change pigment to coat an optical fiber that stays in black-like colors to shield light at normal states and gets changed to transparent colors at a time of the application of heat when the candle is burnt.

In another instance, a candle device has a flame-responsive circuit adapted to respond to a flame source and a receiver circuit configured to respond to a radio-frequency signal. The flame-responsive circuit and receiver circuit are coupled to an electronic playback device, an electromechanical device, or a light source device.

A further candle device has a candle body housed within a container having a bottom and a compartment formed at the bottom to contain a music generator that has an integrated circuit. The integrated circuit is controlled by switching means that trigger the integrated circuit in response to the presence of a candle flame on a lit wick of the candle. The switching means has a fiber optic member combined with a photosensitive resistor, a thermally conducting wire combined with a thermo-sensitive resistor, or a thermally conducting wire combined with an infrared resistor. The infrared resistor detects infrared radiation emitted by the heated wire.

A color-changing candle has a fiber optic strand embedded adjacent to and in parallel with a wick in a candle body. The fiber optic is operatively connected to electronics embedded within the candle body. In response to detecting light channeled from the fiber optic strand, the electronics activate one or more light emitting diodes that change the color of the candle body to that of the color of the one or more lit light emitting diodes.

In yet other instances, a candle contains an optical guide, such as a fiber optic cable, within a wick axially is disposed within a candle body. The optical guide is coupled to a music producing electronic circuit, such that when the candle is lit, candlelight transferred along the optical guide triggers the playing of a musical tune.

In other instances, a candle has a candle flame extinguisher assembly that functions to extinguish a candle flame once the candle has burned a sufficient amount of wax to trigger a magnet-based mechanism. The magnet-based candle flame extinguisher mechanism has a candle that has a wick holder and a first magnet having a first polarity. The candle is disposed over a second magnet that has a second polarity and is disposed beneath the candle. The first and second magnets are positioned such that the first polarity of the first magnet is repelled by the second polarity of the second magnet. However, the weight of the candle is sufficient initially to overcome the repulsion force of the first and second magnets allowing the candle to remain in an upright position. Upon sufficient melting of the candle, a pool of melted wax is formed. After an amount of wax is consumed, the repelling force between the magnets overcomes the weight of the candle and causes the candle to be tipped over into the pool of melted wax thereby extinguishing the flame.

In other instances, a candle support structure is designed to prevent a candle from being overturned by vibration of an earthquake or the like. The structure appears to consist of a thimble-like device that fits into a hole in the base of a conventional wax-bodied candle body. The thimble and candle are received upon a receiving body. The position on the receiving body where the thimble and candle are received has a permanent magnet embedded therein flush with what appears to be a dish-like structure, presumably to catch candle wax drippings from a burning candle. The candle is designed with a hole in its base for first receiving the thimble therein, but additionally for preventing the candle from overheating the thimble and permanent magnet thereunder.

In yet another instance, a magnetic candleholder assembly has a candleholder with a magnet adhered to a base thereof. Further, the assembly has a spiked disk comprising magnetic material. The disk is inserted into the base of a conventional wax-type candle, and the disk and candle are placed atop the magnet. The magnetic attractive force between the magnet adhered to the candleholder and the magnetic material-comprised disk inserted into the base of the candle secures the candle to the candleholder.

A lighted display device has a base that incorporates three light emitting diodes that together can emit color in the visible spectrum and selectively illuminate a translucent article disposed on the display device. The diodes are positioned below an upper surface of the base and within a centrally located light passage disposed in the base. A translucent article support is removably placed atop the upper surface of the base to further diffuse and distribute the light emitted by the LEDs. The translucent article support may be a flat sheet of translucent material or a candle holder.

In yet further instances, a candlestick element has at least two apertures spaced apart and a center hole to which the lower end of an optical fiber is extended and a melody producing unit with switch knobs movably protruded over respective apertures formed at the top portion of the candlestick element.

SUMMARY

According to one aspect of the present disclosure, a candle assembly includes a support base that has a first retention member and a melting plate that includes an upwardly projecting capillary lobe. The capillary lobe includes a first capillary wall extending from the melting plate. The candle assembly further includes a wick holder that has a wick and a base portion that includes a second capillary wall. The capillary lobe cooperatively engages the base portion to define a capillary space between the first and the second capillary walls to allow capillary flow of melted fuel from the melting plate to the wick through the capillary space. The candle assembly further includes a control unit that has a light emitting system and a second retention member configured to lockingly engage with the first retention member.

According to another aspect of the present disclosure, a retention mechanism that includes a first retention member disposed on a support base that includes a melting plate configured to hold a fuel element and engage a wick holder. The melting plate includes a projecting capillary lobe. The capillary lobe includes a first capillary wall extending from the melting. The wick holder has a wick and a base portion that includes a second capillary wall. The capillary lobe cooperatively engages the base portion to define a capillary space between the first and the second capillary walls to allow capillary flow of melted fuel from the melting plate to the wick through the capillary space. The retention mechanism further includes a second retention member disposed on a control unit that has a light emitting system and is configured to lockingly engage the first retention member.

According to a further aspect of the present disclosure, a candle assembly includes a support base that has an upwardly projecting capillary lobe. The capillary lobe is disposed within a recessed base portion of a wick holder. The support base further includes a capillary space defined between the capillary lobe and the recessed base portion to allow capillary flow of melted fuel to a wick from the support base. The candle assembly further includes a control unit that has a light emitting system and a retention mechanism to attach the support base to the control unit and that includes a first retention member disposed on the support base and a second retention member disposed on the control unit. The second retention member is configured to lockingly engage the first retention member.

Other aspects and advantages will become apparent upon consideration of the figures and the following detailed description, wherein like reference numbers in the various drawings designate like structure in various embodiments.

DETAILED DESCRIPTION

Figure 1:
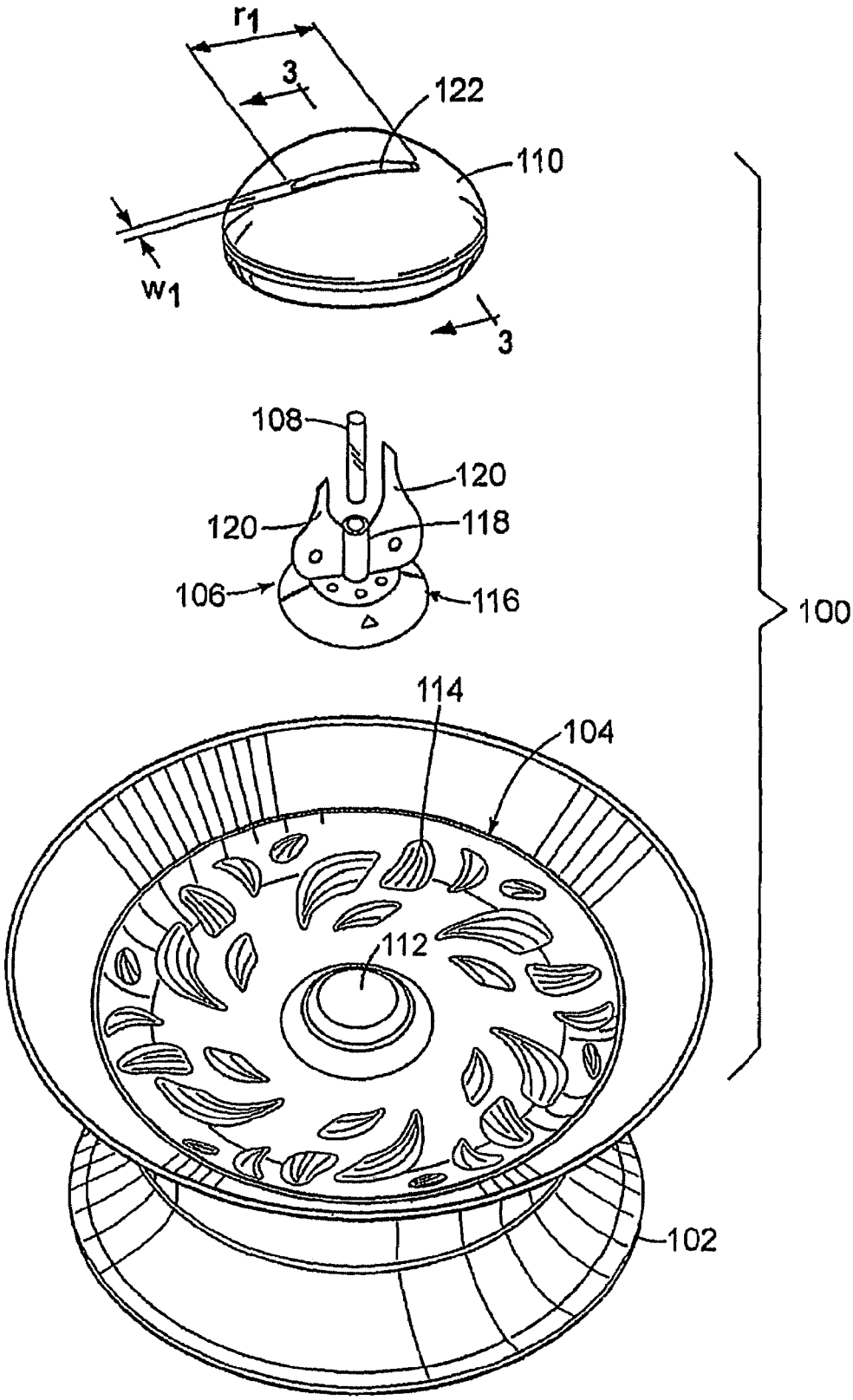
FIG. 1 is an exploded isometric view of a first embodiment of a candle assembly.

Referring now to FIGS. 1-5, a candle assembly 100 includes a support base 102, a melting plate 104, a wick holder 106, a wick 108, and a fuel element 110. The support base 102 carries the melting plate 104, which is generally saucer shaped, and includes a centrally disposed capillary pedestal 112. Optional decorative etchings 114 are disposed on an upper exposed surface of the melting plate 104 to provide enhanced attractiveness or visual information. The wick holder 106 includes a base portion 116 that fits over the capillary pedestal 112, a wick retainer sleeve in the shape of an elongate cylindrical barrel 118, and heat conductive elements, such as fins 120. The barrel 118 receives the wick 108 therein such that the wick extends from the base portion 116 with a portion of the wick exposed above the barrel. The fuel element 110 is disposed over and around the wick holder 106 and includes a duct or slot 122 through which the wick 108 extends. The slot 122 has a width $w_1$ sufficient to allow the wick 108 to extend through the slot and a length $l_1$ sufficient to accept at least a portion of the fins 120 therethrough. In one embodiment, the fuel element 110 has a mass of wax approximately 15 grams, and the melting plate candle 100 burns continuously between about 3 and about 3½ hours on a single fuel element, such as the wax fuel element 110, before the fuel is completely consumed.

Figure 2:
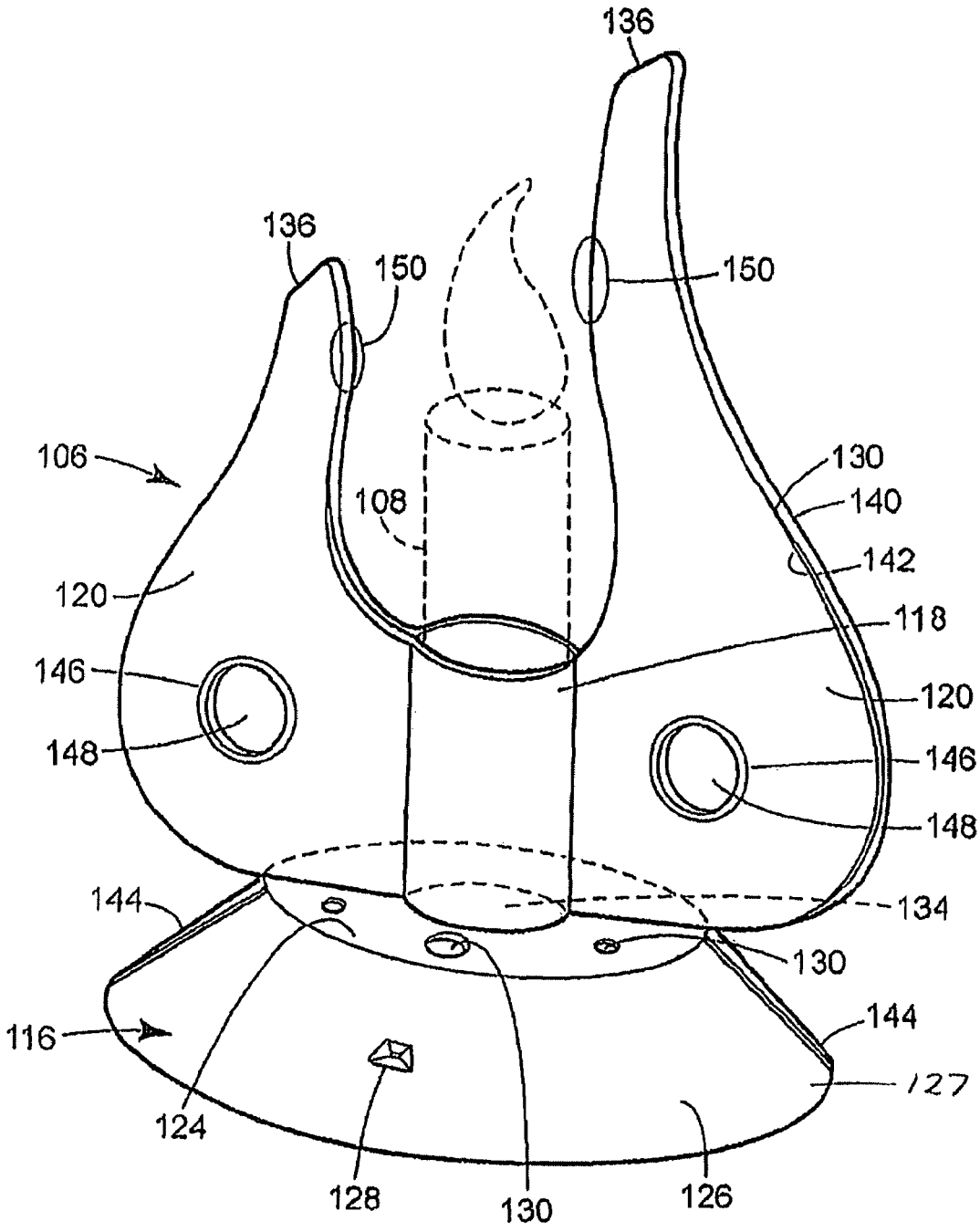
FIG. 2 is an enlarged isometric view of a wick holder shown in FIG. 1.

As seen in FIG. 2, the base portion 116 of the wick holder 106 includes an end plate 124 encompassed by a generally downwardly extending conical base skirt 126 including a capillary wall 127, and an upper portion including the barrel 118 extending upwardly from the base skirt and the fins 120 extending from the barrel and end plate 124. The base portion 116 is adapted to fit closely over and around the capillary pedestal 112 such that the barrel 118 is maintained in an upright, or substantially vertical, orientation when placed on the capillary pedestal. The base skirt 126 includes indentations or spacers 128, and holes 130 extend through the end plate 124. Ferromagnetic structures, such as steel rivets 132 or magnets (not shown), are secured to the base portion 116, such as through the holes 130, so that the wick holder 106 may be releasably secured over the capillary pedestal 130 by magnetic forces. The barrel 118 is sized to receive the wick 108 with either a close fit or interference fit so as to retain the wick therein and defines an opening 134 in the end plate 124 such that the wick can extend through the end plate. The fins 120 extend laterally outwardly on opposite sides of the barrel 118 and extend upwardly above the barrel. In one embodiment, the fins 120 are shaped to simulate a flame outline. In other embodiments, the fins 120 may have square, circular, oval, triangular, or other non-geometric shapes, and in still other embodiments, the fins 120 may have insulated areas (not shown) as described more fully in U.S. patent application Ser. No. 10/939,039, filed Sep. 10, 2004, and incorporated herein by reference in its entirety. The fins 120 are relatively thin strips of heat conductive material, such as metal, for transmitting heat from a flame burning on the wick 108 outwardly toward the fuel element 110. In one embodiment, the wick holder 106 is formed from a single sheet of aluminum that is cut and folded about a fold 136 and thereby forming a capillary space 138 between opposite sides 140 and 142 and channels or gaps 144 in the base skirt 126. In other embodiments, the wick holder 106 may be formed by other methods from other heat resistant materials, such as ceramic, other metals, heat resistant plastics, etc. If the wick holder 106 is formed of a ferromagnetic material, such as steel, the steel rivets 132 may optionally be omitted. The two sides 140 and 142 are secured together by any convenient means, such as with rivets 146 through holes 148 in the heat fins 120, welds, clips, heat resistant adhesives, etc. The gaps 144 and the holes 130 allow melted fuel material from the fuel element 110, to drip or seep underneath the base skirt 126, and the capillary space 138 allows melted fuel material to traverse up the fins 120 by capillary action and thereby provide a source of fuel material in non-consumable wick areas 150. An example of such capillary action is described in U.S. patent application Ser. No. 10/938,453, filed Sep. 10, 2004, and incorporated herein by reference in its entirety.

Figure 3:
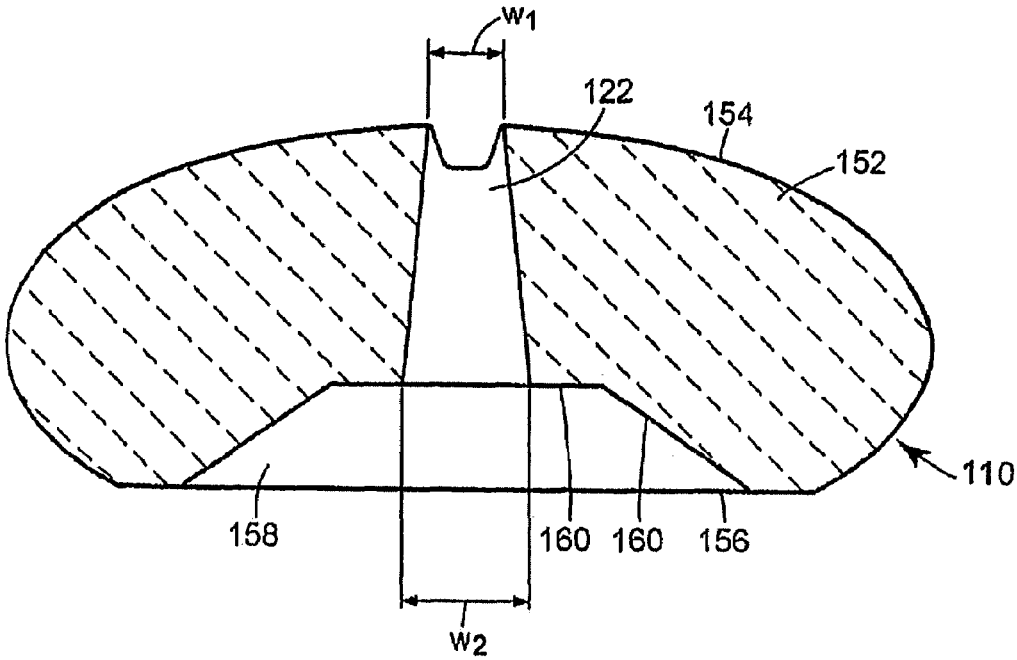
FIG. 3 is a cross-sectional view of a fuel element along the line 3-3 of FIG. 1.

As seen in detail in FIG. 3, the fuel element 110 includes a body 152 of fuel material and has an upper surface 154 and a lower surface 156. The fuel element 110 in one embodiment is a wax puck and in other embodiments may have other shapes and include other meltable or flowable fuel materials, such as paraffin or animal fat, having a solid or semi-solid state or otherwise maintainable in a fixed form at room temperature. The lower surface 156 of the fuel element 110 defines a cavity 158 having an upper cavity wall 160 shaped to conform closely to the base portion 116 of the wick holder 106. The slot 122 extends from the upper surface 154 to the cavity wall 160 and has a width $w_1$ at the upper surface that is smaller than a width $w_2$ at the cavity wall. The width $w_1$ is adapted to prevent melted wax from the fuel element 110 from falling or trickling down the slot 122 without engaging the wick 108, or put another way, the width $w_1$ is narrow enough to ensure that melted fuel material from near the upper portion of the slot 122 will engage the wick 108 as it falls or trickles down the slot. In one embodiment, $w_1$ is not more than approximately 0.02 inch (0.5 mm) larger than a diameter of the wick at an upper end of the slot 122. In another embodiment, $w_1$ is approximately the same as a diameter of the wick 108. In yet another embodiment, the width $w_1$ is less than a width of the wick 108 so that an interference fit exists between the wick and the body 152 at the upper end of the slot 122. In a further embodiment, the width $w_1$ is less than or equal to approximately 0.12 inch (3 mm), and the wick 108 has a diameter of approximately 0.1 inch (2.5 mm). In yet a further embodiment (not shown), the slot 122 may have a width that is initially more than about 0.02 inch (0.5 mm) larger than a diameter of the wick 108 to allow for easy insertion of the wick 108 and wick holder 106 into the slot 122, and the slot is filled subsequently with additional fuel material in a second manufacturing step so that the width $w_1$ is less than about 0.02 inch (0.5 mm) larger than the diameter of the wick.

Figure 4:
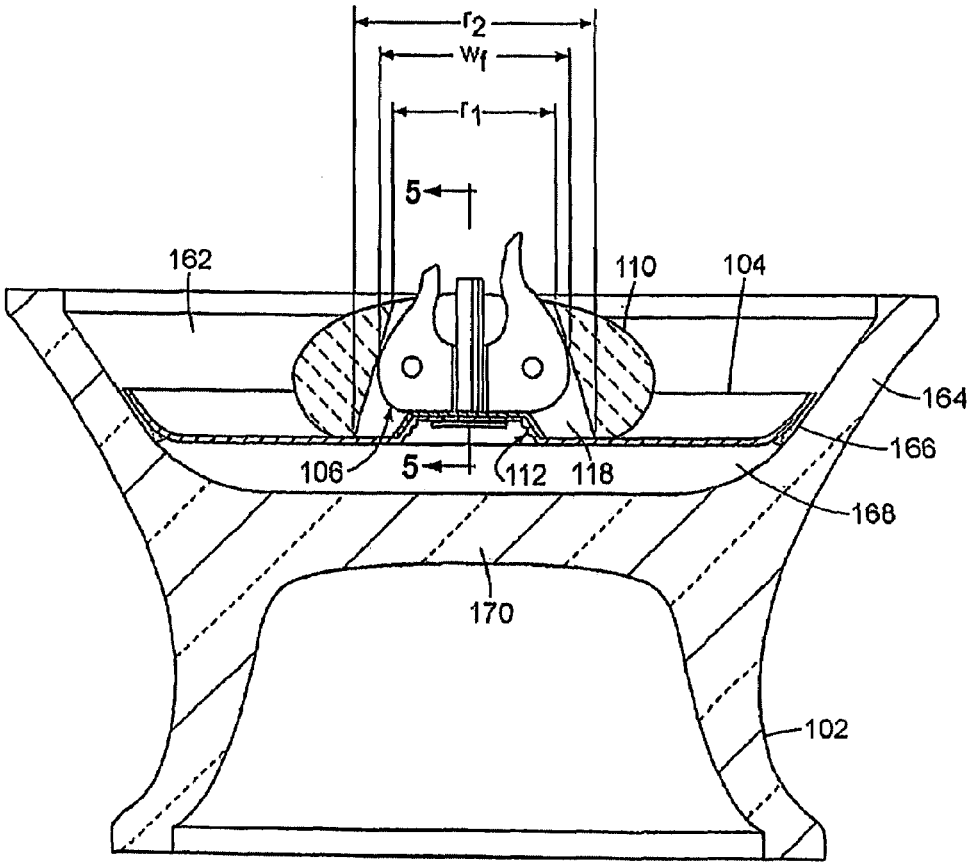
FIG. 4 is a cross-sectional view generally transverse to line 3-3 of FIG. 1 with the candle assembly in assembled form.

As shown in FIG. 4, the support base 102 carries the melting plate 104 within an upper chamber 162, which is generally bowl-shaped. The melting plate 104 in one embodiment is secured to a sidewall 164 of the upper chamber 162 with adhesive 166 thereby providing an empty air space 168 between the melting plate and an intermediate wall 170 of the support base 102. The air space 168 provides additional insulation between the melting plate and the support base 102 to reduce heat loss through the melting plate to the support base. In another embodiment (not shown) the melting plate 104 is adjacent to the intermediate wall 170 with adhesive 166 placed therebetween such that no air space 168 is disposed between melting plate and the intermediate wall. Of course, other arrangements and support configurations for the melting plate 104 are also suitable for supporting the melting plate 104.

In one embodiment of the fuel element 110, the slot 122 has a length $l_1$ in the upper surface 154 that is shorter than a length $l_2$ in the lower surface 156. The length $l_1$ is shorter than a largest width $w_f$ of the fins 120 and the length $l_2$ is longer than the largest width $w_f$ of the heat fins. Such a configuration of the slot lengths $l_1$ and $l_2$ in relation to $w_f$, in addition to the slot widths $w_1$ and $w_2$ as described herein above, facilitates inserting the wick holder 106 fully into the slot from the lower surface 156. Such configuration of the slot 122 and cavity 158 also prevents the slot from fully receiving the wick holder if the fins 120 are inserted into the slot through the upper surface 154 rather than through the lower surface 156, thereby preventing or discouraging improper assembly of the fuel element 110 and the wick holder 106.

Figure 5:
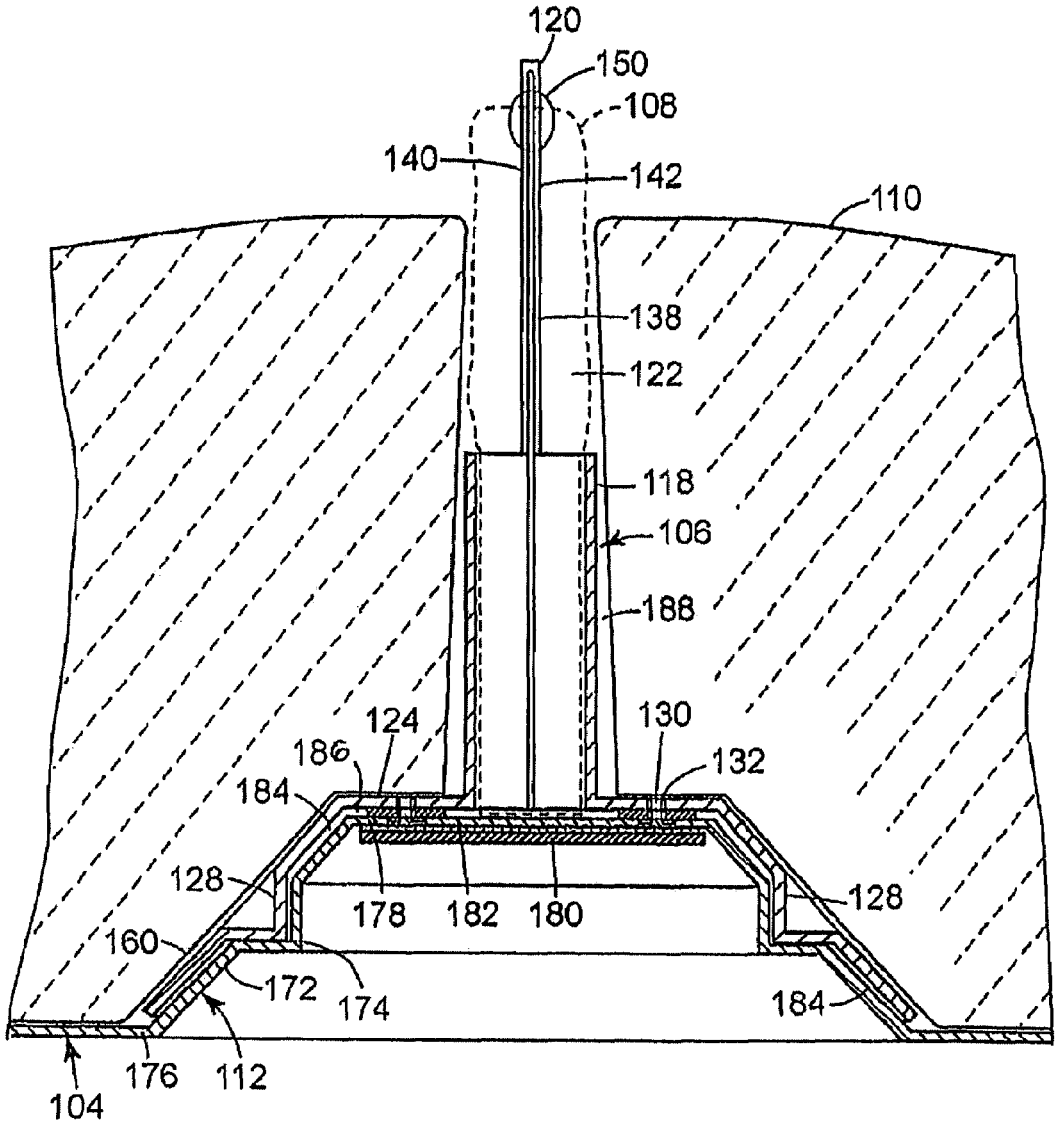
FIG. 5 is an enlarged partial cross-sectional view along the line 5-5 of FIG. 4.

As illustrated in FIG. 5, a portion of the melting plate 104, capillary pedestal 112, wick holder 106, fuel element 110, and wick 108 are shown assembled and ready for use or initial ignition by a user. In one embodiment, the capillary pedestal 112 includes an inclined sidewall 172 having an annular groove 174 extending therearound in a medial position between a floor 176 of the melting plate 104 and a top wall 178 of the capillary pedestal. A magnet 180 is secured to an underside of the top wall 166 with adhesive 182. In another embodiment, the magnet 180 may be disposed on an upper side of the top wall 178 or at another location sufficient to attract the wick holder 106. The spacers 128 are adapted to seat in the annular groove 174 to provide a capillary space 184 between the base skirt 126 and the inclined sidewall 172 sized to facilitate capillary movement of melted or liquid fuel material toward the wick 108. The spacers 128 also help retain the wick holder 106 on the capillary pedestal 112 by seating in the annular groove 174. In addition, the steel rivet 132 in the wick holder 106 is attracted to the magnet 186 when placed over the capillary pedestal 112 and thereby prevents the wick holder from accidentally falling or slipping off of the capillary pedestal. When placed on an underside of the end plate 124, the steel rivets 132 also act as spacers to help maintain the capillary space 184. In another embodiment, magnets 186 may be secured to the end plate 124 by any convenient means, such as with an adhesive or by a rivet, in order to maintain the wick clip 106 in position on the capillary pedestal 112. The cavity wall 160 of the fuel element 110 is shaped to closely fit around the base skirt 126 and barrel 118 of the wick holder 106 and rest on the floor 176 of the melting plate 104 in order to minimize open space 188 between the fuel element and the wick 108, the wick holder 106, and the melting plate floor 176. Minimizing the open space 188 increases the likelihood of having melted fuel material (not shown) being fed directly to the wick 108 rather than falling downwardly to the floor 176 or accumulating in the open space and thereby potentially starving the wick of liquid or melted fuel material while burning. However, as the melted fuel material accumulates about the base of the capillary pedestal 112, whether due to melting from the melting plate 104 or from direct melting by a flame 109 on the wick 108, the melted fuel material is drawn upwardly along the capillary space 184 by capillary action toward the non-consumable wick areas 150 while the candle is burning. The wick 108 in one embodiment extends through the open end 134 of the barrel 118 to touch or nearly touch the top wall 178 of the capillary pedestal 112 so that liquid fuel material drawn up the capillary space 184 will engage the wick 108 and be drawn upwardly therein for eventual burning by a flame burning atop the wick. The wick barrel 118 has an inside diameter sufficient to receive the wick 108. The inside diameter of the barrel 118 may be larger, smaller, or the same as the diameter of the wick and may be uniform or have different diameters along a length thereof. In one embodiment, the inside diameter of the barrel 118 is larger than the diameter of the wick 108 so that the wick may be easily inserted into the barrel. In another embodiment, the inside diameter of the barrel 118 is uniformly approximately 0.012 inch (0.3 mm) larger than the diameter of the wick 108. In yet other embodiments, the inside diameter of the barrel 118 the same size as or smaller than the wick 108. Melted fuel material can seep into the capillary space 184 through the weep holes 130 and thereby prime or facilitate capillary action upward through the capillary space 184. Melted fuel material may also be drawn upwardly in the capillary space 138 between opposing sides 140, 142 of the fins 120 and drawn to the non-combustible wick areas 150 where the melted fuel material is vaporized and ignited by a flame on the wick 108.

Figure 6:
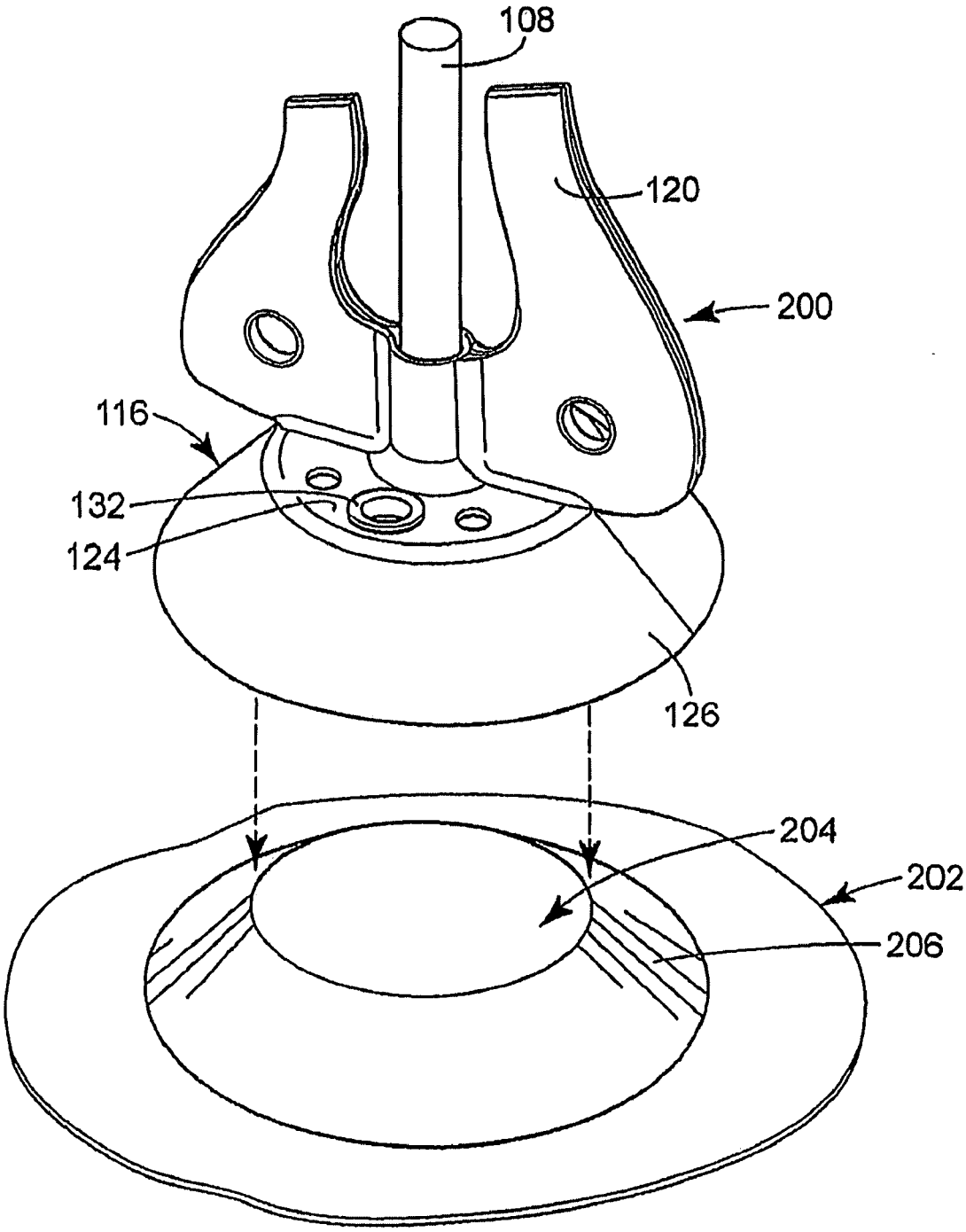
FIG. 6 is an enlarged isometric view of a wick holder and a portion of a melting plate according to another embodiment.

Turning now to FIG. 6, another wick holder 200 and melting plate 202 are shown that are similar to the wick holder 106 and melting plate 104 shown in FIGS. 1-5, except that a capillary pedestal 204 includes a smooth inclined sidewall 206 without the annular groove 174, and the wick holder 200 does not include the spacers 128 in the base skirt 126. A capillary space (not shown), similar to 184, is maintained between the base skirt 126 and the sidewall 206 by steel rivets 132 protruding below an end wall, such as 124, of a base portion 116 of the wick holder 200. In this embodiment, the wick holder 200 is maintained on the capillary pedestal 204 substantially by the attraction between the steel rivets 132 and magnet 180 (not shown in FIG. 6) in the capillary pedestal and any weight of the fuel element 110.

Figure 7:
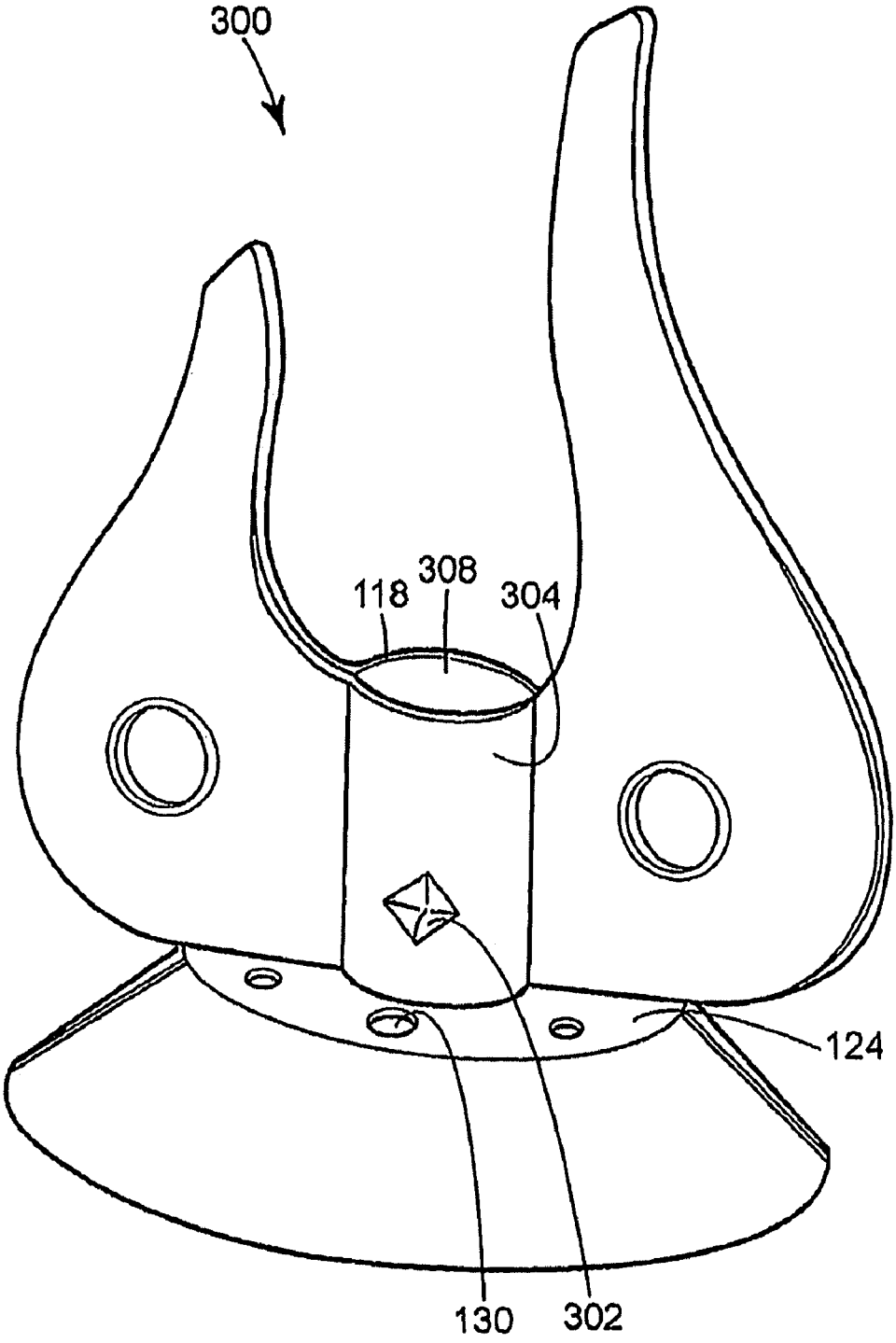
FIG. 7 is an isometric view of still another wick holder according to yet another embodiment.
Figure 8:
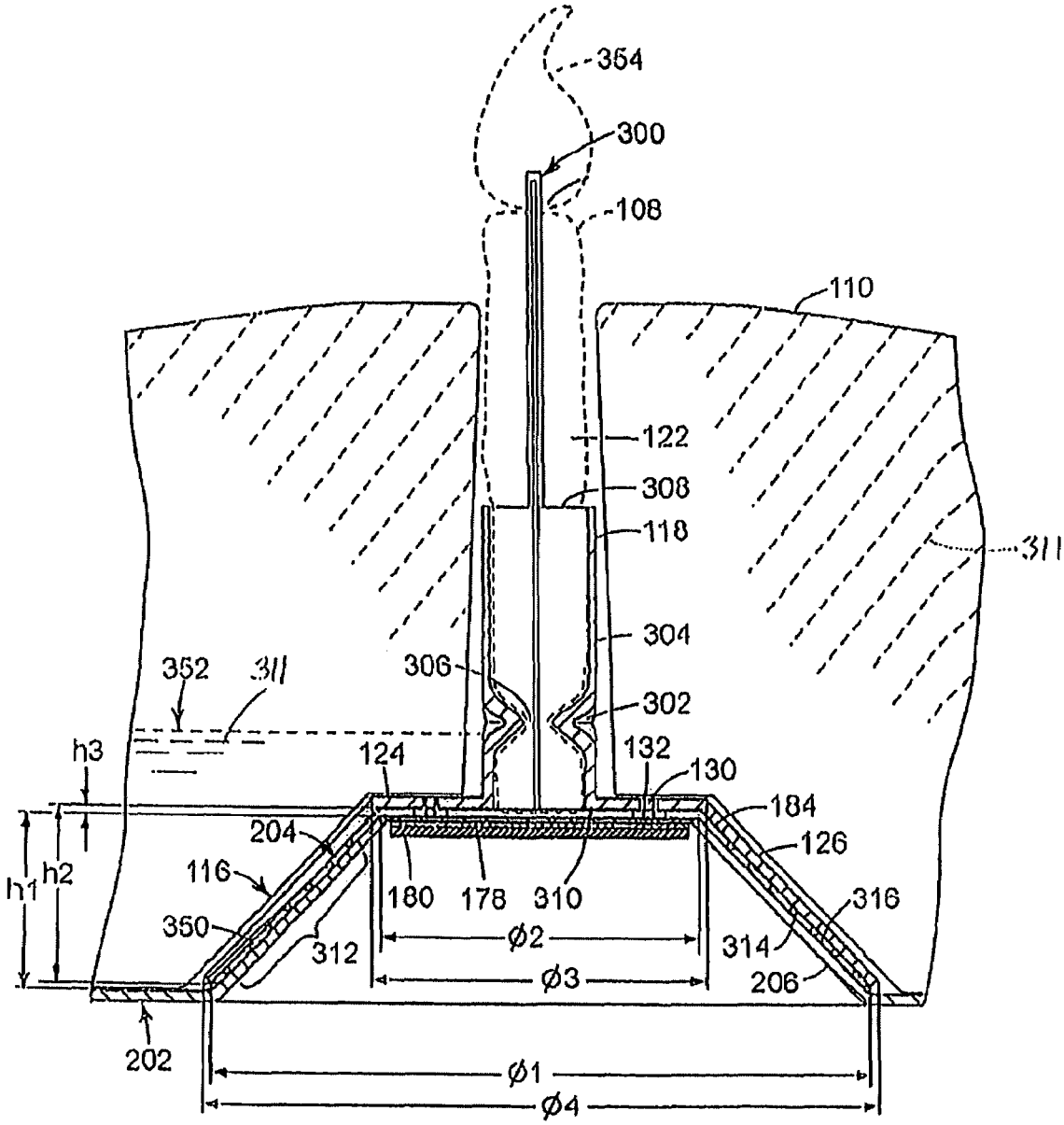
FIG. 8 is an enlarged cross-sectional view of the wick holder shown in FIG. 7 in a similar view as shown in FIG. 5.

Turning to FIGS. 7 and 8, a wick holder 300 of another embodiment for use in a candle assembly, such as 100, is similar to the wick holder 106 (or 200) except that the wick holder 300 also includes a medial portion of the barrel 118 having a cross-sectional area that is less than a cross-sectional area of any other portion of the wick barrel. An indentation 302 in a sidewall 304 of the barrel 118 defines a constricted portion 306 of the barrel located or disposed intermediate opposite ends 308 and 310 of the barrel and having a cross-sectional area less than any other portion of the barrel. The wick 108 extends through the barrel 118 such that a portion or end of the wick adapted to absorb fuel material 311 (when in a melted or otherwise fluid state) extends downwardly through the end 310 and another portion or end of the wick adapted for ignition extends upwardly through end 308. The constricted portion 306 reduces an effective wick cross-sectional area, and thereby may reduce or restrict a capillary fluid flow capacity of the wick between the first open end and the second open end. The restricted flow capacity, and subsequently reduced volume flow rate, of the fluid fuel material 311 up the wick 108 from the end 310 toward a flame region above the end 308, in turn may reduce the fuel material burn rate and extend the life of the fuel element 110. Because the constricted portion 306 having a larger cross-sectional area allows a faster volume flow rate, or increased capillary fluid flow capacity, than a constricted portion having a smaller cross-sectional area, the capillary fluid flow capacity of the wick 108 may be substantially reduced by reducing the cross-sectional area of the constricted portion. Such a constriction on the flow rate of fluid fuel material 311 upwardly along the wick 108 past the constricted portion 306 is enhanced when the sidewall 304 is substantially liquid impervious (for example, does not allow the fluid fuel material to pass therethrough to the wick 108) which thereby restricts the flow of the fluid fuel material into the wick through the end 310 located in the end plate 124 or above the end 308 of the barrel 118. The indentation 302 may also help maintain the wick 108 in a predetermined position within the barrel 118 such that, for example, an end portion of the wick extends through or to the end 310 in order to prevent the wick from being pulled out of the barrel and thus potentially losing contact with the flow of the fluid fuel material 311 toward the wick through the capillary space 184 and weep holes 130.

Other variations and embodiments of the candle assembly and wick holder 300 described in detail herein are also specifically contemplated. For example, in one embodiment, the barrel 118 may take the form of a sleeve having a cylindrical shape or a tubular shape having other cross-sectional areas and shapes. In another embodiment, the constricted portion 306 in the barrel 118 is formed by an inner annular ridge (not shown), which may be formed by indenting or crimping the sidewall 304 entirely around the wick barrel 118 or by an inner annular shoulder disposed on an inner surface of the sidewall 304. The constricted portion 306 in another embodiment may be formed by a single indentation 302 or by a plurality of indentations, which may be either in opposing relationship or offset from each other. In another embodiment (not shown) the barrel 118 may have form of a wick casing that is not generally tubular, but rather includes a longitudinally curved sidewall that encases a portion of the wick 108 and has first and second openings in the sidewall through which the wick extends.

According to another aspect, which is shown in FIG. 8 but which is also applicable to any combination of any of the wick holders and any of the capillary pedestals described herein, the capillary space 184 defines a volume, or capillary well 350, between the base portion 116 of the wick holder 300 and the capillary pedestal 204. The capillary well 350 has dimensions that are preselected to promote a successful sustained relight of the wick 108 after a pool 352 (shown in dashed lines) of the fuel material 311 (such as wax or other meltable fuel) has been formed in melting plate 202 around the peripheral skirt 126 and capillary pedestal 204 and then allowed to solidify. During a sustained burn, a fluid portion of the fuel material 311 from the pool 352 is drawn into the capillary well 350 and up to the wick 108 by capillary action to feed a flame 354 at wick 108. If the flame 354 is extinguished prior to consuming the entire fuel element 110, the pool 352 of fuel material 311 solidifies and extends across the bottom of the melting plate 202, through the capillary well 350, and into the wick 108. In one embodiment, when the wick 108 is re-lit after the pool 352 of fuel material 311 has solidified, the capillary space 184 is dimensioned such that a fluid supply of the fuel material is quickly formed and available in the capillary well 350 to feed the flame 354 via the wick 108 until the fuel material surrounding the peripheral skirt 126 has melted sufficiently to provide a supply of liquefied fuel material to replace the fuel material in the capillary well. For example, if the capillary space 184 is dimensioned too small, there may not be enough fuel material in the capillary well 350 to sustain the flame 354 on the wick 108 during a sustained relight before the pool 352 of fuel material 311 surrounding the peripheral skirt 126 has melted enough to provide additional liquefied fuel to the wick 108. Also, for example, if the capillary space 184 is too large, heat transfer through the solidified fuel material 311 in the capillary well 350 may be too slow to melt enough of the fuel material therein to provide liquefied fuel to the wick 108 before fuel material in the wick is burned. Under either circumstance, the flame 354 may run out of fuel and extinguish prior to melting a sufficient amount of the fuel material 311 in the pool 352 to begin or sustain substantially continuous capillary movement of the fluid fuel material from outside of the capillary space 184, into the capillary well 350, and up the wick 108 to feed the flame 354. Therefore, to assist in a successful sustained relight of the wick 108 in one embodiment, the capillary well 350 has a volume not less than a volume sufficient to provide an amount of melted fuel to the relit wick 108 until a sufficient amount of liquefied fuel is formed from the pool 352 of solidified fuel material 311 adjacent to or surrounding the peripheral skirt 126 to continuously feed the flame 354 by capillary action through the capillary space 184. In another embodiment, the volume of the capillary well 350 is not more than a volume able to allow heat from the flame 354 to melt the solidified fuel material 311 disposed in the capillary space 184 sufficiently rapidly to feed the flame 354 after solidified fuel material 311 carried in the wick is burned.

In a further embodiment, a successful relight can be achieved if the volume of the capillary well 350 is proportional to a thermal mass of an entire candle assembly, such as 100, in order to provide a sufficient source of melted fuel to the wick until the pool 352 of solidified wax has melted sufficiently to provide an adequate flow of fuel to the wick 108 to maintain a sustained burn of the flame 354. The thermal mass of the candle assembly 100 is a measure of the amount of energy needed to change the temperature of the entire melting plate candle by a measured amount and is equal to the sum of the products of the mass of each portion of the candle assembly multiplied by the specific heat of that portion. Illustratively, a successful relight may be achieved when the ratio of the volume of the capillary well 350 to the thermal mass of the entire candle assembly is between about 0.00006 cubic inches per calorie per degree centigrade (hereinafter, $in^3$/cal/° C.) (1 $mm^3$/cal/° C.) and about 0.0006 $in^3$/cal/° C. (10 $mm^3$/cal/° C.), or between about 0.0001 $in^3$/cal/° C. (2 $mm^3$/cal/° C.) and about 0.0004 $in^3$/cal/° C. (6 $mm^3$/cal/° C.), or between about 0.00018 $in^3$/cal/° C. (3 $mm^3$/cal/° C.) and about 0.00024 $in^3$/cal/° C. (4 $mm^3$/cal/° C.). Accordingly, in one embodiment, the thermal mass of the candle assembly is between about 135 cal/° C. and about 10 cal/° C., or between about 75 cal/° C. and about 40 cal/° C., or between about 61 cal/° C. and about 50 cal/° C., and the volume of the capillary well 350 is between about 0.006 $in^3$ (100 $mm^3$) and about 0.03 $in^3$ (500 $mm^3$), or between about 0.009 $in^3$ (150 $mm^3$) and about 0.018 $in^3$ (300 $mm^3$), or about 0.012 $in^3$ (200 $mm^3$).

For example, the thermal mass of an embodiment of a candle assembly, such as 100, includes the support base 102, the melting plate 202, and the wick holder 300 having a combined thermal mass of about 50 cal/° C. and the fuel element 110 of approximately 0.53 oz. (15 g) of wax having a thermal mass of about 10.5 cal/° C. before being burned. The capillary pedestal 204 has a generally frustoconical shape with a height h1 between about 0.39 inches (10 mm) and about 0.04 inches (1 mm), or about 0.2 inches (5 mm), a bottom radius Φ1 between about 1.18 inches (30 mm) and about 0.39 inches (10 mm), or about 0.83 inches (21 mm), and a top radius Φ2 between about 0.04 inches (1 mm) and about 0.79 inches (20 mm), or about 0.43 inches (11 mm). The base 116 has a frustoconical shape generally complementary to the capillary pedestal with the peripheral skirt 126 having an upper diameter Φ3 of between about 0.08 inches (2 mm) and about 0.83 inches (21 mm), or between about 0.43 inches (11 mm) and about 0.55 inches (14 mm), or about 0.51 inches (13 mm); a bottom diameter Φ4 between about 1.22 inches (31 mm) and about 0.43 inches (11 mm), or about 0.79 inches (20 mm) and about 0.91 inches (23 mm), or about 0.87 inches (22 mm); a height h2 between about 0.43 inches (11 mm) and about 0.08 inches (2 mm), or between about 0.28 inches (7 mm) and about 0.16 inches (4 mm), or about 0.2 inches (5 mm); and a height h3 of the rivets 132 from the end plate 124 of between about 0.004 inches (0.1 mm) and about 0.04 inches (1 mm), or between about 0.03 inches (0.8 mm) and about 0.02 inches (0.5 mm), or about 0.02 inches (0.6 mm). In another embodiment, the capillary pedestal 204 has a height h1 about 0.18 inches (4.7 mm), a bottom radius Φ1 about 0.81 inches (20.5 mm), a top radius Φ2 about 0.44 inches (11.1 mm), and the base 126 has a skirt 126 having an upper diameter Φ3 about 0.5 inches (12.6 mm), a bottom diameter Φ4 about 0.85 inches (21.6 mm), and a height h2 about 0.2 inches (5.05 mm). When the base 116 is placed on top of the capillary pedestal 204, the end plate 124 is a perpendicular distance of about 0.03 inches (0.65 mm) from a top wall 178 of the capillary pedestal, and the peripheral skirt 126 is perpendicular distance of about 0.02 inches (0.38 mm) from the sidewall 206, which defines a capillary well 350 having a volume of approximately 0.012 $in^3$ (200 $mm^3$).

Figure 9:
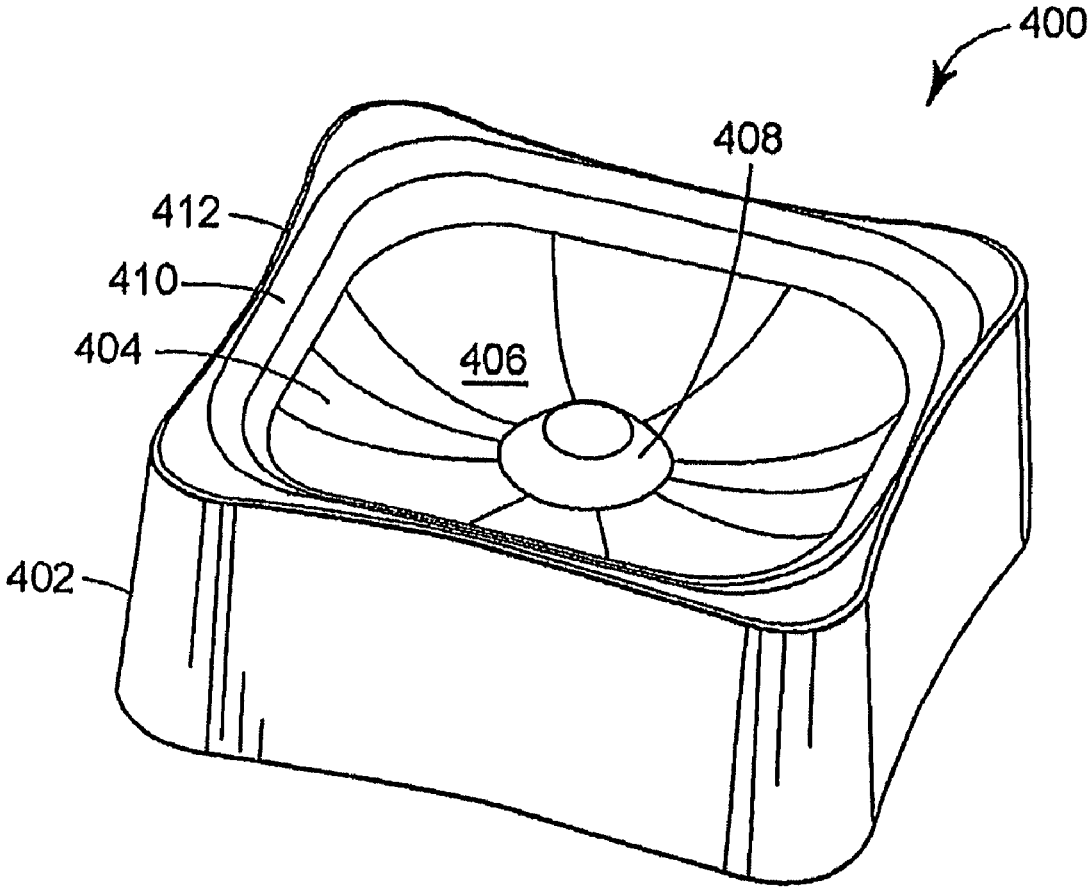
FIG. 9 is an isometric view of a candle assembly according to another embodiment.

Turning now to FIG. 9, a melting plate candle assembly 400 according to another aspect is shown including a holder or base 402 and a generally concave melting plate 404 carried within a recessed portion 406 of the base. A solid fuel element and wick holder similar to those already described herein that rest on the melting plate are not shown for purposes of clarity. The melting plate 404 has high thermal conductivity and is similar to other melting plates described previously herein, including a capillary pedestal 408 protruding upwardly therefrom at a centrally disposed wick location. The base 402 includes a wall 410 extending around and angularly disposed outwardly at a zenith angle θ from the melting plate 404 and having an uppermost or top edge 412 disposed above the melting plate. In one aspect, the base 402 and the melting plate 404 have a geometry that is adapted to increase or promote substantially laminar air flow (when surrounded by a calm atmospheric environment) over a pool of molten or liquefied fuel when a flame is disposed in close proximity above the pool during a burn, such as, for example, when a flame is present on a wick such as the wick 108. Such laminar air flow controls the overall temperature of the pool by reducing eddy currents over the pool and/or reducing or minimizing localized hot spots in the pool, which slows volatilization of active volatile ingredients in the fuel, such as a fragrance or insecticide, and thereby extends an effective fragrancing period of the fuel until the fuel is completely burned. When all the fuel is liquefied in the pool during the burn of the melting plate candle, air may be drawn in substantially laminar flow over the top edge 412 of the wall 410 into the recessed portion 406, over the melting plate 404 and a pool of liquefied fuel, such as melted wax, by a heat chimney, or upward air currents, caused by a flame on a wick (not shown) disposed over the capillary pedestal 408. The air currents ascending up the heat chimney also distribute the volatilized active ingredient into the surrounding environment.

In one embodiment, the base 402 and the melting plate 404 have a geometry to increase or promote substantially laminar air flow described by the following equations:

$$20{,}000\ \text{mm}^2+(P\text{min}^2-P\text{max}^2)\geqq SA\geqq 2{,}500\ \text{mm}^2+(P\text{max}^2-P\text{min}^2); \quad 1.$$

$$Dp\text{max}\leqq(SA/1{,}000\ \text{mm})+\{[(H\text{min}-P\text{min})/2]\sin\theta\}; \quad 2.$$

$$P\text{min}\geqq 6(Dp)(\cos\theta);\ \text{and/or} \quad 3.$$

$$H\text{min}\approx P\text{min}+2[R+(Dp-R)\tan\theta]; \quad 4.$$

in which:

Pmax is a maximum width across the melting plate 404 in mm;

Pmin is a minimum width across the melting plate 404 in mm;

SA is a projected surface area, or surface area of a two-dimensional projection of an outline, of the melting plate 404 in square millimeters;

Hmin is a minimum width of the base 402 at the top edge 412 in mm;

Dp is a depth of the melting plate 404 from the top edge 412 of the base 402 in mm;

Dpmax is a maximum value for Dp in mm;

R is an outside radius of the upper edge of the base 402 in mm; and

θ is the zenith angle of the wall 410 in degrees.

Equation 1 quantifies an approximate relationship of the projected surface area of the melting plate and the width across the melting plate, within upper and lower constant boundaries, to promote the laminar air flow. Equation 2 quantifies an approximate relationship of the projected surface area of the melting plate 404 and the depth of the melting plate 404 from the top edge 412 of the base 402 to promote the laminar air flow. Equation 3 quantifies an approximate relationship of the minimum melting plate across the melting plate and the depth of the melting plate 404 from the top edge 412 of the base 402 and the zenith angle of the base wall 410 to promote the laminar air flow. Equation 4 quantifies an approximate minimum width of the base 402 at the top edge 412 as a function of the geometries of the melting plate 404 and the base to promote the laminar airflow. Although the equations 1-4 above have been described in relation to a generally rectangular base and holder, the relationships may also be used with other candle assembly shapes, such as oval and circular, in order to approach an optimized candle assembly geometry. For example, in one embodiment comprising a circular base and melting plate, such as the base 102 and melting plate 104 shown in FIG. 4, Hmin is approximately 3.94 inches (100 mm), Pmax and Pmin are both equal to approximately 3.15 inches (80 mm), Dp is approximately 0.4 inch (10 mm), R is approximately 0.08 inch (2 mm), and θ is approximately 45°.

Figure 10:
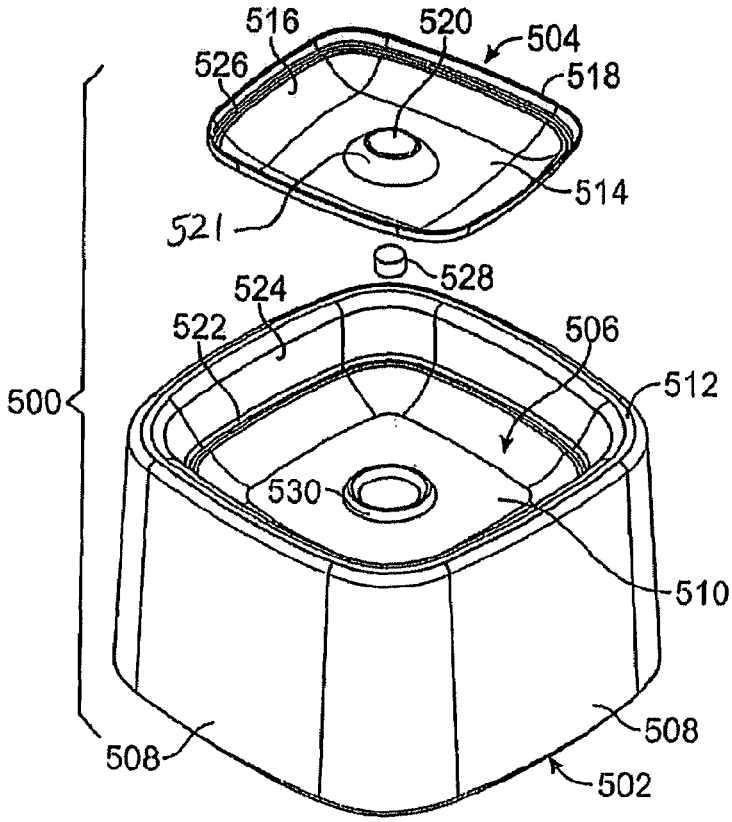
FIG. 10 is an exploded isometric view of a candle assembly according to yet another embodiment.
Figure 11:
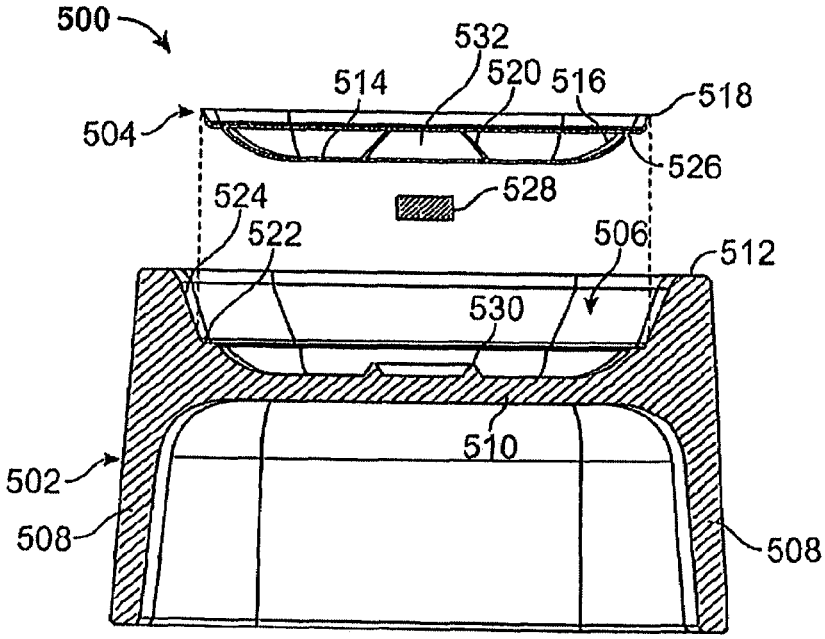
FIG. 11 is an exploded cross-sectional view of the candle assembly of FIG. 10 along a vertical plane at a centerline thereof.

FIGS. 10 and 11 show a candle assembly 500, which is generally similar to the candle assembly 400 except that the candle assembly 500 includes an alignment mechanism for ensuring proper alignment of a melting plate 504 with a base portion 502. The candle assembly 500 includes the base portion 502 and the melting plate 504 for supporting a votive candle such as the combination of the fuel element 110, wick holder 106, and wick 108. The base portion 502 is made of a non-flammable material with low heat transmissivity, such as glass or ceramic, and the melting plate is made of a non-flammable material with high heat transmissivity, such as aluminum or other metal, although other materials may also be used. The base portion includes a recess 506 in a top end thereof defined by four upstanding sidewalls 508 and a medial wall 510 spanning the sidewalls spaced below an upper rim 512 of the sidewalls. A bottom end of the base 502 is hollow under the medial wall 510. It is to be understood that the specific shape and configuration of the sidewalls 508 and the bottom end of the base 502 may take almost any shape and form and are not limited to the specific shapes described herein. The melting plate 504, which is dish- or bowl-shaped, concaves upwardly with a bottom surface shaped generally complementary to the recess 506 so as to be received in the recess in an operative position. The melting plate 504 has a generally square footprint with a relatively flat bottom wall 514 surrounded by a raised or upwardly curved peripheral portion 516 adjacent an outer peripheral edge 518. The melting plate 504 further includes a capillary lobe 520 with a capillary wall 521 extending upwardly, for example, at an angle from about 30° to about 60° from horizontal, from a central portion of the bottom wall 518 for receiving the votive candle (not shown) disposed centrally thereon in a similar manner as described previously herein. The capillary wall 521 is so configured that when the wick holder 106 with a complementary capillary wall 127 is placed upon capillary wall 521, a capillary space (not shown) is formed between the capillary walls to allow capillary flow of melted fuel from the melting plate 504 to the wick 108 through the capillary space.

An alignment mechanism for ensuring proper alignment of the melting plate 504 within the recess 506 of the base 502 includes a shoulder, such as horizontal step 522, that projects inwardly from an interior side 524 of the sidewalls and extends entirely around the recess 506, and a complementary ledge, such as horizontal ledge 526, that rests on the shoulder. The ledge 526 extends around the melting plate and is vertically disposed between the peripheral edge 518 and the bottom wall 514 of the melting plate 504 and rests on the horizontal step 522 with the peripheral edge pressed against the inner surface 524 of the sidewalls 508 around the entire recess 506. The entire melting plate, including the capillary lobe 520 and the peripheral edge 518, is disposed below the upper rim 512. The melting plate 504 is spaced above the medial wall 510 in the recess 506 with the raised peripheral edge portions 516 pressed against the inner surface 524 of the sidewalls 508 and the capillary lobe 520 projecting upwardly. The melting plate 504 is secured to the base 502 with a bead of adhesive, such as the adhesive 166 (not shown), disposed between the ledge 526 and the shoulder 522. The adhesive may also provide a seal between the peripheral edge 518 of the melting plate 504 and the interior surface 524 of the sidewalls 508 to prevent melted wax or other liquids from seeping under the melting plate. Other substantially complementary alignment configurations may also or alternatively be used for alignment mechanisms. For example, the base shoulder may only include one or more discrete spaced apart step portions, and the melting plate ledge may be continuous or match the discrete ledge portions to provide only one possible correct mating fit between the melting plate and the base. In one embodiment, the alignment feature helps ensure that the melting plate 504 is located in a predetermined relation to the base 502 so that the bottom wall 514 of the melting plate is substantially level and spaced above the medial wall 510 to ensure that melted wax pools around the capillary lobe when the candle assembly 450 is placed on a level support surface and minimize heat loss from the melted wax into the base. Of course, the alignment feature may be readily modified to cause a melting plate to rest within the recess in other alignment configurations, such as with the bottom wall 514 contacting the medial wall 510 and/or with the bottom wall 514 disposed at a non-level angle. In yet another embodiment (not shown), the alignment feature may include one or more raised protrusions disposed anywhere within the recess 506 that engage complementary ledges or cavities in the melting plate 504 so as to provide a predetermined alignment between the base 502 and the melting plate. Further, the protrusions may be integral with the base 502, or the protrusions may be formed by a separate object, such as a wire or button (not shown), placed in the cavity. Another alignment mechanism (not shown) may include only one of the ledge and the shoulder without an opposing complementary shoulder or ledge, respectively, wherein the ledge or shoulder urges the melting plate into a predetermined alignment or orientation to the base.

A retainer feature for a magnet 528, such as a circular ring 530 projecting upwardly from a central area of the medial wall 510, is disposed below a cavity 532 in the bottom surface of the melting plate 504 underneath the capillary lobe 520. The ring 530 extends upwardly into the cavity 532 without engaging the bottom surface of the melting plate. The ring 530 acts as a retainer for the magnet 528, which is glued to the melting plate 504 inside the cavity 532, in case the magnet should become unglued from the melting plate. In one embodiment, the ring 530 does not engage, or is spaced from, the bottom surface of the melting plate in order to minimize loss of heat from the melted wax to the base. The retainer is not limited to the specific circular ring form shown in the drawings, but may take other shapes that would help retain the magnet 528 in a predetermined position underneath the capillary lobe 520. For example, the retainer may be a plurality of spaced projections that partially surround the magnet 528, and the magnet may be shaped so as to interfit with the spaced projections in a predetermined orientation. In another example, the retainer may engage the bottom surface of the cavity 532 to help align the melting plate 504 within the recess 506 in addition to the shoulder 522 and ledge 526. In addition, the alignment feature retainer feature may be readily adapted to work with any other combination of base and melting plate disclosed herein, such as the base 102 and circular melting plate 104, and are not limited to the particular base and melting plate of this embodiment.

Figure 12:
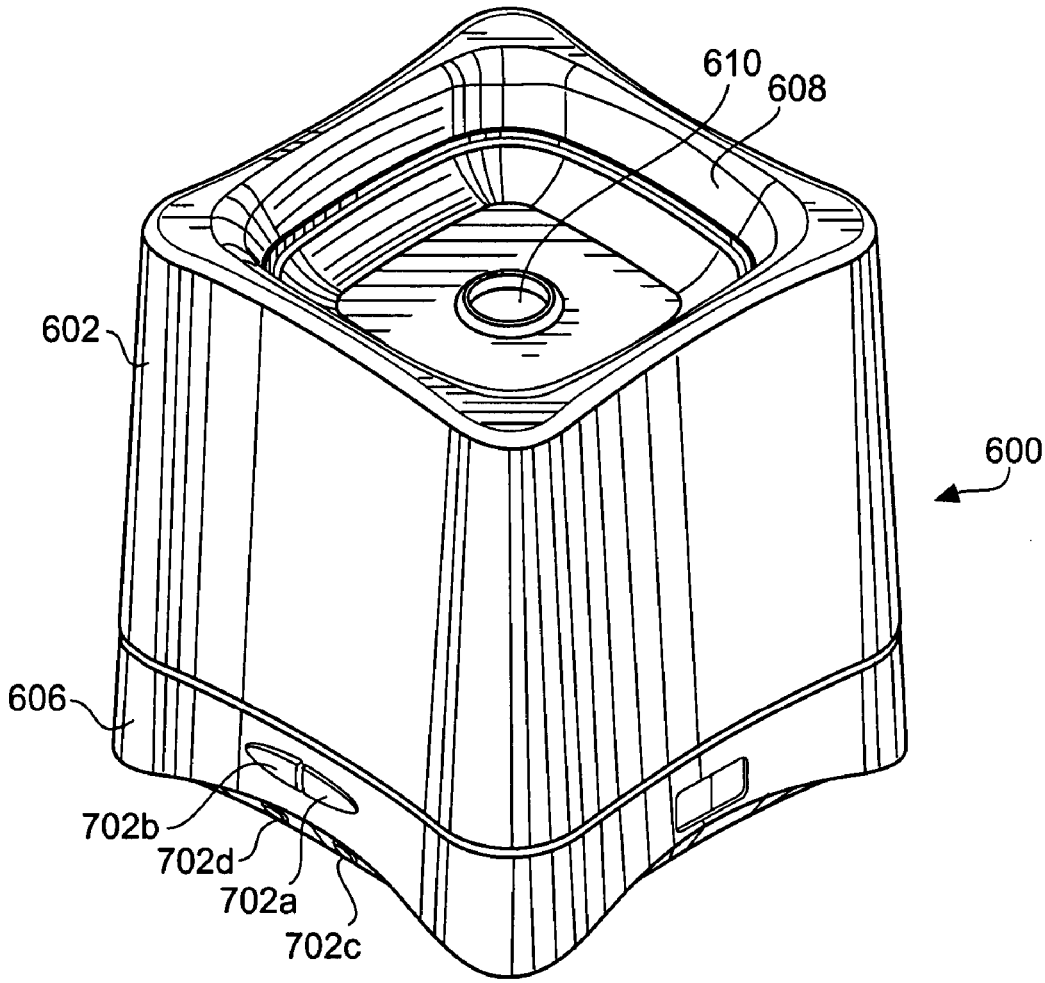
FIG. 12 is an isometric view of a further embodiment of a candle assembly incorporating sound and/or light features.
Figure 13:
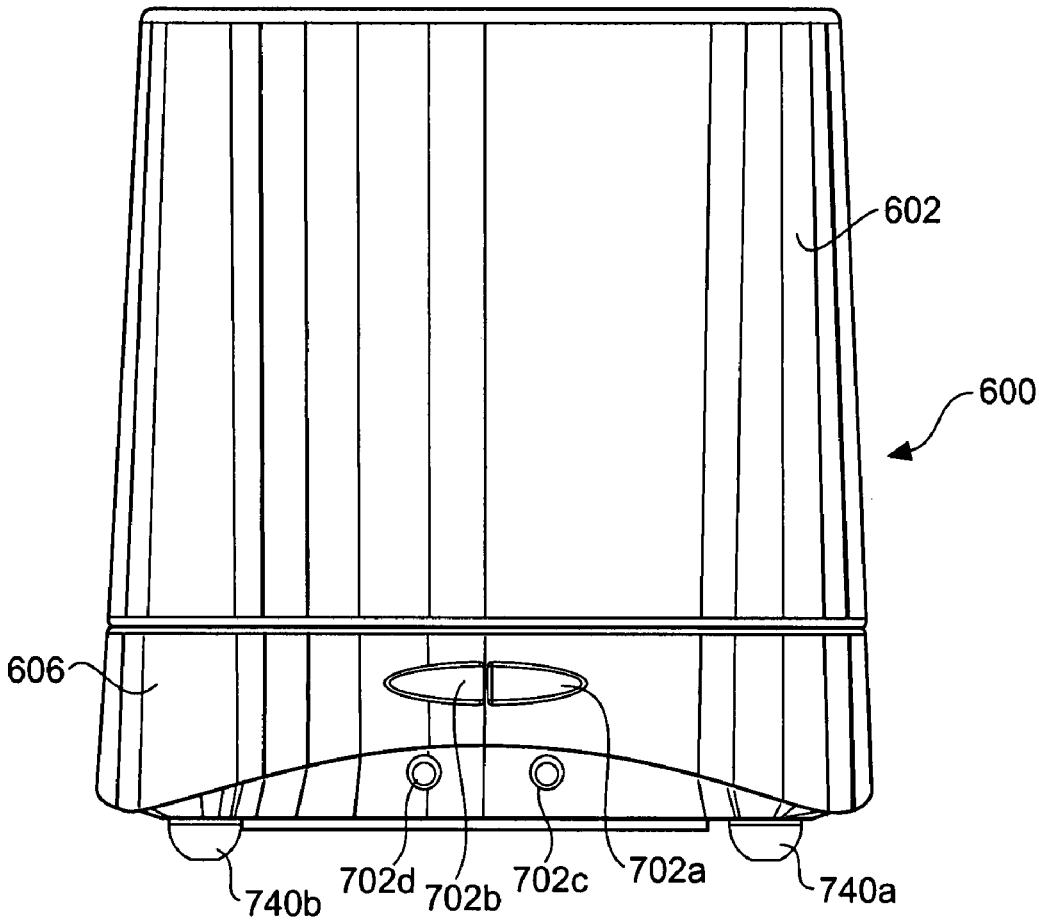
FIG. 13 is a side elevational view of the candle assembly of FIG. 12.
Figure 14:
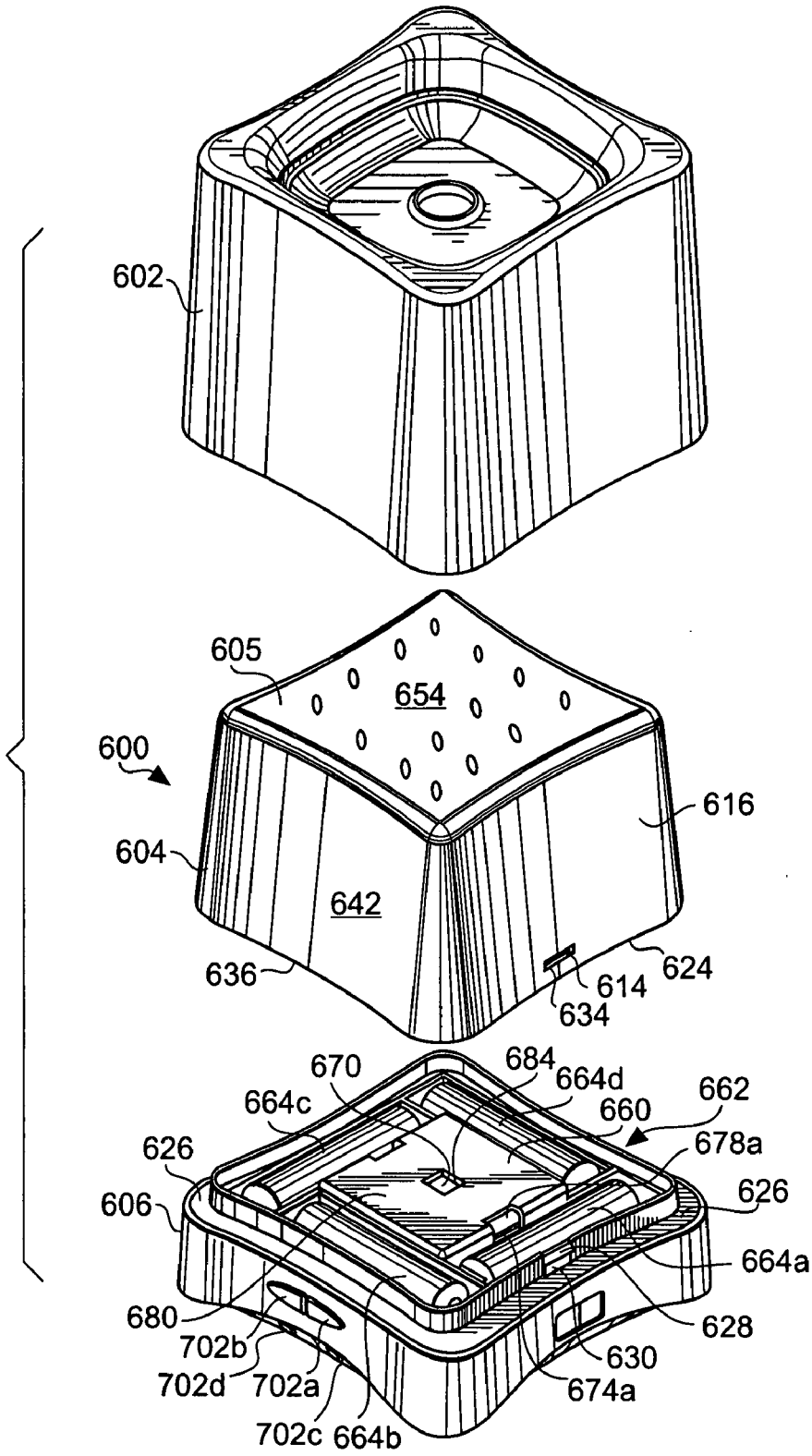
FIG. 14 is an exploded isometric view of various portions of the candle assembly of FIG. 12 illustrating upper, front, and right-hand surfaces thereof.
Figure 15:
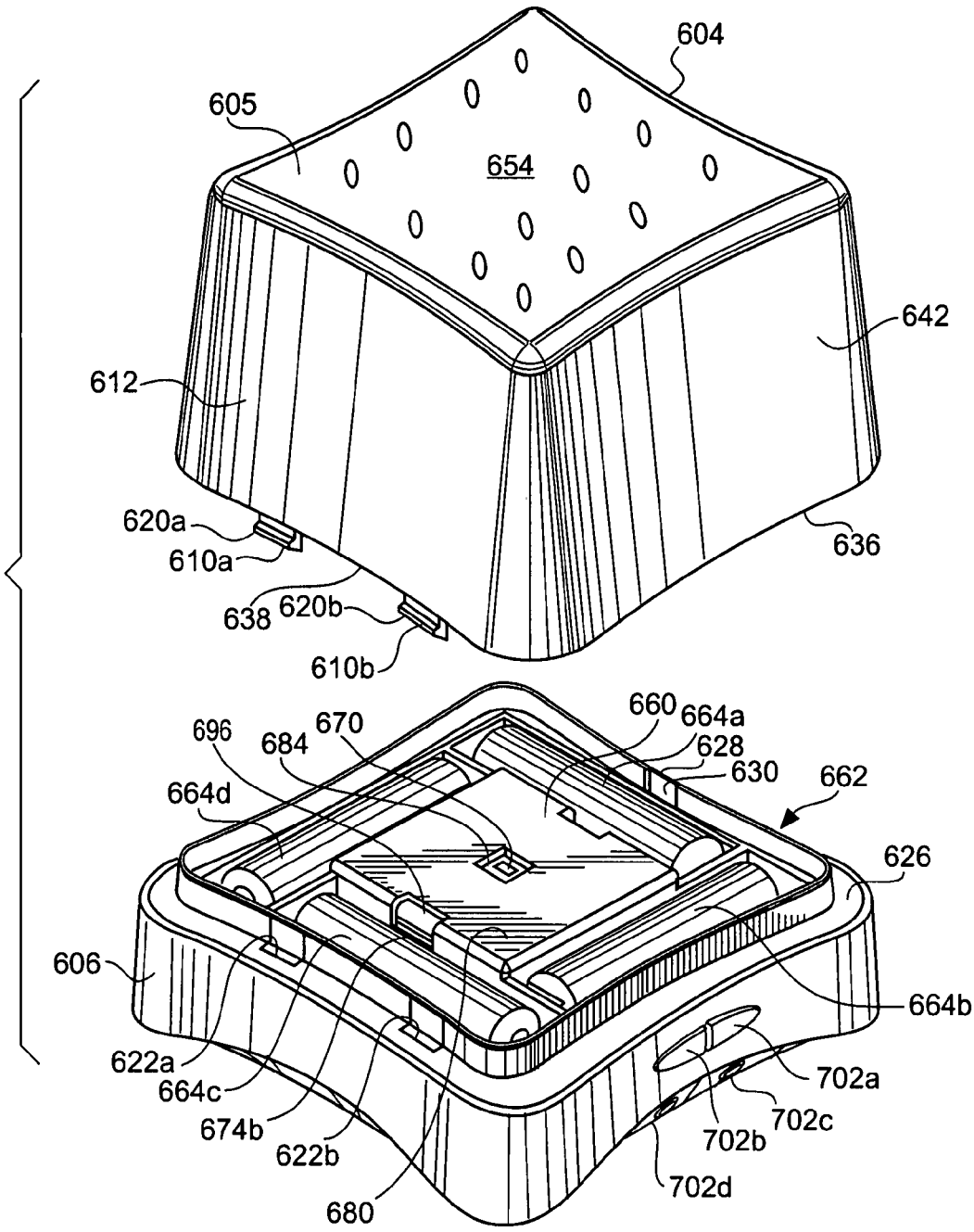
FIG. 15 is an exploded isometric view of the control unit and diffuser of the candle assembly of FIG. 12 illustrating upper, front, and right-hand surfaces thereof.

FIGS. 12-14 illustrate another embodiment of a candle assembly 600. The candle assembly 600 includes a support base 602, an optional light diffuser 604 and a control unit 606. In one embodiment, the base 602 is similar or identical to the bases 102, 402, and 502 described previously and a melting plate 608 is secured therein, again as described in connection with the preceding embodiments. Although not shown, a magnet may be disposed below a pedestal 610 and a wick clip, wick, and fuel element are removably disposed on the pedestal 610 and are retained thereon by magnetic forces developed by a magnet.

The base 602 in another embodiment is made of clear or transparent glass, although other materials may be used having the same or different optical characteristics.

The diffuser (FIG. 14) 604 is disposed within the base 602 and, in one embodiment, snuggly and conformingly fits within a recess thereof. The diffuser 604 may be made of a translucent thermoplastic that is injection molded, or otherwise formed. When the diffuser 604 is made of materials resistant to bonding and/or considered to be unbondable to other objects made of the same and/or different materials, geometric surface features 605 may be included in the diffuser to enable the use of conventional and/or unconventional adhesives to bond the diffuser to other objects including, for example, the base 602. Referring specifically to FIGS. 14-17, the diffuser 604 includes a pair of tabs 610*a*, 610*b* depending downwardly from a left-hand surface 612 (the terms left, right, front, back, top, bottom, upper and lower, as used herein are used for convenience only to note relative placement of various elements, and are not used in a limiting sense whatsoever). Further, a slot 614 is disposed in a lower portion of a right-hand sidewall 616 of the diffuser 604. The diffuser 604 is mounted on the control unit 606 by placing outturned flanges 620*a*, 620*b* of the tabs 610*a*, 610*b*, respectively, into corresponding recesses 622*a*, 622*b*, respectively with the diffuser 604 tipped or angled such that a lower edge 624 of the right-hand wall 616 is spaced upwardly away from a support surface 626 of the control unit 606. The diffuser 604 is then rotated such that the lower edge 624 of the right-hand wall 616 is brought down toward the support surface 626, whereupon an outturned flange 628 of a tab 630 is eventually deflected toward a center of the control unit 606 due to interference with an inner surface 632 of a lower portion 634 of the diffuser 604. Continued downward pivoting of the diffuser 604 causes the outturned flange 628 of the tab 630 to enter the slot 614, whereupon the lower edge 624 of the right-hand wall 616, as well as lower edges 636, 638, and 640 of a front surface 642, the left-hand surface 612 and a rear surface 644, respectively, of the diffuser 604 rest on the support surface 626.

The diffuser 604 may be removed from the control unit 606 by displacing the front and rear surfaces 642, 644 inwardly, thereby causing at least the right-hand sidewall 616 to deflect outwardly so that the outturned flange 628 of the tab 630 is moved out of interfering contact with the inner surface 632 of the lower portion 634. The diffuser 604 may then be pivoted upwardly and the tabs 610*a*, 610*b* may be removed from the recesses 622*a*, 622*b*, respectively.

Figure 16:
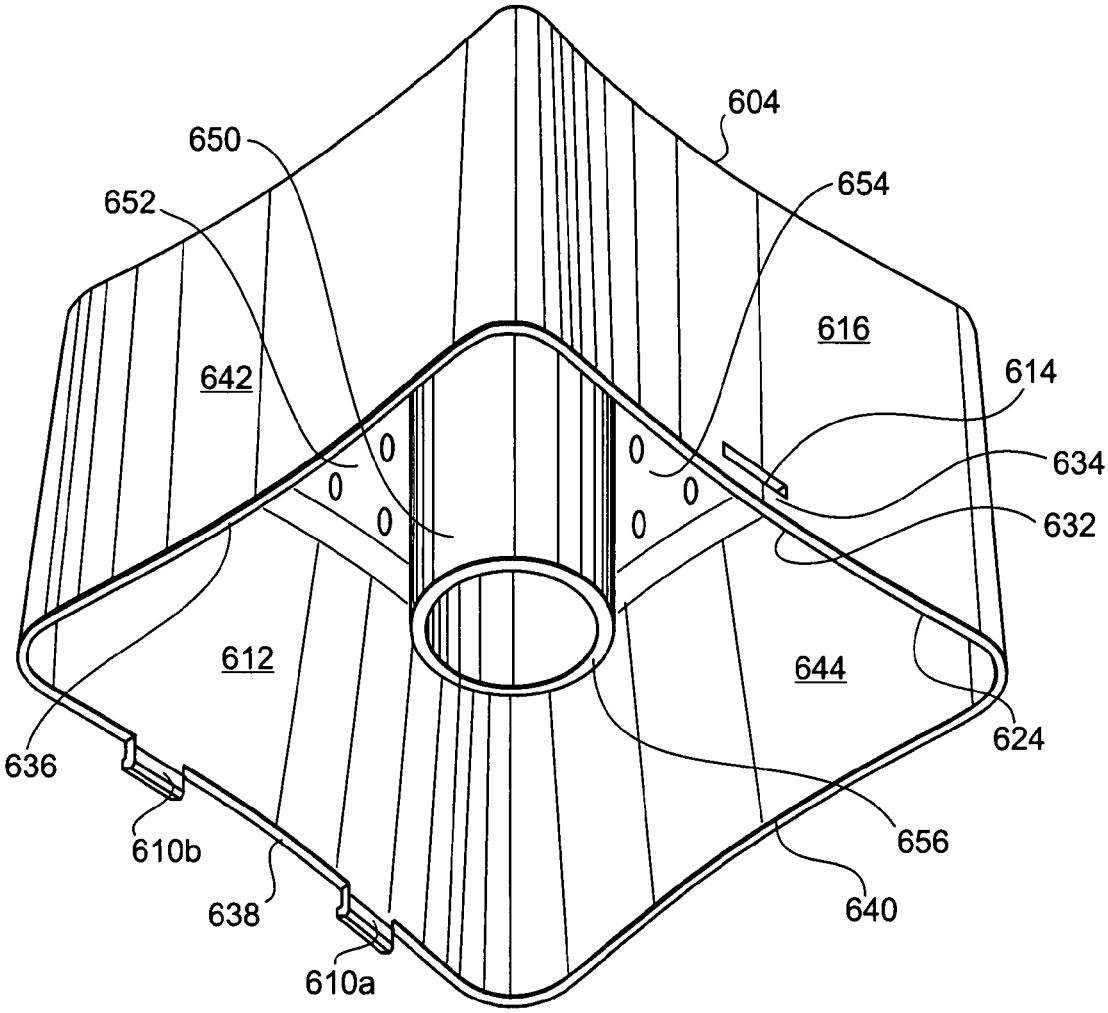
FIG. 16 is an isometric view of the diffuser of FIG. 12 taken from below.
Figure 17:
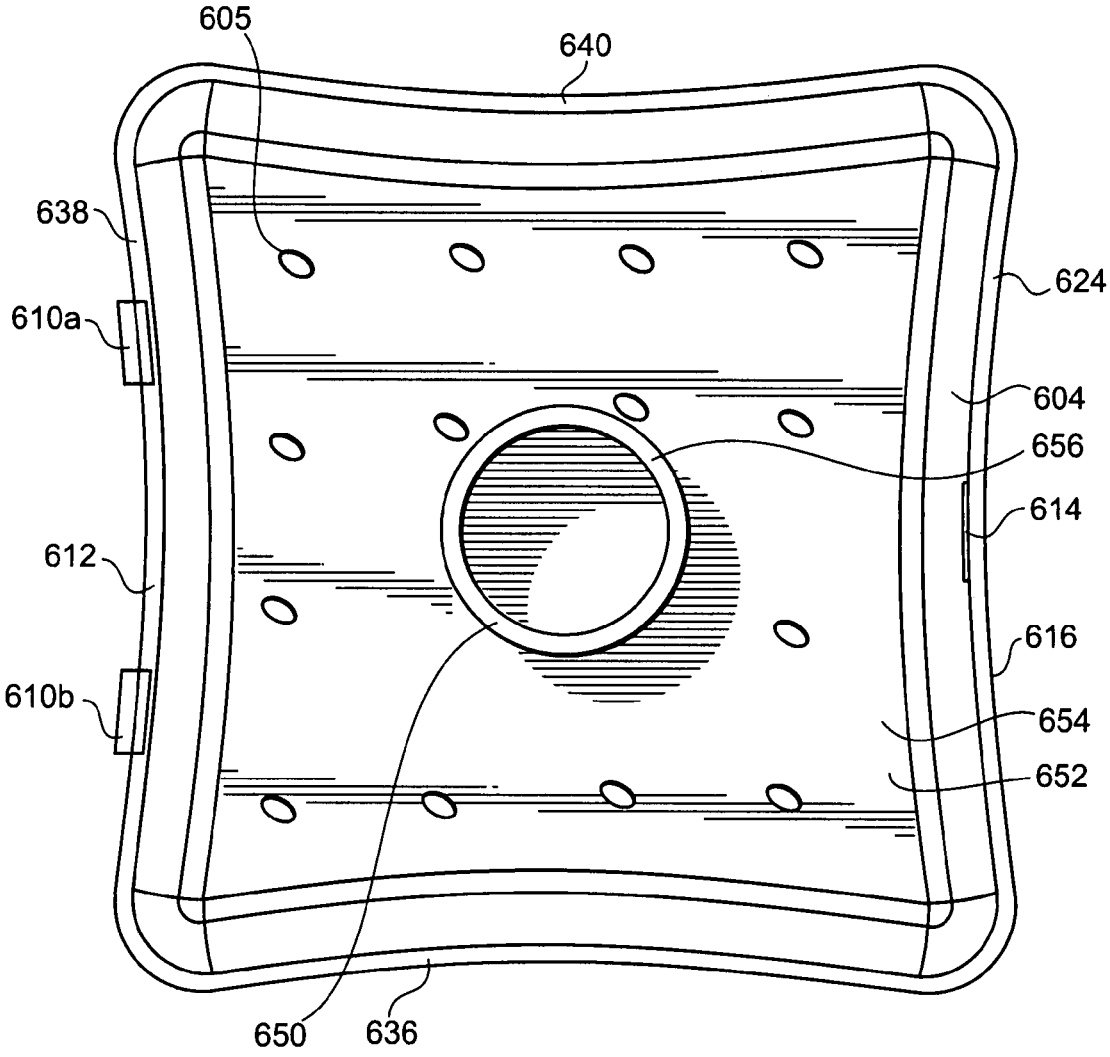
FIG. 17 is a bottom elevational view of the diffuser of FIG. 12.

As referring specifically to FIGS. 16 and 17, the diffuser 604 further includes a hollow cylindrical member 650 that depends downwardly from an inner surface 652 of an upper wall 654. The cylindrical member 650 is closed ended where the member 650 meets the inner surface 652 and is open ended at a lower end thereof. In one embodiment, the cylindrical member 650 is fabricated of the same material as the diffuser 604, and either or both are translucent or, optionally, transparent. In another embodiment, although not necessarily, a lower edge 656 of the cylindrical member 650 is in contact with a planar surface 660 of a battery holder 662 (FIGS. 14, 15, and 18) of the control unit 606. Alternatively, the lower edge 656 may be spaced from the planar surface 660 when the diffuser 604 is mounted on the control unit 606, if desired.

Referring next to FIGS. 14, 15, and 18-21, the battery holder 662 includes recesses for receiving four AA sized batteries 664*a*-664*d*. If desired, a greater or lesser number of batteries may be provided depending upon electrical requirement.

Figure 18:
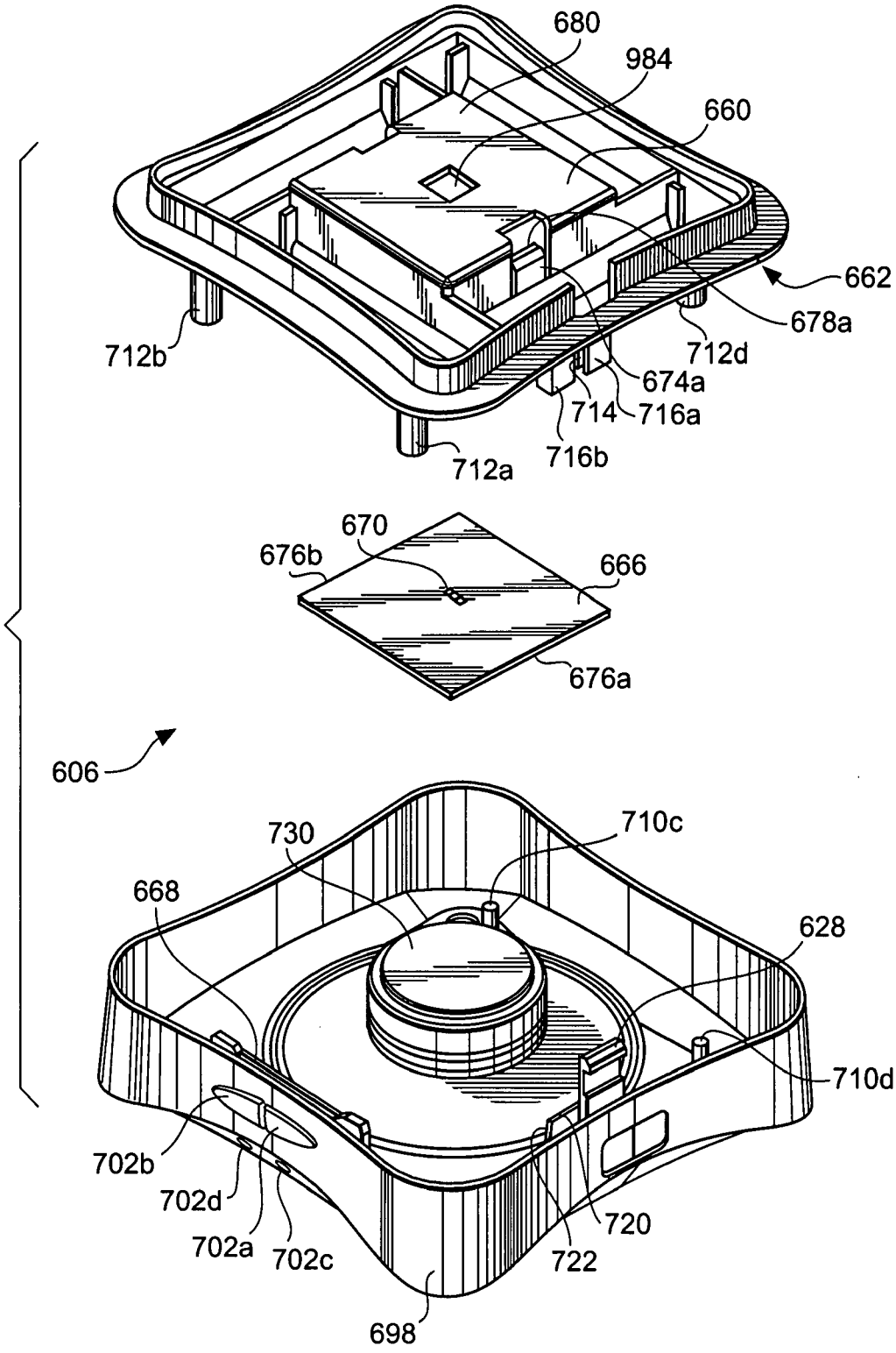
FIG. 18 is an exploded isometric view of the control unit and diffuser of the candle assembly of FIG. 12 illustrating upper, front, and left-hand surfaces thereof.
Figure 19:
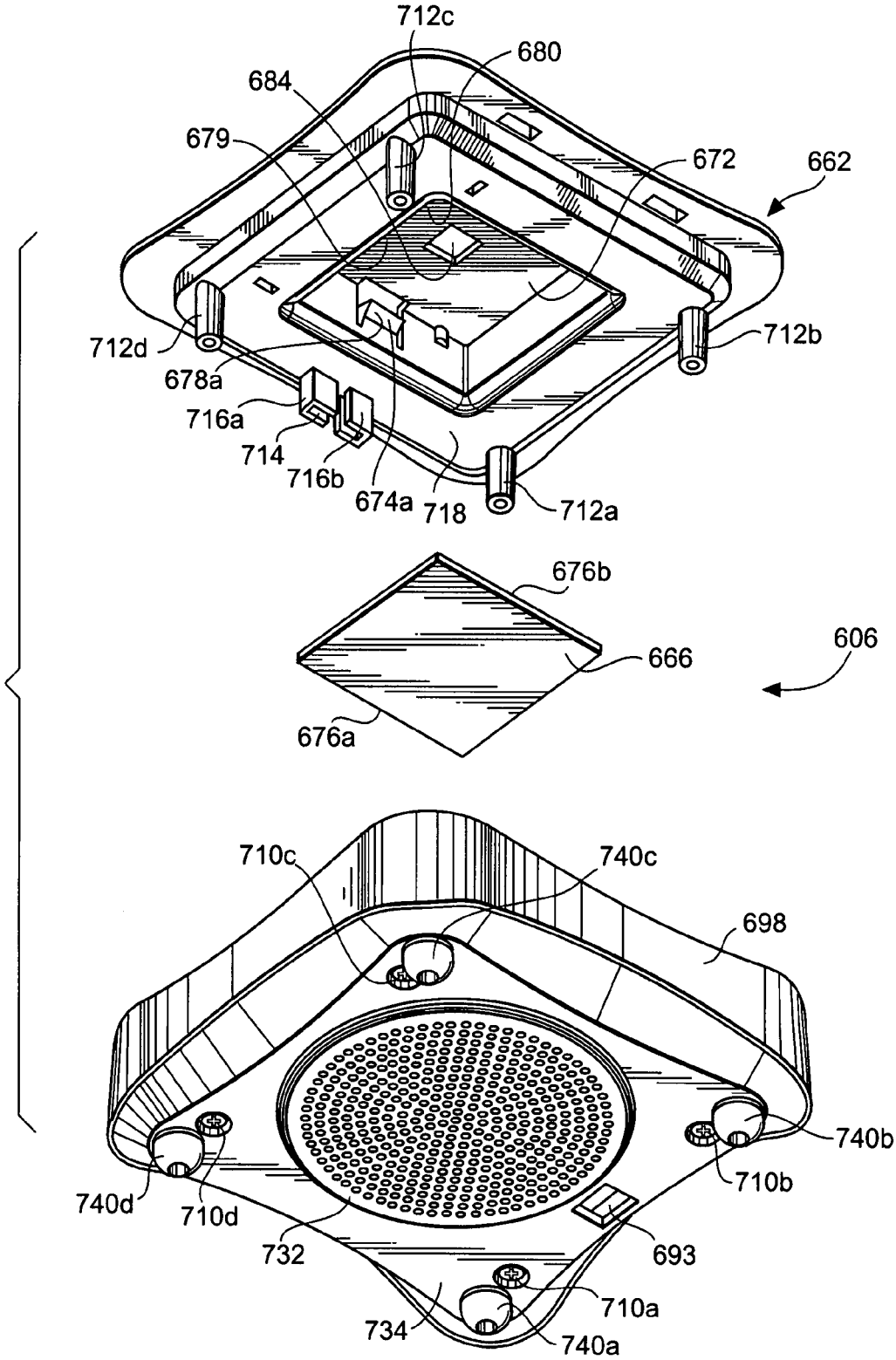
FIG. 19 is an exploded isometric view of portions of the control unit of the candle assembly of FIG. 12 taken from below and illustrating lower, rear, and left-hand surfaces thereof.
Figure 20:
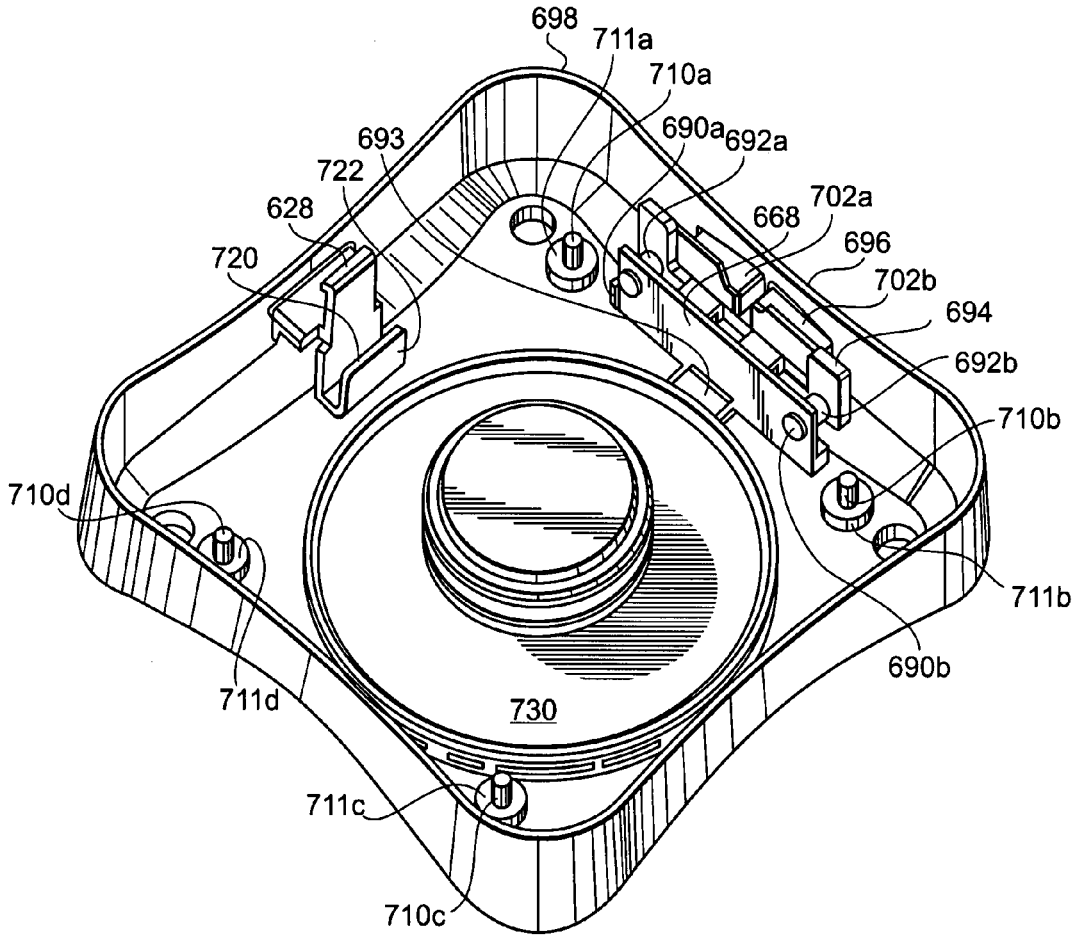
FIG. 20 is an enlarged isometric view of the control unit housing and various components of the control unit of FIGS. 18 and 19 taken from above and illustrating upper, rear, and left-hand surfaces thereof.
Figure 21:
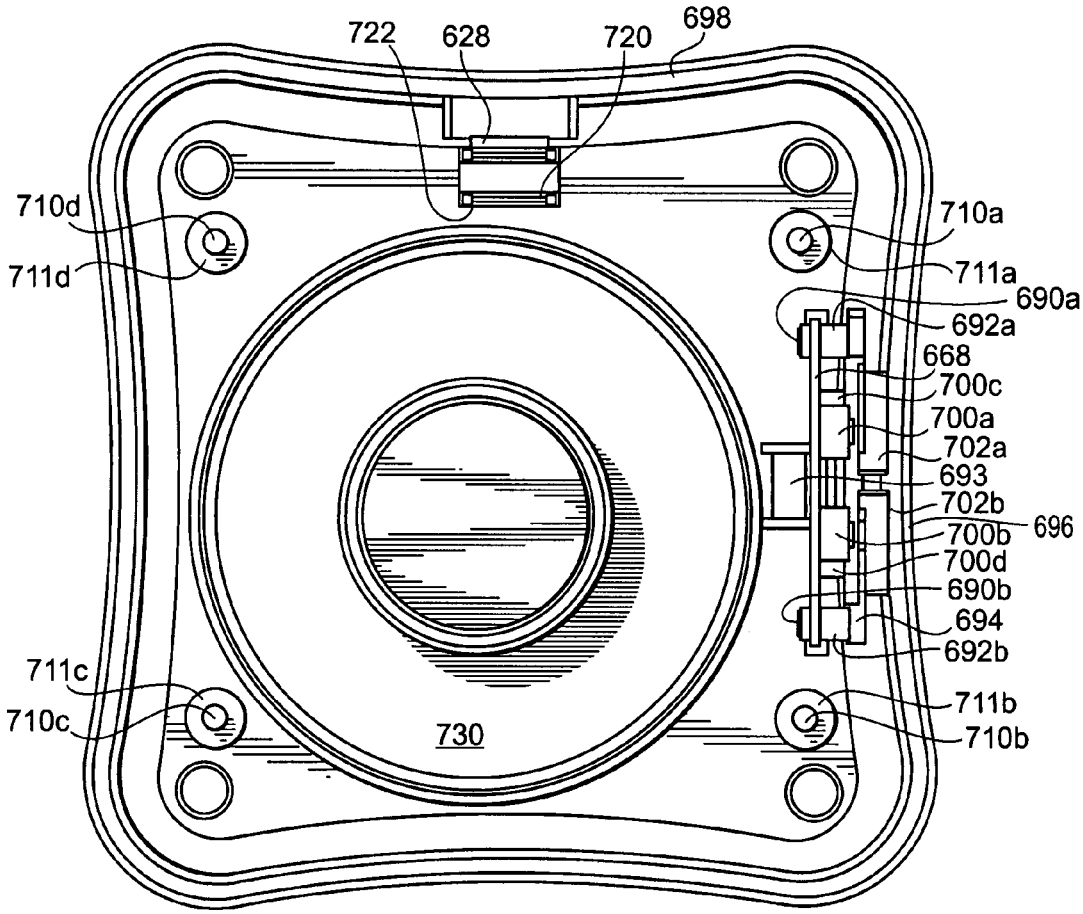
FIG. 21 is a plan view of the control unit of FIG. 20.
Figure 22:
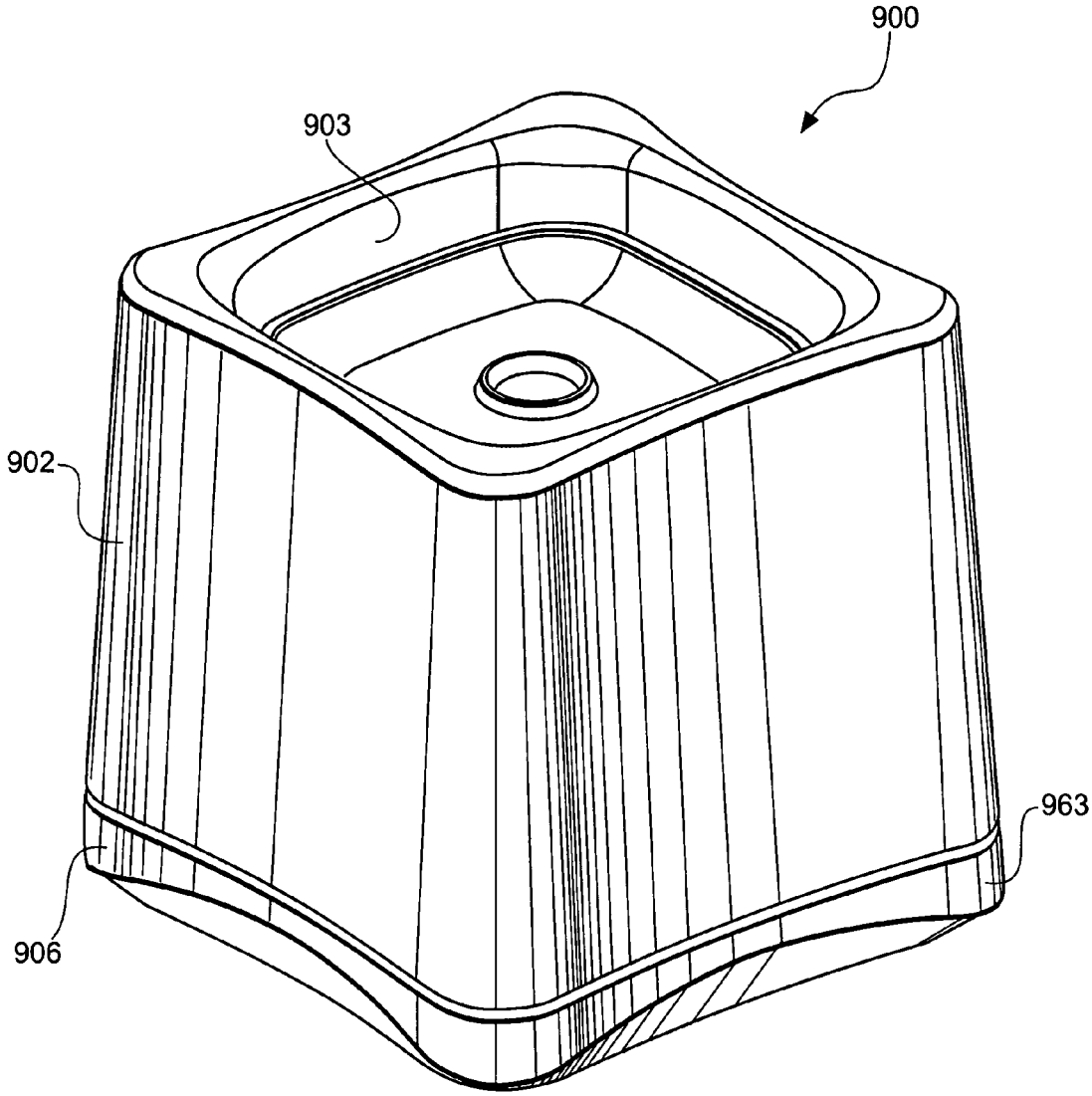
FIG. 22 is an enlarged isometric view of a further embodiment of a candle assembly incorporating a light feature.

The batteries 664*a*-664*d* are connected together in series to electrical components carried by a first printed circuit board 666 (FIGS. 18 and 19) and a second printed circuit board 668 (FIGS. 18, 20 and 21).

The first printed circuit board 666 carries a number of electrical components thereon, including an LED assembly 670 (the remainder of the electrical components carried by the printed circuit board 666 that are not shown for purposes of simplicity). With specific reference to FIGS. 18 and 19, the first printed circuit board 666 is snap-fitted into a recess 672 (FIG. 19) and is retained therein by clips 674*a*, 674*b* (the clip 674*a* is visible in FIGS. 14, 18, and 19, whereas the clip 674*b* is visible in FIG. 15). Specifically, the first printed circuit board 666 is inserted upwardly into the recess 672 until edges 676*a*, 676*b* interfere with inwardly turned flanges 678*a*, 678*b* of the clips 674*a*, 674*b*. Continued upward movement of the printed circuit board 666 forces the clips 674*a*, 674*b* outwardly until the edges 676*a*, 676*b* of the printed circuit board 666 clear the inwardly turned flanges 678*a*, 678*b* thereupon the clips 674*a*, 674*b* return to the original positions thereof, thereby trapping the printed circuit board 666 between a lower surface 679 of a central planar surface 680 of the battery holder 662 and the inwardly turned flanges 678*a*, 678*b* of the clips 674*a*, 674*b*. When the first printed circuit board 666 is so mounted, the LEDs 670 are positioned within an aperture 684 that extends through the central planar surface 680 of the battery holder 662.

In one embodiment, the LEDs 670 include red, green, and blue light emitting diodes that are closely spaced together. The LEDs 670 are energized in a fashion described in greater detail hereinafter to develop light at a varying spectral content and/or intensity. This light is transmitted through the cylindrical member 650, the remaining portions of the diffuser 604 and the base 602 so that such light is visible to an observer. Also in one embodiment, the current delivered to each of the LEDs 670 is controlled to cause such LED 670 to develop a light intensity of a particular magnitude. While many methodologies exist for controlling the amount of current delivered to each LED 670, in another embodiment a pulse width modulation (PWM) operation is employed to minimize battery drain.

As seen specifically in FIGS. 20 and 21, the second printed circuit board 668 is mounted by screws 690*a*, 690*b* to standoffs 692*a*, 692*b*, respectively. A shoulder tab 693 (FIGS. 19-21) assists in maintaining the placement of the second printed circuit board 668 against the standoffs 692*a*, 692*b*. The standoffs 692 are, in turn, either integral with or secured to an anchor plate 694 that is, in turn, integrally molded with or otherwise secured to a front sidewall 696 of a housing 698 of the control unit 606. First through fourth switches 700*a*-700*d* are carried by the second printed circuit board 668 and include actuating members that are contactable by buttons 702*a*-702*d*, respectively (FIGS. 12-15, 18, 20, and 21). Depression of one of the buttons 702*a*-702*d* causes closure of one of the associated switches 700*a*-700*d*, respectively.

The battery holders 662 are retained within the housing 698 by a series of four screws 710*a*-710*d* that extend through washers 711*a*-711*d*, respectively, into threaded bosses 712*a*-712*d*, respectively, integral with or otherwise secured to the battery holder 662. During assembly, the battery holder 662 is inserted into the housing 698 such that the outturned flange 628 extends through a slot 714 in part defined by opposed hollow members 716*a* and 716*b* (FIGS. 18 and 19) until the outturned flange 628 is in the position shown in FIG. 14, whereupon an under surface 718 (FIG. 19) rests upon an upper edge 720 of an inner portion 722 of the outturned flange 628 (FIGS. 18, 20, and 21). The screws 710*a*-710*d* are then inserted through apertures in the housing 698 and into the aligned threaded bosses 712*a*-712*d* and tightened to secure the battery holder 662 in the position shown in FIG. 14.

Referring next to FIGS. 18-21, a speaker 730 is mounted in the housing 698 by any suitable means and, as seen specifically in FIG. 19, a series of apertures are provided in a central portion 732 of a lower surface 734 of the housing 698.)

The control unit housing 698 further includes four feet 740*a*-740*d* (FIGS. 13 and 19) that provide support for the candle assembly 600 and which space the bottom of the portion 732 from a support surface so that sounds emitted by the speaker 730 can escape from the volume beneath the candle assembly 600.

FIGS. 22-30 illustrate another embodiment of a candle assembly 900. The candle assembly 900 includes a support base 902 with a melting plate 903 secured therein, an optional light diffuser 904 (that may or may not be removable) and a control unit 906, identical or similar to those described in detail with respect to the embodiment of FIGS. 12-23. The features of the candle assembly 900 that are identical to those of FIGS. 12-21, 45, and 50 will not be described further herein.

Figure 23:
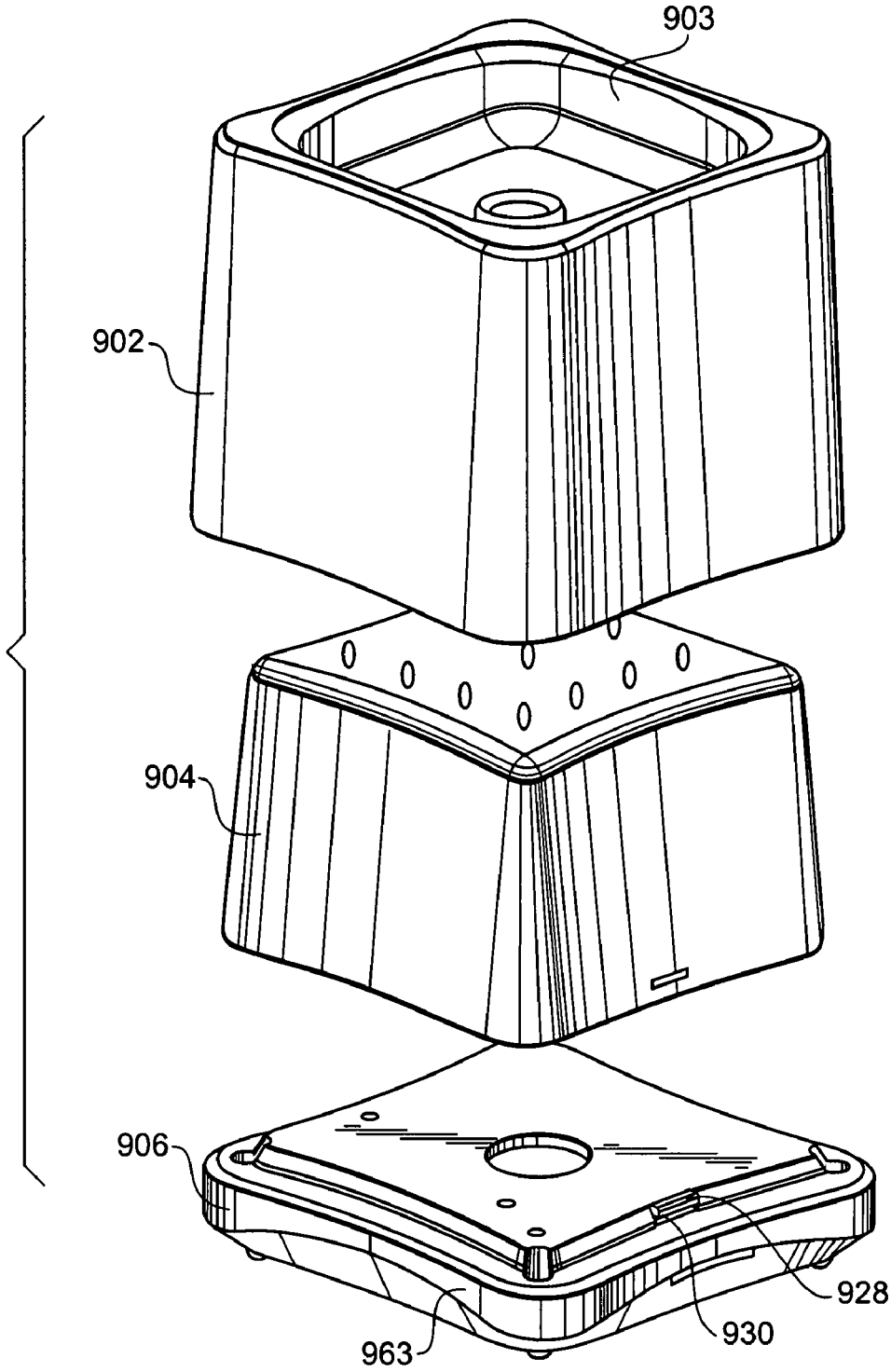
FIG. 23 is an exploded isometric view of various portions of the candle assembly of FIG. 22 illustrating upper, front, and right-hand surfaces thereof.
Figure 24:
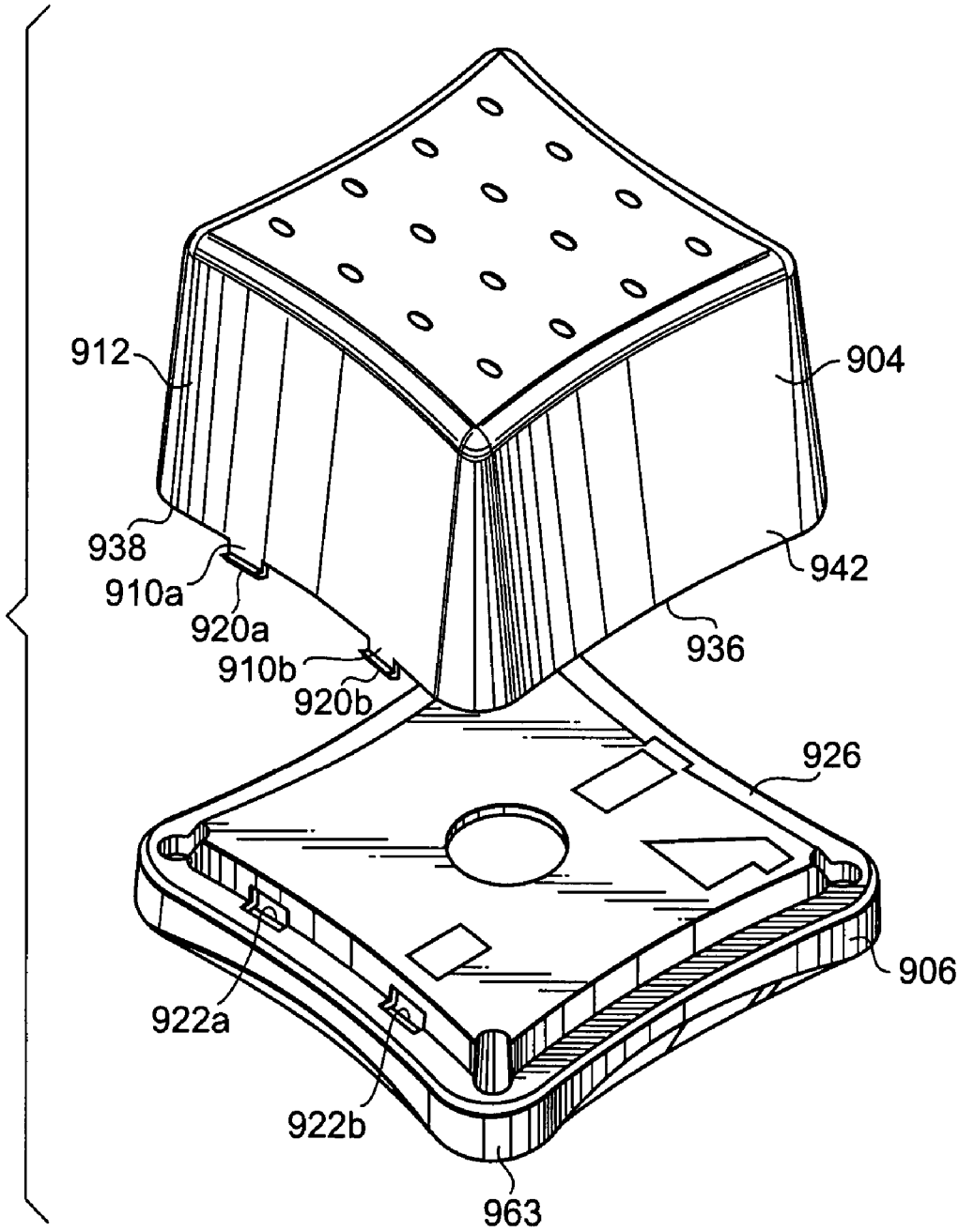
FIG. 24 is an exploded isometric view of various portions of the candle assembly of FIG. 22 illustrating upper, front, and left-hand surfaces thereof.
Figure 25:
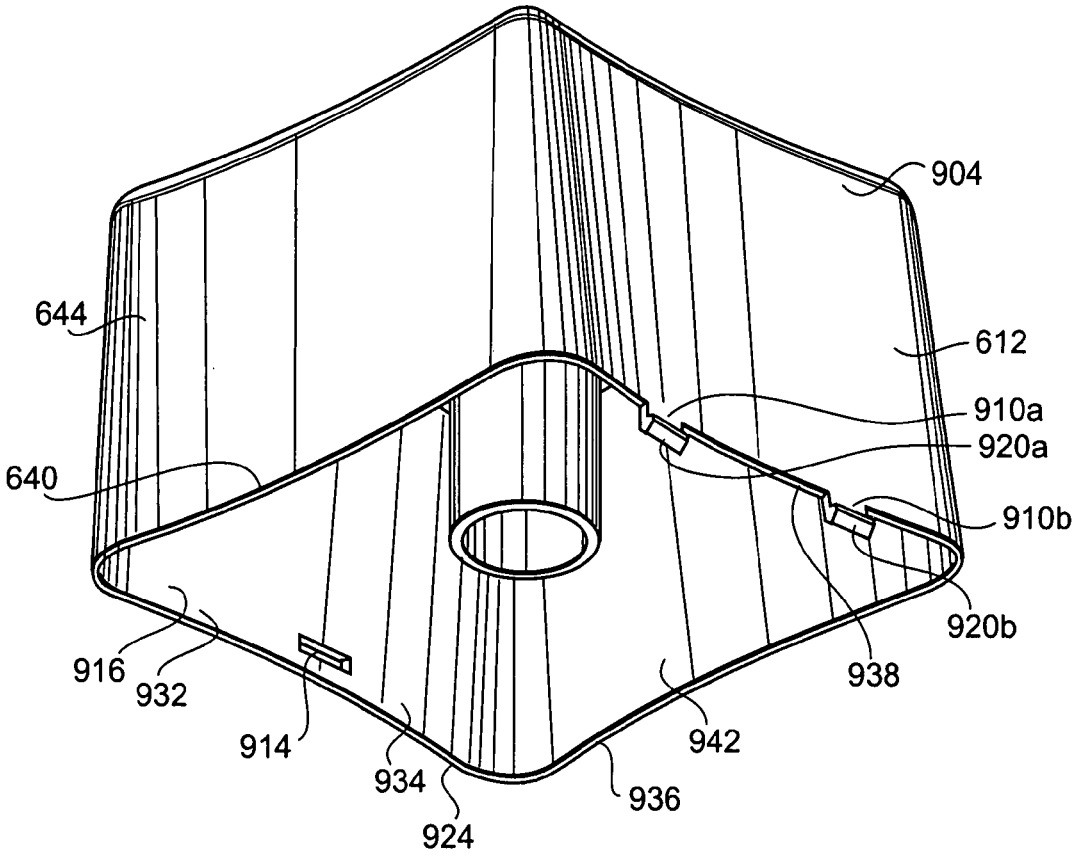
FIG. 25 is an isometric view of the diffuser of FIG. 22 taken from below.

The diffuser (FIG. 23) 904 is disposed within the base 902 and, in one embodiment, snugly and conformingly fits within a recess thereof. Referring specifically to FIGS. 23 and 24, the diffuser 904 includes a pair of tabs 910*a*, 910*b* depending downwardly from a left-hand sidewall 912 (again, the terms left, right, front, back, top, bottom, upper and lower, as used herein are used for convenience only to note relative placement of various elements, and are not used in a limiting sense whatsoever). Further, as seen in FIG. 25, an indentation 914 is disposed in an inner surface 915 of a lower portion of a right-hand sidewall 916 of the diffuser 904. The diffuser 904 is mounted on the control unit 906 by placing outturned flanges 920*a*, 920*b* of the tabs 910*a*, 910*b*, respectively, into corresponding recesses 922*a*, 922*b*, respectively with the diffuser 904 tipped or angled such that a lower edge 924 of the right-hand sidewall 916 is spaced upwardly away from a support surface 926 of the control unit 906. The diffuser 904 is then rotated such that the lower edge 924 of the right-hand wall 916 is brought down toward the support surface 926, whereupon an outturned flange 928 (FIG. 23) of a tab 930 is eventually deflected toward a center of the control unit 906 due to interference with an inner surface 932 of a lower portion 934 of the diffuser 904. Alternatively or in addition, portions of the right-hand sidewall 916 itself may deflect outwardly to permit the flange 928 and the diffuser 904 to move relative to one another. Continued downward pivoting of the diffuser 904 causes the outturned flange 928 of the tab 930 to enter the indentation 914, whereupon the lower edge 924 of the right-hand sidewall 916, as well as lower edges 936, 938, and 940 of a front wall 942, the left-hand sidewall 912 and a rear wall 944, respectively, of the diffuser 904 rest on the support surface 926. It should be noted that the diffuser 904 of this embodiment is not designed to be readily removed from the control unit 906.

Figure 26:
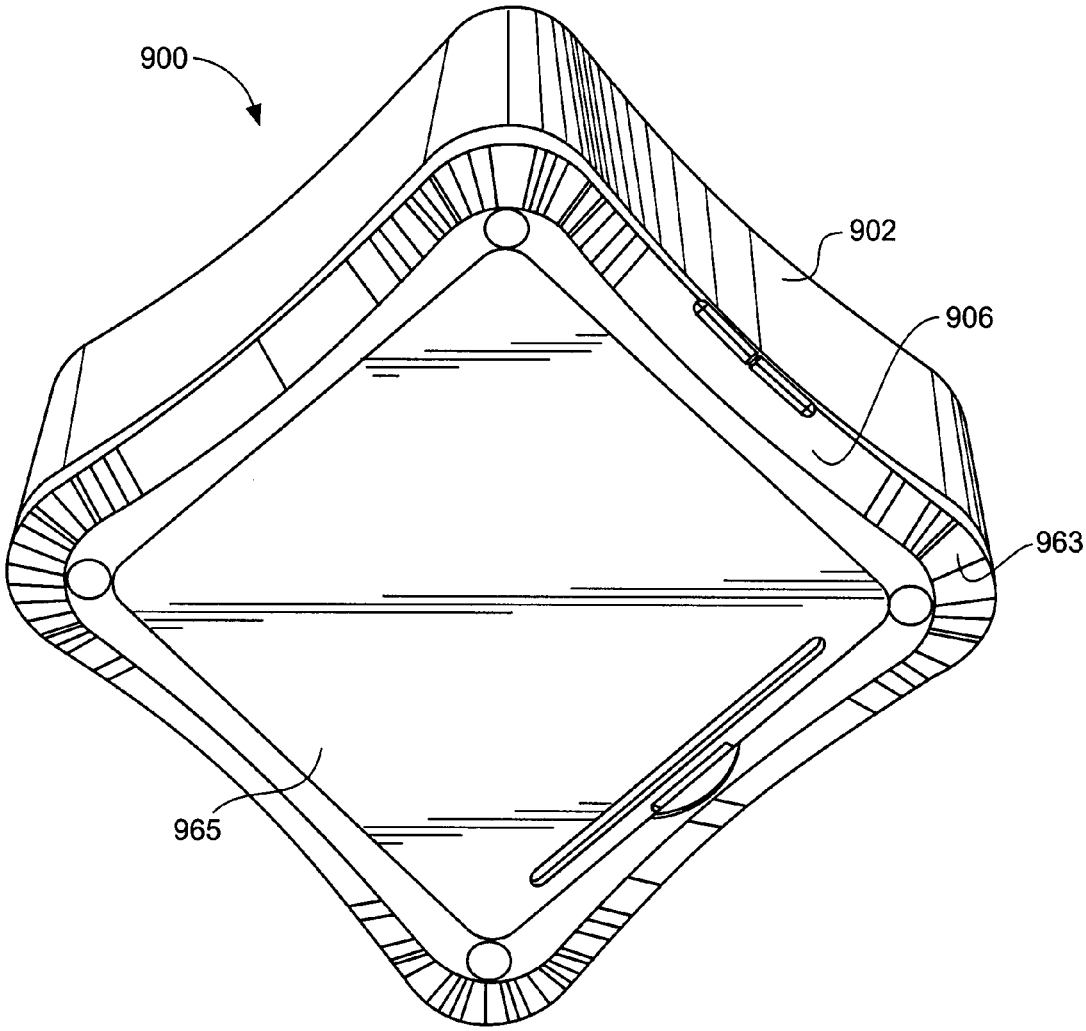
FIG. 26 is an enlarged isometric view of the control unit of FIG. 22 taken from below.
Figure 26A:
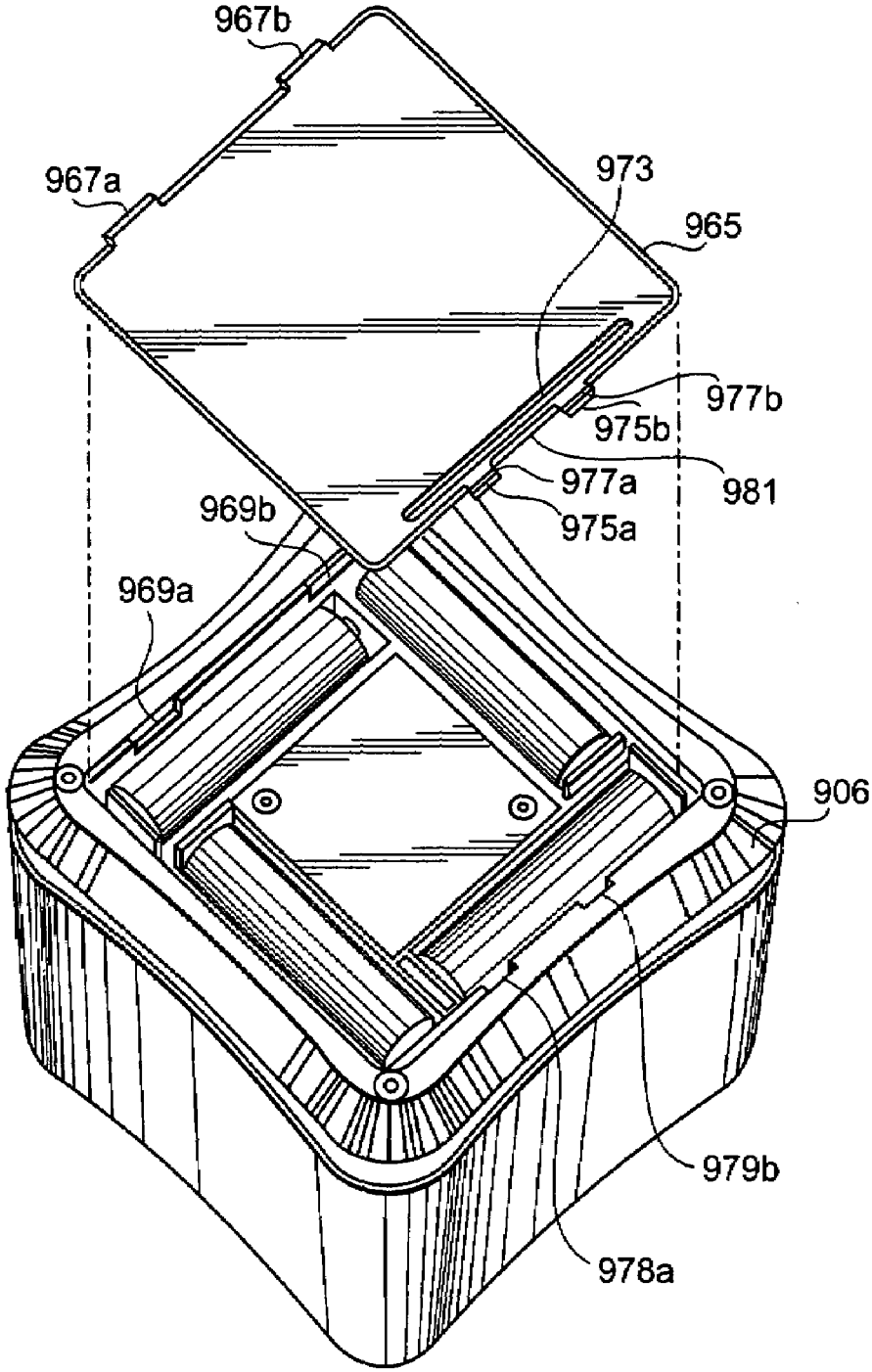
FIG. 26A is an exploded isometric view of the control unit of FIG. 22 taken from below.
Figure 27:
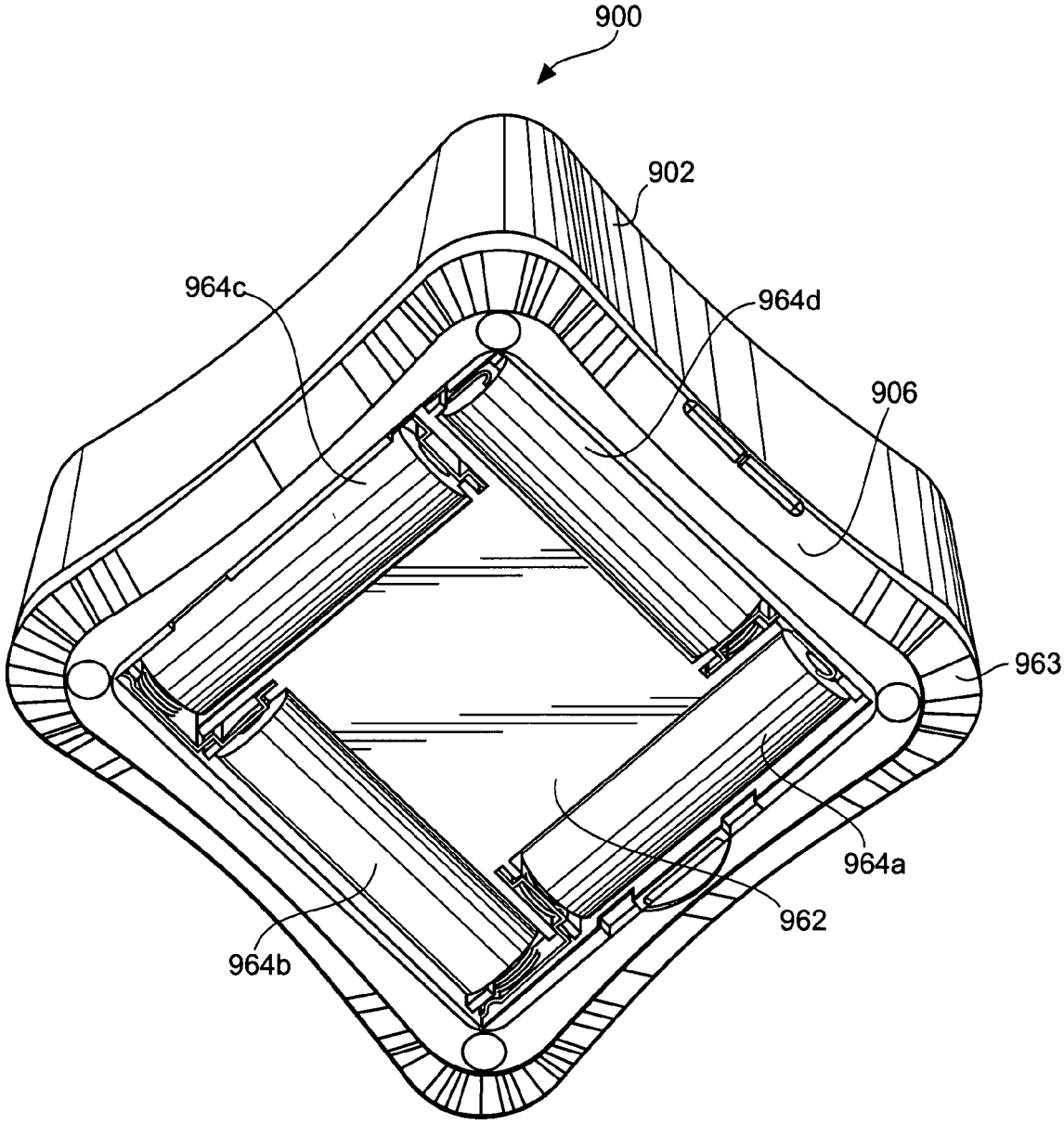
FIG. 27 is an enlarged isometric view of the control unit of FIG. 22 and components thereof taken from below.

Referring next to FIGS. 26 and 27, a battery holder 962 is disposed in a bottom portion 963 of the control unit 906 and includes recesses for receiving four AA sized batteries 964*a*-964*d*. The batteries 964*a*-964*d* are accessible only through the bottom portion 963 of the control unit 906 through a battery door 965. As seen in FIG. 26A, the battery door 965 is attached to the control unit 906 by tilting the battery door 965 such that first and second extensions 967*a*, 967*b* extend into the first and second recesses 969*a*, 969*b* in the control unit 906. Thereafter, the battery door 965 is rotated into contact with the control unit 906 such that a flexible portion 973 of the battery door 965 flexes inwardly until outturned flanges 975*a*, 975*b* of tabs 977*a*, 977*b* extending from the battery door 965 rest in corresponding recesses 979*a*, 979*b* in the control unit 906. When removing the battery door 965 to replace the batteries 964*a*-964*d* or otherwise, an upwardly extending tab 981 is pressed inwardly, thereby flexing the flexible portion 973 inwardly and pulling the tabs 977*a*, 977*b* away from the recesses 979*a*, 979*b* and allowing removal of the battery door 965.

As discussed above, a greater or lesser number of batteries may be provided depending upon electrical requirements. The batteries 964*a*-964*d* are connected together in series to electrical components carried by a first printed circuit board 966 (FIGS. 18 and 19) and a second printed circuit board 968 (FIGS. 18, 20 and 21).

The first printed circuit board 966 carries a number of electrical components thereon, including an LED assembly 970 (the remainder of the electrical components carried by the printed circuit board 966 that are not shown for purposes of simplicity). With specific reference to FIG. 28, during assembly, the first printed circuit board 966 is mounted to the control unit 906 by inserting two screws 972*a*, 972*b* through apertures 974*a*, 974*b*, wherein the screws 972*a*, 972*b* extend into threaded bosses 976*a*, 976*b* that extend upwardly from the control unit 906. When the first printed circuit board 966 is so mounted, the LEDs 970 are positioned within an aperture 978 that extends through a central planar surface 980 of a cover portion 982 of the control unit 906. The LEDs 970 may emit the same colors and may be spaced and energized in the same manner as described with respect to the embodiment of FIGS. 12-21, 45, and 50.

Figure 28:
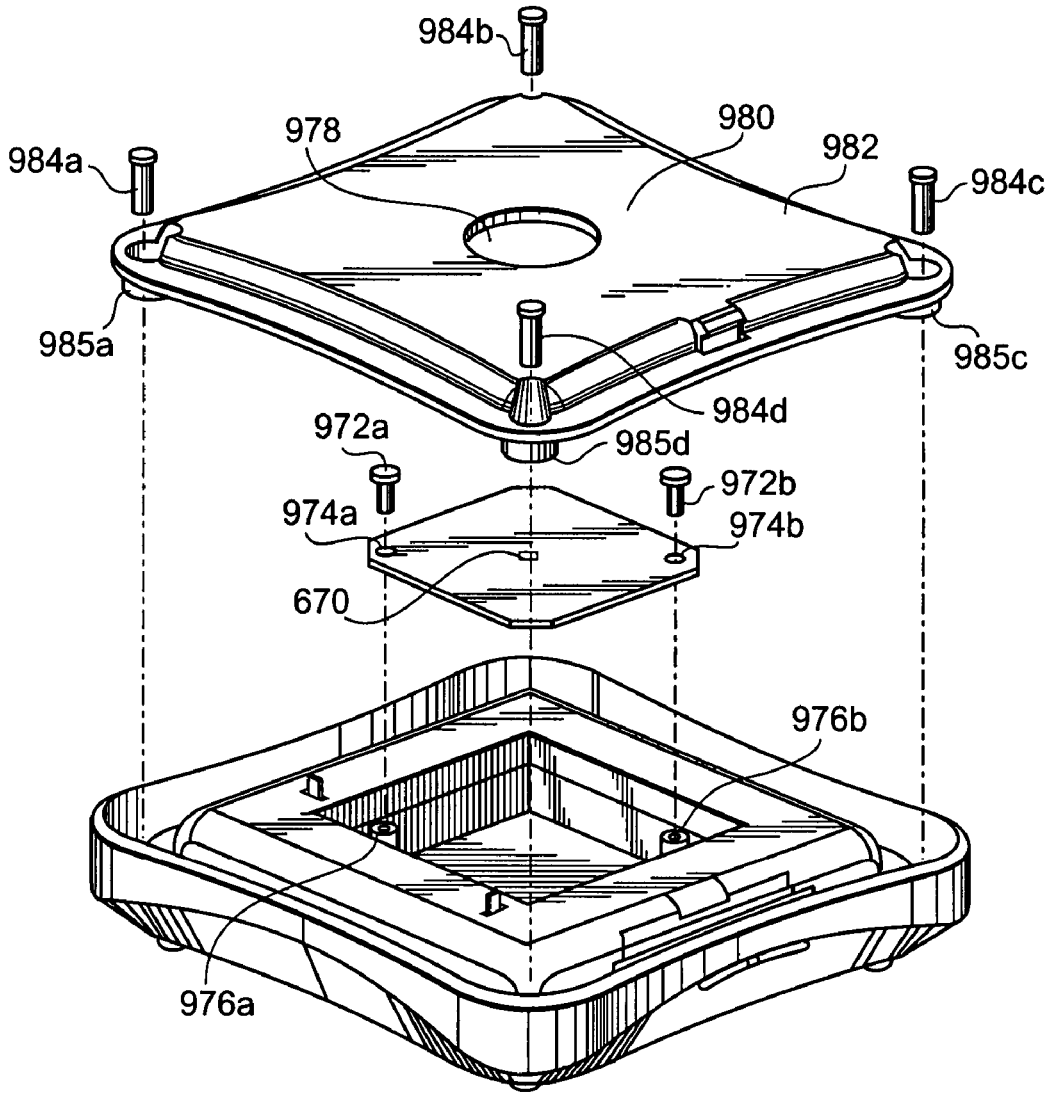
FIG. 28 is an exploded isometric view of various portions of the candle assembly of FIG. 22.
Figure 29:
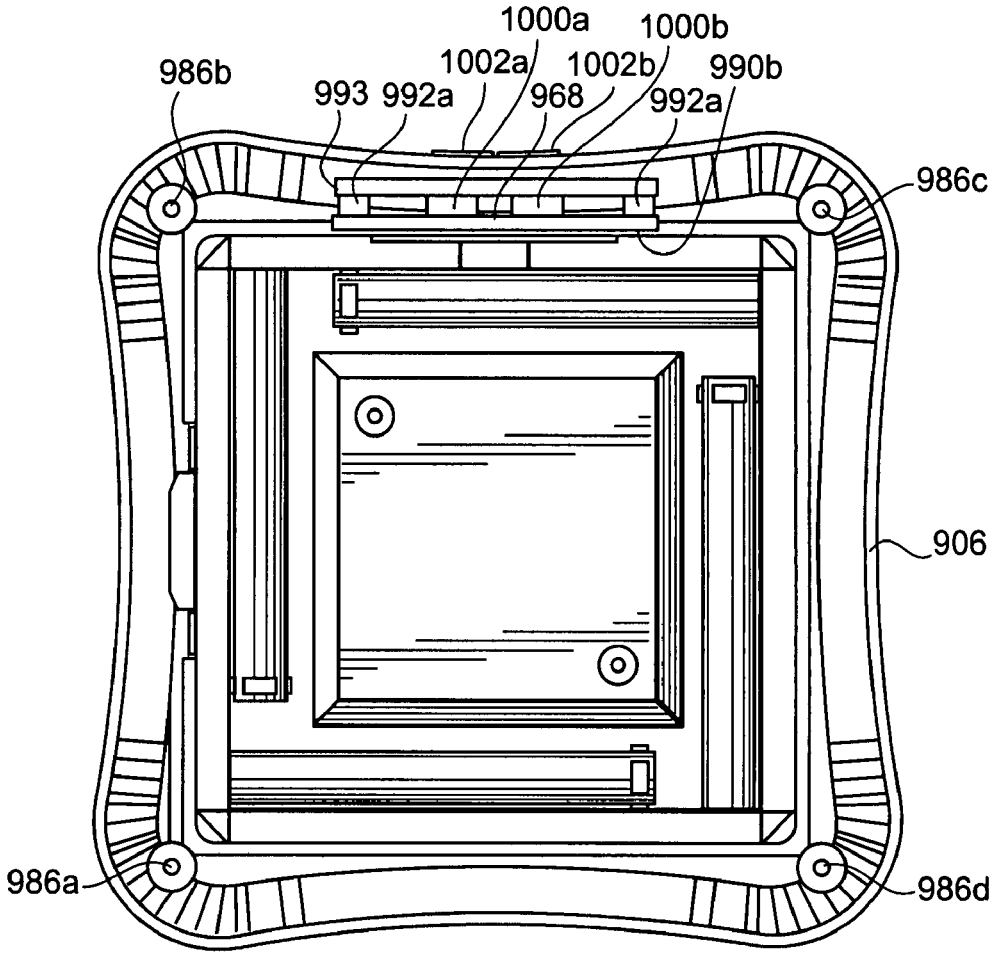
FIG. 29 is a plan view of the control unit of FIG. 22.
Figure 30:
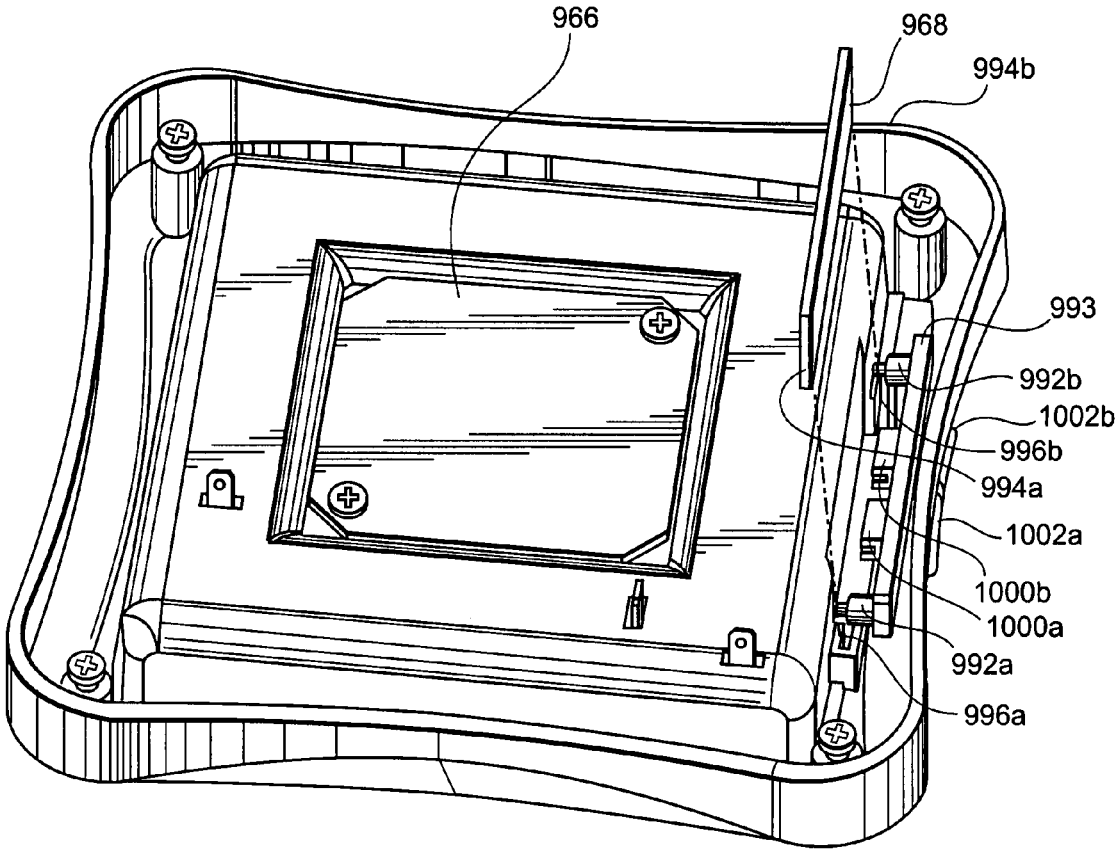
FIG. 30 is an enlarged exploded view of the control unit of FIG. 22.

As further seen in FIGS. 28 and 29, the cover portion 982 of the control unit 906 is retained on the bottom portion 963 of the control unit 906 by a series of four screws 984*a*-984*d* that extend through washers 985*a*-985*d*, respectively, and into threaded bosses 986*a*-986*d*, respectively, integral with or otherwise secured to the bottom portion 963.

The second printed circuit board 968 is seen in detail in FIG. 29 and is mounted by screws 990*a* and 990*b* to standoffs 992*a* and 992*b*, respectively. The standoffs 992*a*, 992*b* are either integral with or secured to an anchor plate 993. First and second lower corners 994*a*, 994*b* (FIG. 30) of the second printed circuit board 968 are inserted into first and second slots 996*a*, 996*b* formed in the control unit 906 to retain the second printed circuit board 968 therein. First and second switches 1000*a*-1000*d* are carried by the second printed circuit board 968 and include actuating members that are contactable by buttons 1002*a*-1002*d*, respectively. Depression of the buttons 1002*a*, 1002*b* causes closure of the associated switches 1000*a*, 1000*b*, respectively. Depression of a first button 1002*a* activates and selects the light show mode of the candle assembly 900 and deactivates the light show after scrolling though the various modes, as discussed in detail above. A second button 1002*b* pauses or stops the color morphing in a light show, thereby maintaining a currently displayed color. Depressing the second button 102*b* again resumes operation in the selected light show mode.

Figure 31:
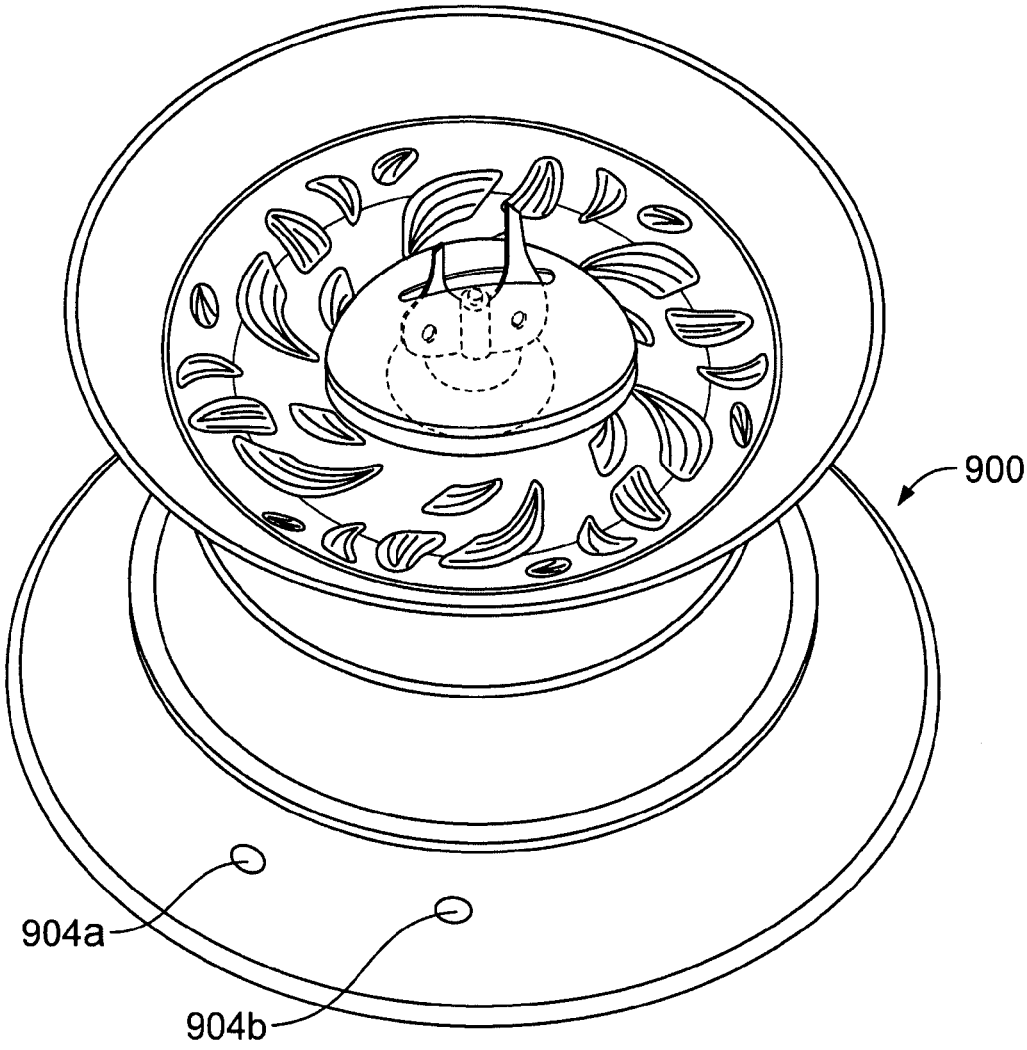
FIG. 31 is an isometric view of another embodiment of a candle assembly incorporating a light or sound feature.
Figure 32:
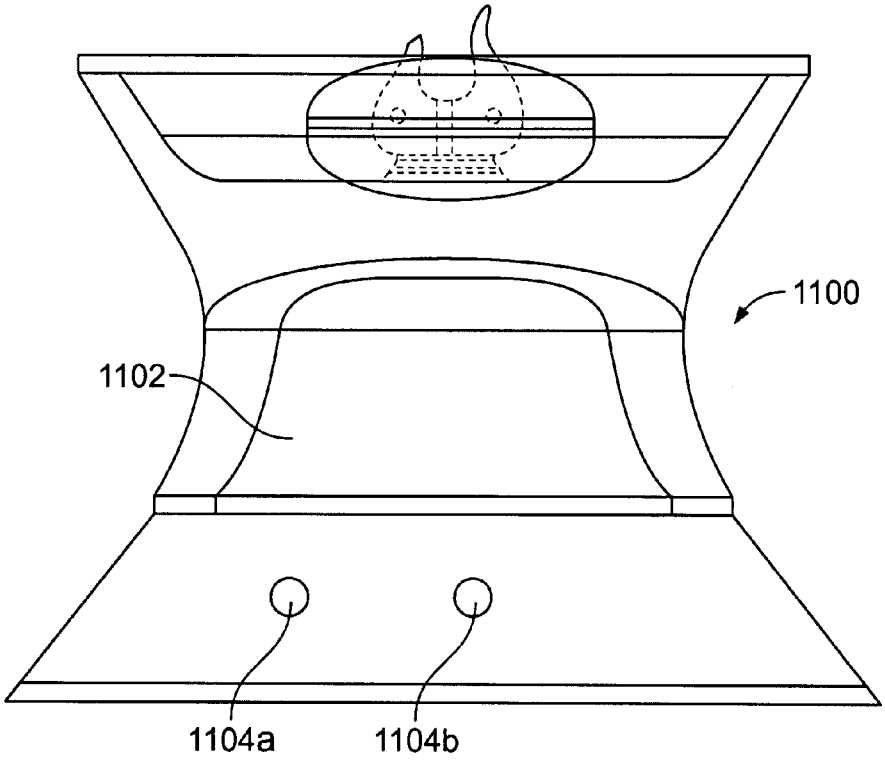
FIG. 32 is a side elevational view of the candle assembly of FIG. 31.

FIGS. 31 and 32 illustrate yet another embodiment of a candle assembly 1100, which is capable of emitting light or sounds, but not both. Specifically, the embodiment of FIGS. 31 and 32 includes circuitry and LEDs to cause light to be developed in the fashion illustrated in the embodiment of FIGS. 12-21, 45, and 50 in a region 1102 (FIG. 32) in response to actuation of buttons 1104*a*, 1104*b*. The button 904*a*, when depressed, causes energization of the LEDs within the candle holder 1100 whereas the actuation of the button 1104*b* causes the LEDs to be lit in different energization modes, such as the modes described above in connection with FIGS. 12-21, 45, and 50.

Of course, through the substitution of a speaker and appropriate circuitry for the LEDs and circuitry of FIGS. 31 and 32, the embodiment of such figures can be modified to cause the candle assembly 1100 to emit sounds, for example as described in the embodiment of FIGS. 12-21, 45, and 50, as opposed to light. Further, any configuration and number of switches and/or buttons may be used as desired to control the electronic components described herein. For example, the candle assembly 1100 that is configured to emit both light and sound may be configured to have three controls (not shown) located in the bottom portion 963 (or any other portion) of the control unit 906. One control, for example, a combined on/off switch and potentiometer, may be used to turn the sound show on and off and to control the volume of the sound. A first button may be provided to turn the light show on and off and to permit selection of one of various light shows (if the capability to display multiple light shows is provided). Through suitable programming the first button might also be actuated according to a selected sequence to provide commands to the processor to pause the selected light show. (For example, the first button may be depressed a particular number of times within a first time period of initial depression thereof to select a light show mode, and thereafter the first button may be depressed a further time after the first time period to pause the light show. Yet another depression of the first button may resume the light show subsequent depressions of the first button may permit selection of a different light show mode or may turn the light show off.). A second button may be provided to scroll through the sound show modes. The controls, switches and/or buttons may also be located at any desired location on the candle assembly 1100.

Now referring to FIGS. 33-38A, a candle assembly 1200 includes a candle refill 1202 filled with a fuel material 1211 with a wick 1208 disposed therethrough, disposed atop a refill holder 1216. The refill holder 1216 is disposed adjacent a top surface of a diffuser 1214 that is disposed on a control unit 1206. The control unit 1206 includes similar electronic components shown and described above and such similar electronic components will not be further shown or described. A light permissive or translucent sheath 1230 rests upon the control unit 1206 and surrounds the candle refill 1202, the refill holder 1216, and the diffuser 1214. Three LEDs (not shown) are located at or above a hole or cutout 1236 in a top surface of the control unit 1206. Further, a lock and key mechanism, for example, a female element 1224 and a male element 1226, align the control unit 1206 to the candle refill 1202. In this embodiment, the lock and key mechanism includes the female element 1224 on a bottom surface of the candle refill 1202 that is complementary to the male element 1226 formed on an upper surface of a refill holder 1216. Mating of the female element 1224 and the male element 1226 may serve to align functionally the mechanisms described below for operatively linking a flame 1254 disposed on a wick 1208 to electrical components disposed within the control unit 1206. When a lock and key mechanism is not necessarily needed to align various components of the candle assembly 1200, and/or is not incorporated into the candle assembly (see, for example, FIG. 38), a 4 oz. glass votive candle refill 1202 may be used with the candle assembly 1200. Other glass votives having varied shapes and sizes may also be used with the candle assembly 1200, for example, those manufactured by, for example, S.C. Johnson and Son.

Figure 33:
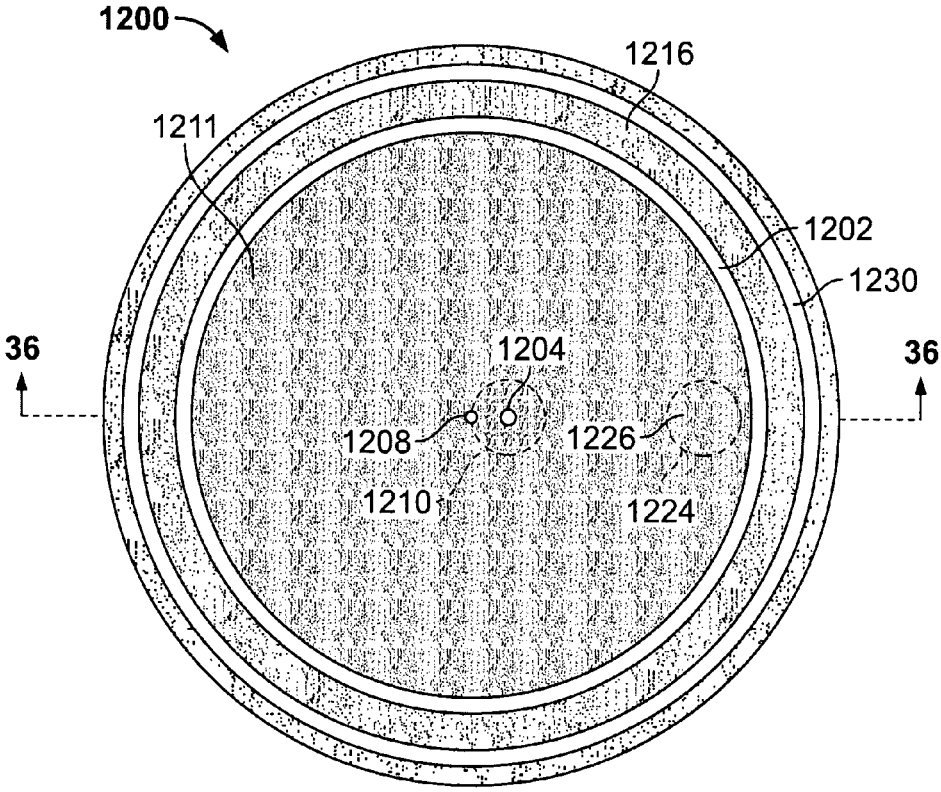
FIG. 33 is a plan view of a candle assembly according to another embodiment.
Figure 36:
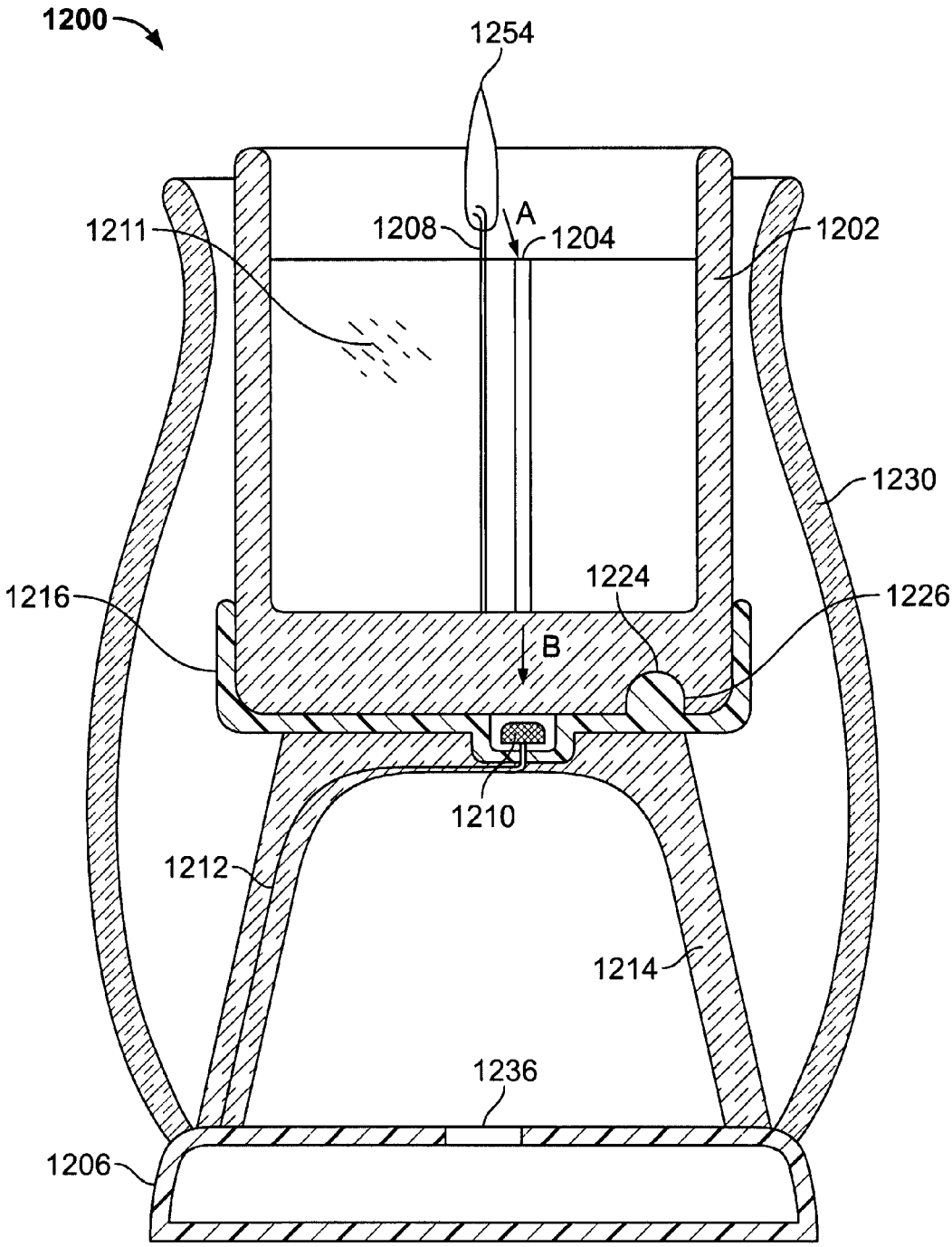
FIG. 36 is a cross-sectional view of another embodiment of a candle assembly along the line 36-36 of FIG. 33.

Turning now to FIGS. 33 and 36, an embodiment is shown for detecting the presence of the flame 1254 disposed on the wick 1208. The candle assembly 1200 includes the candle refill 1202 with an optical fiber 1204 disposed along side the wick 1208. The optical fiber 1204 is positioned such that light traveling in a direction A emitted from the flame 1254 is directed by the optical fiber 1204 to the bottom of the refill 1202. The light is emitted from the optical fiber 1204 in a direction B, and passes through a light passage in the bottom of the refill 1202. The light passing through the light passage is detected by a light sensor such as a photosensitive sensor 1210. The light passage may be, for example, clear or transparent glass or a non-frosted and/or non-colored portion of a frosted, colored, and/or translucent candle refill 1202, or other light permissive medium. In one embodiment, as the flame 1254 melts the fuel 1211, the fuel, the wick 1208, and/or the optical fiber 1204 are consumed (not shown) at similar rates such that as the level of the fuel decreases, the wick and the optical fiber remain in operative spatial relation to one another so that the optical fiber directs light from the flame on the wick to the photosensitive sensor 1210 throughout the life of the candle refill 1202.

In other embodiments not shown, the optical fiber 1204 may be interwoven into the wick 1208. Further, the optical fiber 1204 may be coated with a thermochromatic ink (not shown) to inhibit or prohibit ambient light from being transferred to or detected by the photosensitive sensor 1210. In this embodiment, the thermochromatic ink has a color impervious to or absorptive of light when at or below a first temperature (for example, about 120° F. to about 140° F.) and is coated or applied to the optical fiber 1204. Upon lighting of the wick 1208, the flame 1254 heats the thermochromatic ink to a second temperature higher than the first temperature that causes the thermochromatic ink to change from the light impervious or absorptive color to a color (for example, a clear color) that permits light to pass through the optical fiber 1204. In this embodiment, when the thermochromatic ink is exposed to sufficient heat from the flame 1254, light may travel through the optical fiber 1204 to the photosensitive sensor 1210. Thermochromatic inks useful in the present invention include, for example, those described in U.S. Patent Application Publication No. 2004/0160764. Additional thermochromatic inks useful in the present invention include, for example, those described in U.S. Patent Application Publication No. 2005/0024859. Further, thermochromatic inks useful in the present invention include those, for example, available from Matsui International, such as Chromicolor® inks. In an additional embodiment, the wick 1208 may have a clear microwax (for example, polyethylene and/or polypropylene) sheath (not shown) that transfers light to the photosensitive sensor 1210.

Figure 34:
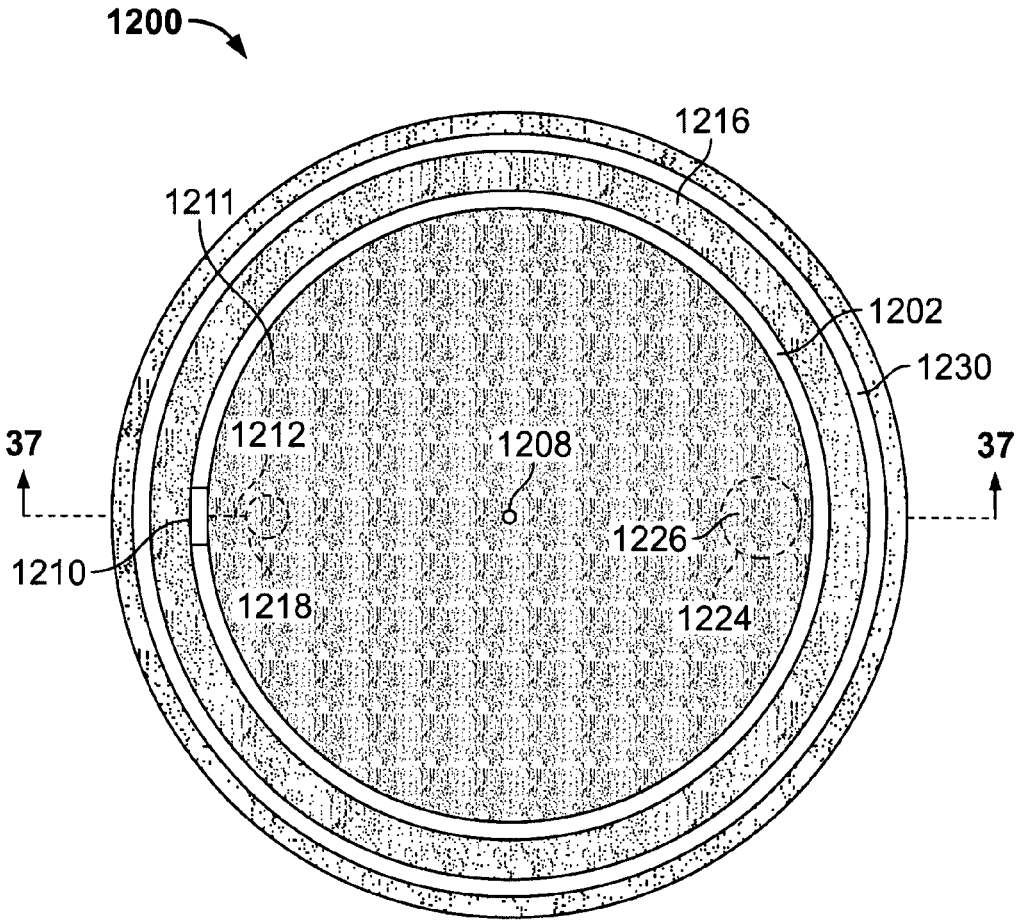
FIG. 34 is a plan view of a candle assembly according to another embodiment.
Figure 37:
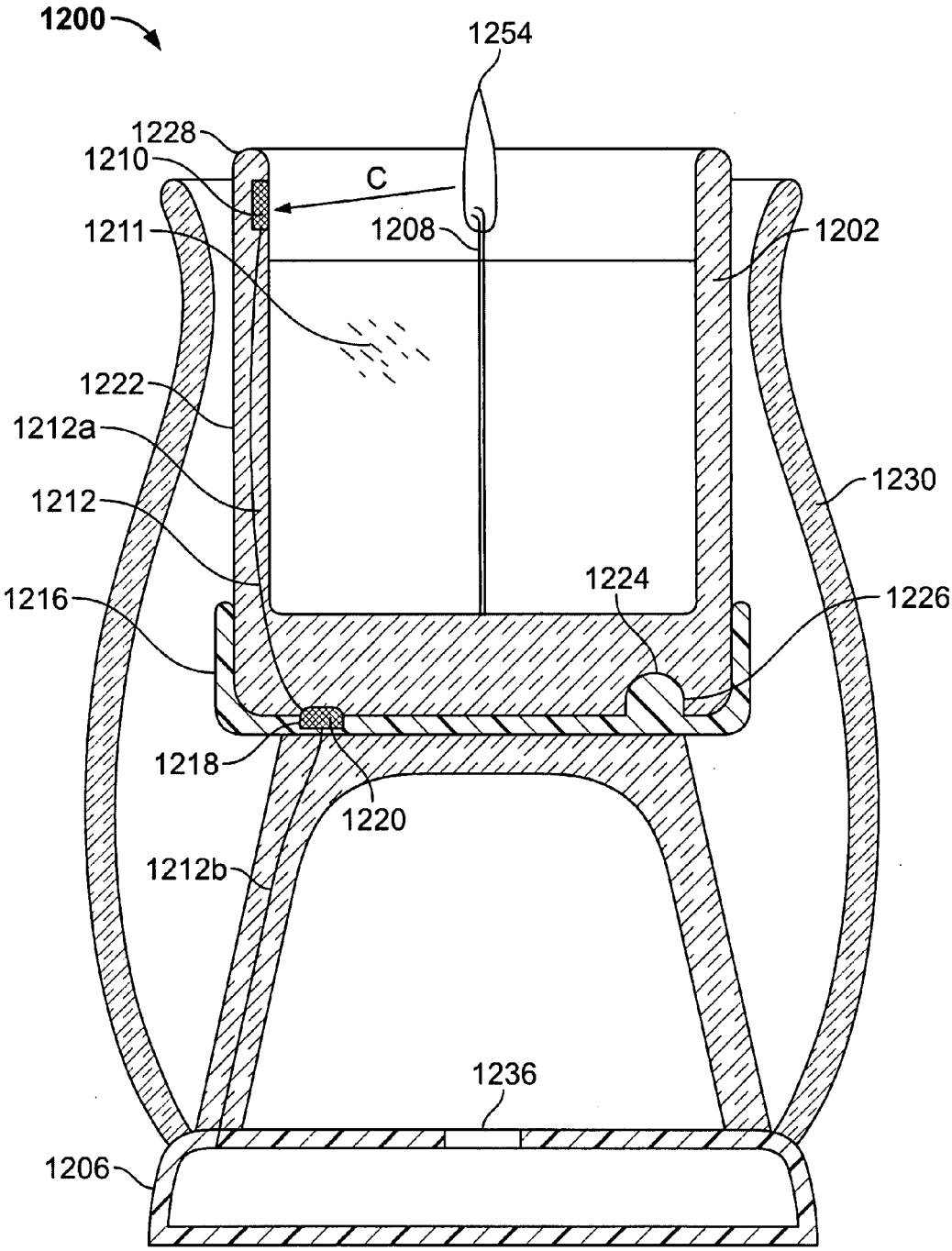
FIG. 37 is a cross-sectional view of another embodiment of a candle assembly along the line 37-37 of FIG. 34.

As an alternative embodiment, similar to the embodiment depicted in FIG. 36, the photosensitive sensor 1210 is placed in such proximity relative to the wick 1208 so to detect directly the flame 1254 disposed thereon, as is seen in FIGS. 34 and 37. Here, the photosensitive sensor 1210 is disposed in operative proximity (for example, in or on a top portion 1228 of a wall 1222 of the candle refill 1202) to the wick 1208. The photosensitive sensor 1210 is positioned such that light having a direction C (for example) emitted from a flame 1254 is detected by the photosensitive sensor 1210.

Figure 35:
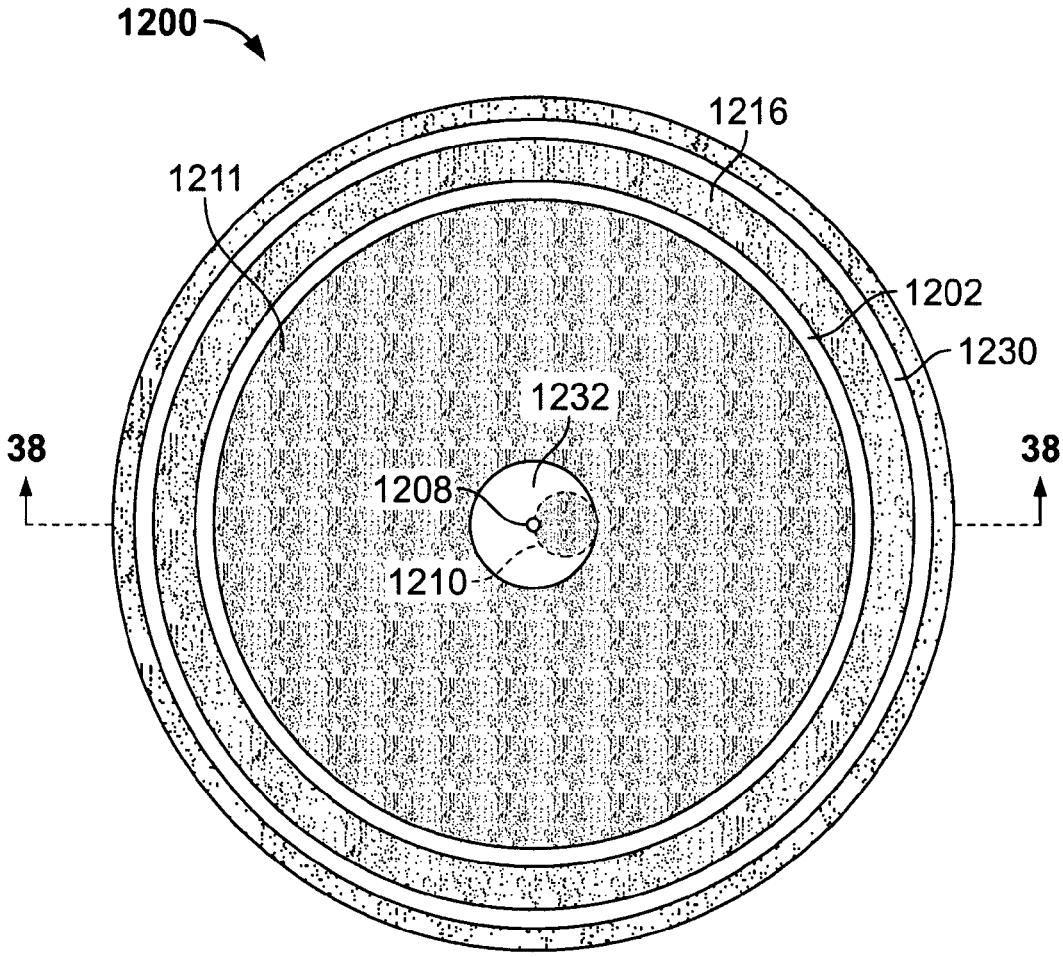
FIG. 35 is a plan view of a candle assembly according to another embodiment.
Figure 38:
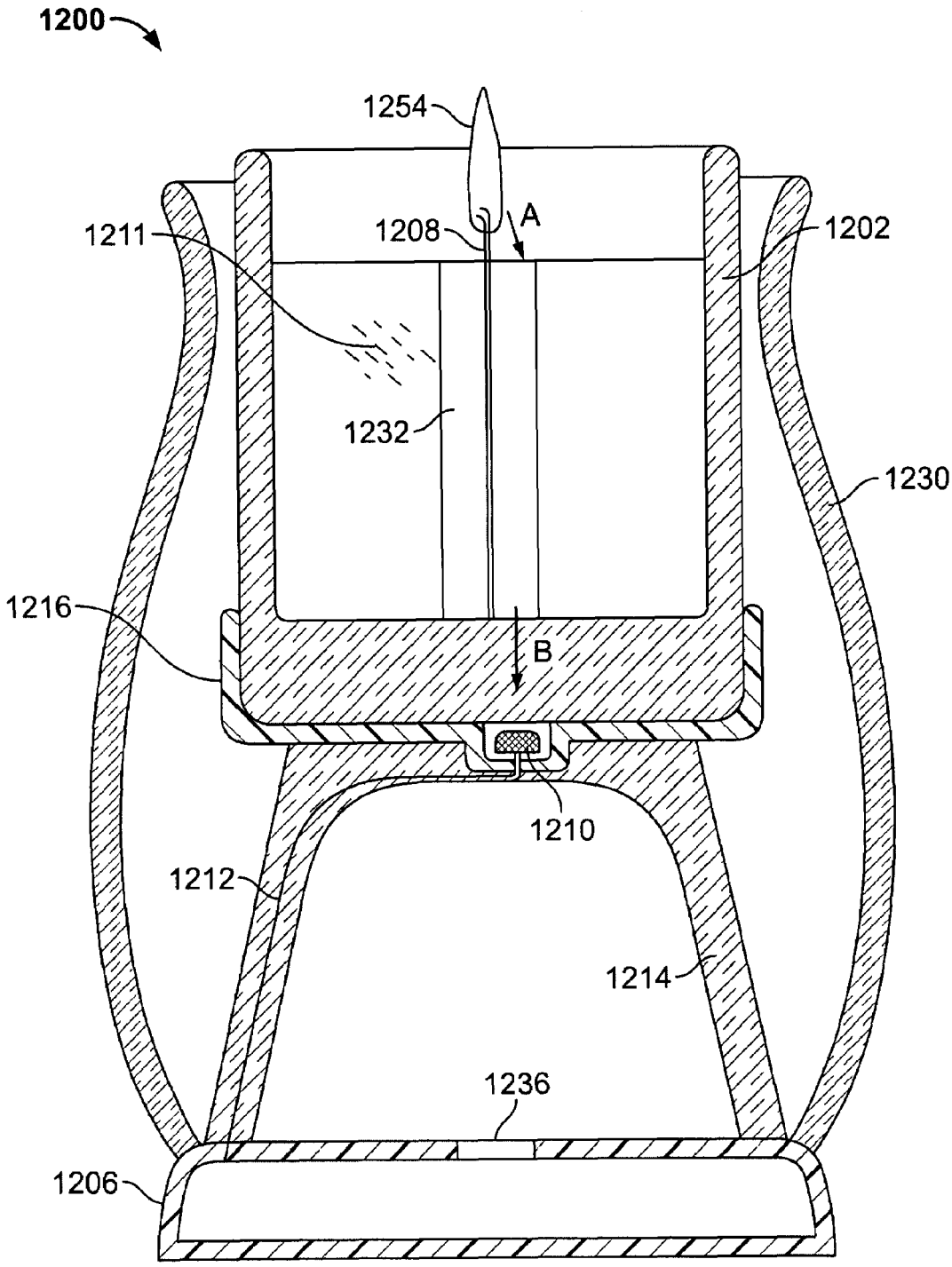
FIG. 38 is a cross-sectional view of another embodiment of a candle assembly along the line 38-38 of FIG. 35.

Another embodiment depicted in FIGS. 35 and 38, shows the candle assembly 1200 that includes the candle refill 1202 that has a light transmissive clear gel candle core 1232 with a diameter of approximately one half inch located adjacent the wick 1208 and extending to the base of the candle refill 1202. Light having the direction A emitted from the flame is communicated by the clear gel candle core 1232 to the bottom of the refill 1202 and passes through a light passage in the bottom of the refill 1202 in the direction B. The light passing through the light passage is then detected by the photosensitive sensor 1210 disposed on or in the electronic base 1206, which activates and/or deactivates the electrical components in the control unit 1206. In one embodiment, after an initial use, the clear gel candle core 1232 and the wax 1211 components blend together and create an opaque film upon solidifying when cool (not shown) at the top of the candle refill 1202. The opaque film inhibits or blocks light from passing through the clear gel candle core 1232 thereby deactivating the electronics within the control unit 1206. A light impervious wax film (not shown) can also be applied to the very top of the candle refill 1202 during manufacturing operations to prevent ambient light from triggering the electrical components prior to use. Light transmissive clear gel candle core materials useful in the present invention include those described in U.S. Pat. No. 6,827,474. Additional light permissive materials useful in the present invention include those described in U.S. Pat. No. 6,050,812.

The photosensitive sensor 1210 is connected to electrical components within a control unit 1206 via a connector 1212 (for example, an electrical wire or other devices known to those skilled in the art) to activate or enable the various electrical components. Through the combination of the light communicating techniques, for example, the optical fiber 1204 and clear gel core 1232 and the photosensitive sensor 1210, the electrical components within the control unit 1206 are operatively linked when the candle is lit or unlit and may be used to activate and/or deactivate the electrical components within the control unit 1206 and/or enable the electrical components to be activated by separate switching mechanisms disclosed herein. The discontinuous structural nature of the combination of the optical fiber 1204 with the photosensitive sensor 1210 allows the control unit 1206 to be reused with multiple candle refills 1202.

In embodiments when the photosensitive sensor 1210 is an integral part of the candle refill 1202, for example, see FIG. 37, the connector 1212 is discontinuous, with one portion 1212*a* spanning from the photosensitive sensor 1210 to connect to a connective interface 1218 at the bottom of the refill 1202. The connective interface 1218 interfaces with a corresponding connective interface 1220 in or on a refill holder 1216 disposed on a diffuser 1214 that is integral to or attached to the control unit 1206. To complete the connection between the photosensitive sensor 1210 and electrical components within the control unit 1206, a connective interface 1220 on the control unit 1206 is operatively connected to the control unit 1206 via another connector section 1212*b* associated with the diffuser 1214.

Figure 38A:
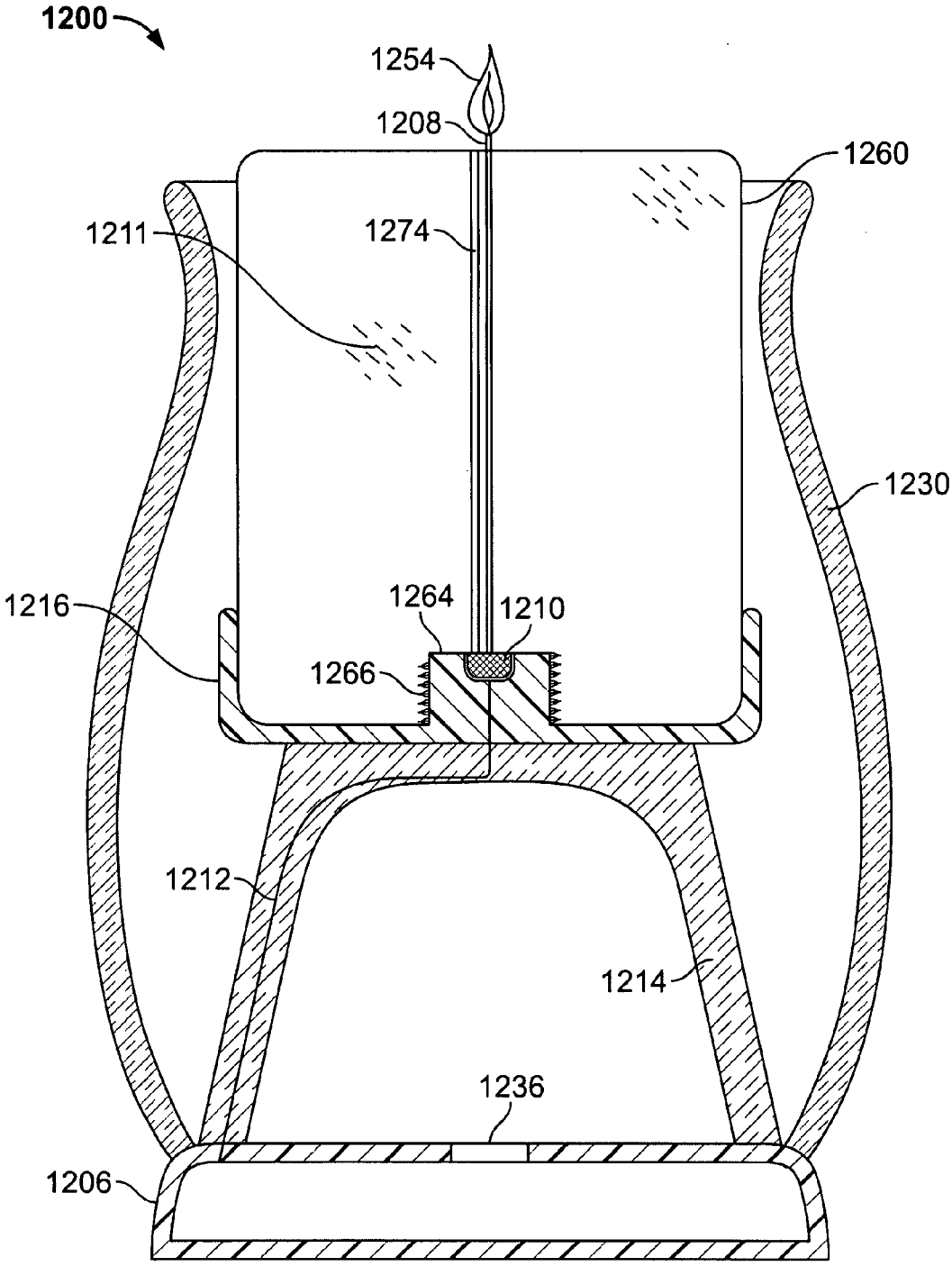
FIG. 38A is a cross-sectional view of another embodiment of a candle assembly.

In another embodiment seen in FIG. 38A, the candle assembly 1200 includes the candle refill 1260 in the form of, for example, a pillar candle. The candle refill 1260 includes a wick 1208 and a light transferring and/or heat transferring element 1274 similar to that described elsewhere herein (for example, an optical fiber, a light pipe, a thermistor, and/or a conductive wire, and the like). In this embodiment, it is contemplated that the lock and key mechanism may take the form of a threaded male element 1266 that corresponds to a complementary, threaded female element 1264. Illustratively, as an example, the candle refill 1260 with a threaded female element 1264 may be mated onto the threaded male element 1266 of the control unit 1206. Further, a flame detecting sensor 1210, including for example, a photosensitive sensor and/or a heat sensor may be disposed on the threaded male element to detect the presence of the flame 1254 on the wick 1208. In a further embodiment, the LEDs (not shown) are disposed in and/or on the threaded male element 1266.

When the photosensitive sensor 1210 is not part of the candle refill, for example, when the photosensitive sensor is attached to or disposes on the sheath 1230 (not shown), the connector 1212 may be continuous from the photosensitive sensor 1210 to electrical components within the control unit 1206. In addition to or in place of the photosensitive sensor 1210, other heat sensors, optical sensors, and/or heat and photosensitive sensors may be used. For example, heat and/or photosensitive sensors useful for the present invention include those described in U.S. Pat. No. 6,491,516. Other photosensitive sensors useful in the present invention include, for example, those available from Banner Engineering Co., for example, MINI-BEAM® photoelectric sensors (for example, all variations of model no. SME312). Examples of optical sensors useful in the present invention include those described, for example, in Japanese Patent No. JP 408185710A. Optical fibers and photosensitive sensors useful in the present invention include, for example, those described in U.S. Patent Application Publication No. 2005/0111217. Additional optical fibers and photosensitive sensors useful in the present invention include, for example, those described in U.S. Pat. No. 5,807,096. Additional optical fibers and photosensitive sensors useful in the present invention include, for example, those described in U.S. Pat. No. 6,033,209. Additional photosensitive sensors useful in the present invention include those, for example, described in U.S. Pat. No. 6,468,071. Optical fibers and photosensitive sensors useful in the present invention include, for example, those described in U.S. Patent Application Publication No. 2002/0119413. Additional optical fibers and photosensitive sensors useful in the present invention include, for example, those described in U.S. Patent Application Publication No. 2005/0093834. Additional optical fibers and photosensitive sensors useful in the present invention include, for example, those described in U.S. Pat. No. 4,804,323. Additional optical fibers and photosensitive sensors useful in the present invention include, for example, those described in U.S. Pat. No. 4,477,249. Additional optical fibers and photosensitive sensors useful in the present invention include, for example, those described in U.S. Pat. No. 5,921,767. Additional photosensitive sensors useful in the present invention include those described in U.S. Pat. No. 6,050,812.

Now referring to FIGS. 39-43, a candle assembly 1300 includes a support base 1316 that is made of, for example, glass, a resin, a polymer, a metal, a wood, a rock, a hollow material, a porous material, a liquid-filled material, and the like that supports a melting plate 1304 and is disposed atop a control unit 1306 that houses electrical components (not shown but similar to those described above). A diffuser 1322 is disposed beneath the support base 1316. Upon the melting plate 1304, a wick holder 1314 holds a wick 1308 upon which a flame 1354 is disposed. Three LEDs (not shown but described previously) controlled by the electrical components are located at or above a hole or cutout 1336 in a top surface of the control unit 1306.

The embodiments depicted in FIGS. 39-43 operatively link the flame 1354 to the electrical components within the candle assembly 1300. The candle assembly 1300 includes a flame and/or a heat sensor 1310 operatively connected through a connector 1312 (for example, a conductive wire attached to the support base 1316) to a connective interface 1313 attached with the support base 1316. To complete the connection between the heat sensor 1310 and the electrical components within the control unit 1306, the connective interface 1313 connects to a complementary connective interface 1315 that is operatively linked by a connector 1317 to the electrical components of the control unit 1306.

Figure 39:
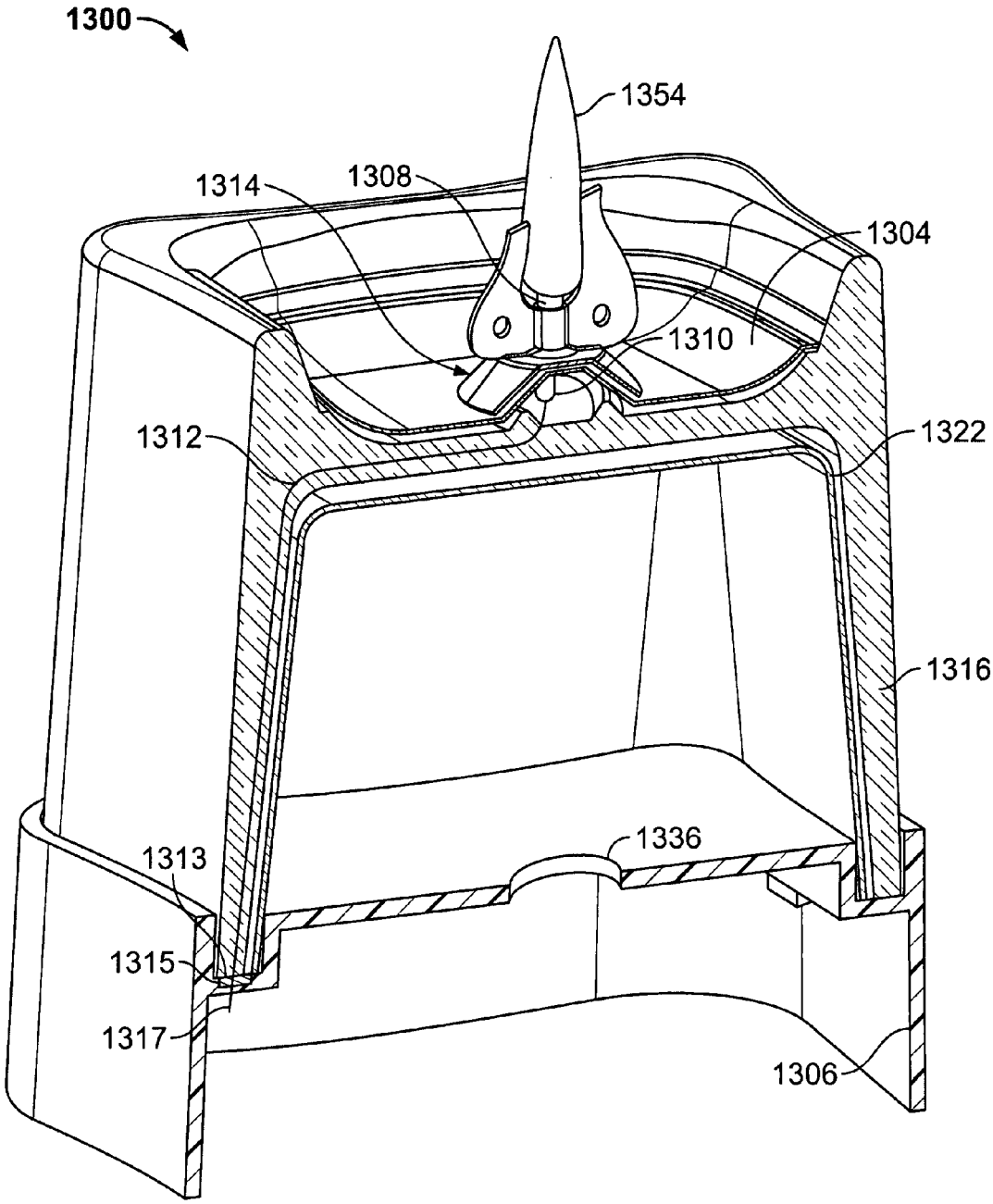
FIG. 39 is an elevated cross-sectional view of a candle assembly according to another embodiment incorporating a heat sensor.

The embodiment shown in FIG. 39 incorporates into the candle assembly 1300 a heat sensor 1310 in thermal communication with the melting plate 1304. The heat sensor 1310 detects the rise in temperature of the melting plate due to the presence of the flame 1354 upon the wick 1308. Detection of heat by the heat sensor 1310 leads to the activation or enablement of electrical components disposed within the control unit 1306. Once the flame 1354 has been extinguished, the melting plate 1304 cools causing the heat sensor 1310 to deactivate or disenable the electrical components. Examples of heat sensors 1310 include, but are not limited to thermistors, Hall effect sensors, and/or Reed switches, and the like.

Figure 40:
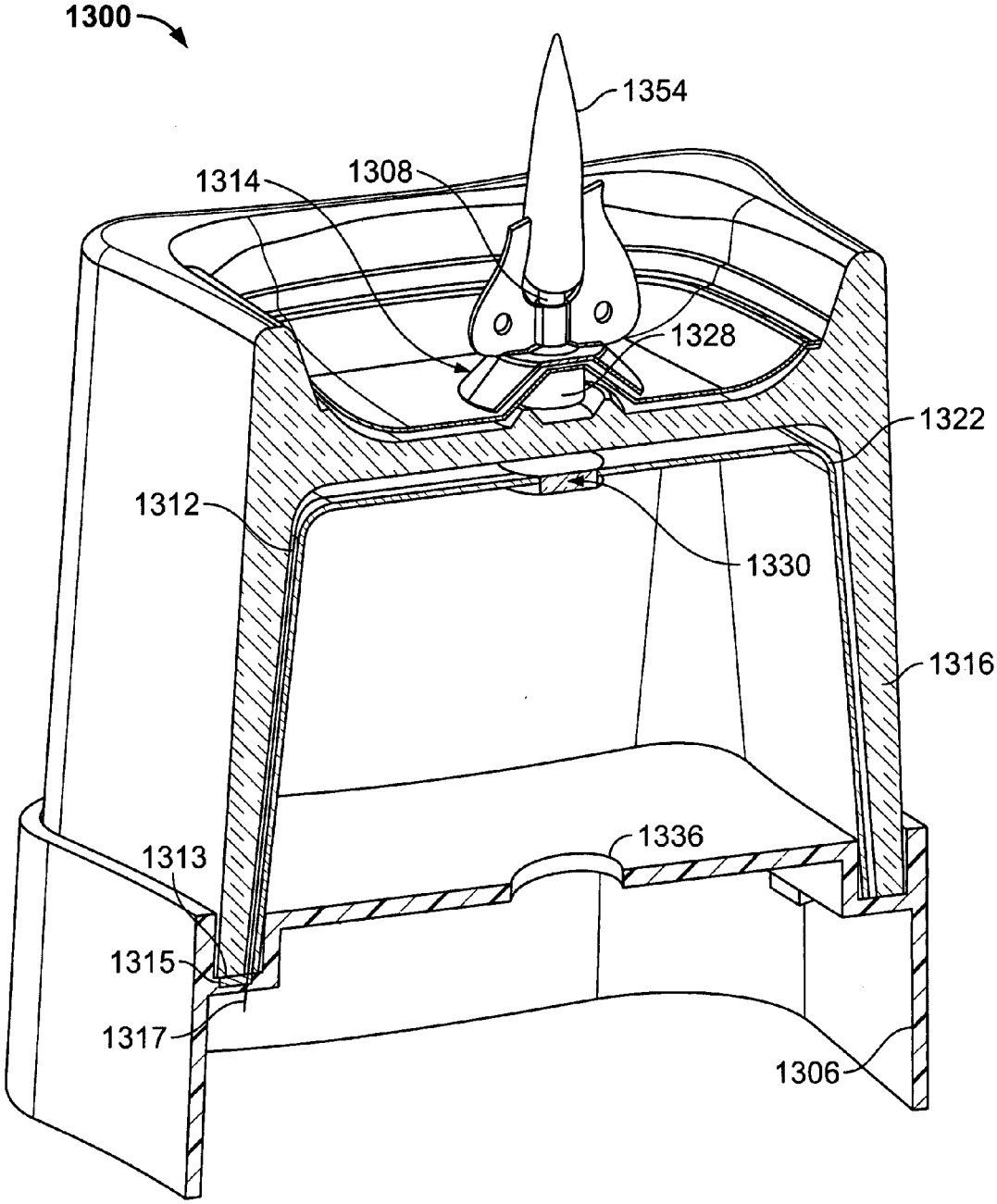
FIG. 40 is an elevated cross-sectional view of a candle assembly according to another embodiment incorporating a Hall effect sensor.

In another embodiment, as shown in FIG. 40, the candle assembly 1300 incorporates a heat sensor 1310 such as a Hall effect sensor to detect changes in a magnetic field associated with changes in heat of a magnet 1328 disposed adjacent the heat sensor 1310. The heat sensor 1310 activates, deactivates, enables, and/or disables the electrical components within the control unit 1306. In this embodiment, a single magnet 1328 may function to retain the wick holder 1314, as well as function in combination with the heat sensor 1310 to link the flame 1354 with control of the electrical components. It is envisioned that additional magnets in direct or indirect heat communication with the flame 1354 may be used with the heat sensor 1310 to operatively link the flame to the electrical components. In a further embodiment, the Hall effect sensor 1310 may be used to sense the presence of a wick holder 1314. For example, if a wick holder 1314 is absent from the candle assembly 1300, the Hall effect sensor 1310 may be able to sense the absence of the wick holder due to an altered magnetic field of the magnet 1328. The absence of the wick holder 1314 may be reported to the electrical components of the control unit 1306, which in turn may lead to an audible and/or visual prompt to the user to remind the user to replace the fuel element.

Figure 41:
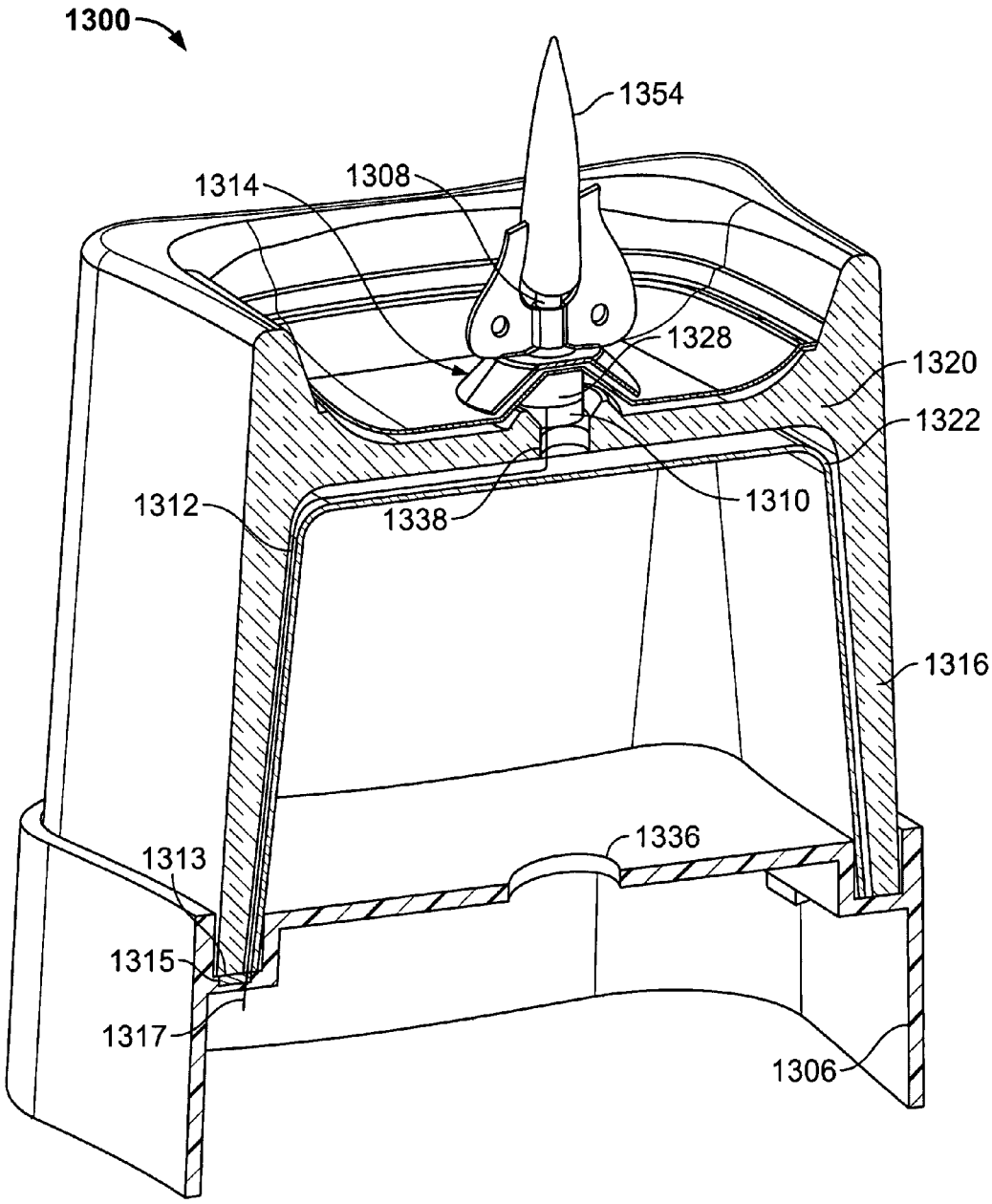
FIG. 41 candle is another elevated cross-sectional view of a candle assembly according to another embodiment incorporating a heat sensor.

Similar to the embodiments seen in FIGS. 39 and 40, FIG. 41 depicts the candle assembly 1300 comprising a support plate 1320 (for example, made of glass) having a hole 1338 therethrough to allow the heat sensor 1310 to be positioned closer to the flame 1354 or to the magnet 1328 resulting in increased sensitivity of the heat sensor to changes in heat or changes in the magnetic strength of the magnet in response to the flame.

Heat sensitive sensors useful in the present invention include those, for example, described in U.S. Pat. No. 5,015,175. Additional heat sensors useful in the present invention include, for example, those described in U.S. Pat. No. 4,983,119. Additional heat sensitive sensors useful in the present invention include, for example, those described in U.S. Pat. No. 5,057,005.

Figure 42:
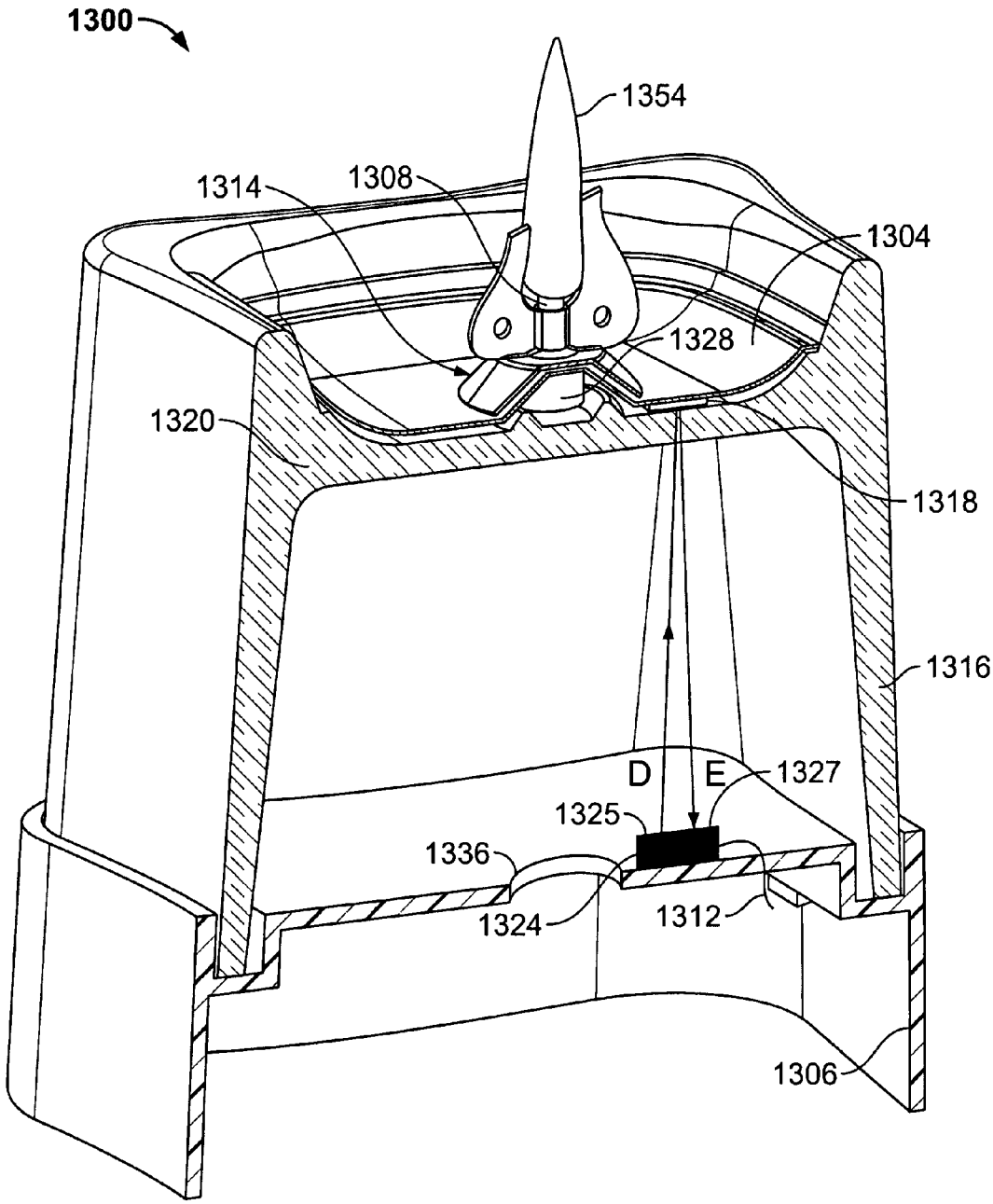
FIG. 42 is another cross-sectional view of a candle assembly according to another embodiment incorporating a thermochromatic label.

Another mechanism to operatively link the flame 1354 with the activation, deactivation, enablement, and/or disablement of electrical components within the control unit 1306 is illustrated in FIG. 42. Here, the candle assembly 1300 is equipped with a thermochromatic strip 1318 attached beneath and in thermal communication with the melting plate 1304 and a photoelectric sensor 1324. Upon lighting the wick 1308, meltable fuel (not shown) is melted and fills the melting plate 1304. Heat from the melted fuel causes the thermochromatic strip 1318 to change from a first color to a second color. The change from the first color (for example, at temperature less than or equal to about 100° F., or less than or equal to about 110° F., or less than or equal to about 120° F., or less than or equal to about 130° F., or less than or equal to about 140° F., or less than or equal to about 150° F.) to the second color (for example, at a temperature greater than or equal to about 100° F., or greater than or equal to about 110° F., or greater than or equal to about 120° F., or greater than or equal to about 130° F., or greater than or equal to about 140° F., or greater than or equal to about 150° F.) of the thermochromatic strip 1318 is detected by a photoelectric sensor 1324. The photoelectric sensor 1324 emits a light beam (for example, an infrared or visible light beam) from an LED 1325 in a direction D toward the thermochromatic strip 1318. The color of the light reflected from the thermochromatic strip 1318 in a direction E is detected by a photosensitive cell 1327 (such as a photoresistor and/or a photodiode) within the photoelectric sensor 1324. The connector 1312 connects the photoelectric sensor 1324 to electrical components within the control unit 1306. In a similar embodiment to that shown in FIG. 44, the melting plate 1304 is formed of the surface of the support plate 1320, and the thermochromatic strip 1318 is attached directly to the underside of the support plate that is integral to the support base 1316, such that the thermochromatic strip is in thermal communication with the glass support plate. If desirable, to reduce interference from ambient light, the emitted light beam may be modulated to have a dominant wavelength (for example, in the blue spectrum). Alternatively, a full spectrum light source could be used with an additional optical filter (not shown) of the appropriate color to attain an emitted light beam having a dominant wavelength.

It is contemplated that the abovementioned mechanisms for operatively linking the flame to the activation of the various electrical components described herein may have the further function of maximizing battery life such that the one or more of the electrical components may be operable only when the flame is present and/or after a pre-select temperature (for example, greater than or equal to about 100° F., or greater than or equal to about 110° F., or greater than or equal to about 120° F., or greater than or equal to about 130° F., or greater than or equal to about 140° F., or greater than or equal to about 150° F.) is reached. Further, it is contemplated that when a candle assembly is equipped with a mechanism for operatively linking the flame to the activation of the electrical components, the light and sound switches (such as, for example, 700*c,d* and 702*c,d* of FIG. 18) could be removed and only an audio level set of buttons remain on the product (such as, for example, 700*a,b* and 702*a,b* of FIG. 18).

Figure 43:
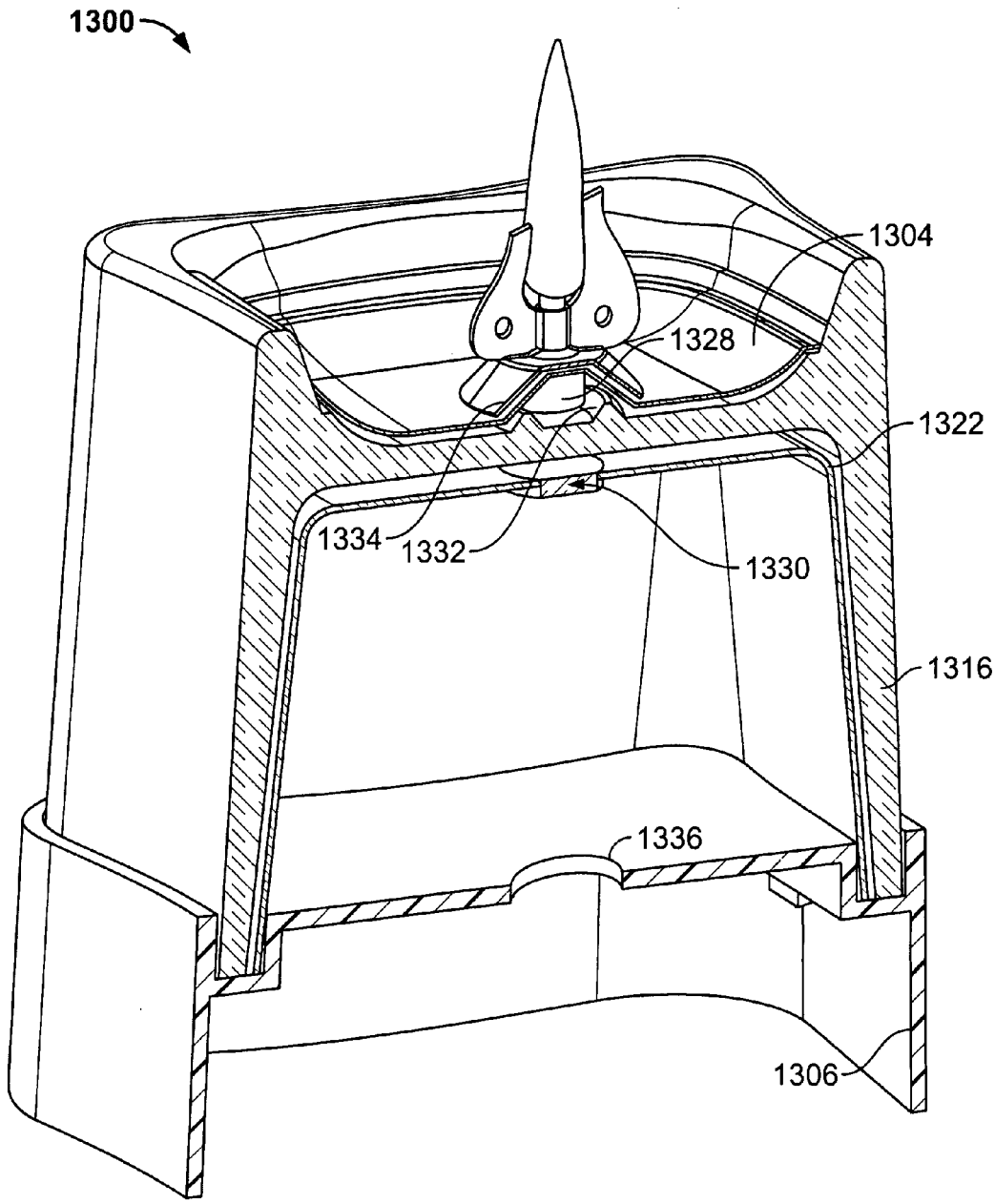
FIG. 43 is another elevated cross-sectional view of a candle assembly according to another embodiment incorporating a magnet or ferrous material disposed between the diffuser and the candleholder.

Another example of a lock and key mechanism is depicted in FIG. 43. Here, the candle assembly 1300 has a first magnet 1328 with a first polarity disposed within a cavity 1332 in a bottom surface of the melting plate 1304 beneath a capillary lobe 1334. Disposed beneath the support base 1316 and atop the control unit 1306 similar to that described above is a light diffuser 1322 with a second magnet with a second polarity or a ferrous material 1330 disposed on a surface of the light diffuser. The first polarity of the first magnet 1328 second polarity of the second magnet or the ferrous material 1330 are in such orientation so as to have an attractive force therebetween that secures the support base 1316 to the control unit 1306. This securement system allows a user to remove the support base 1316 for cleaning and replace it upon the control unit 1306 without risk of misassembly.

Figure 44:
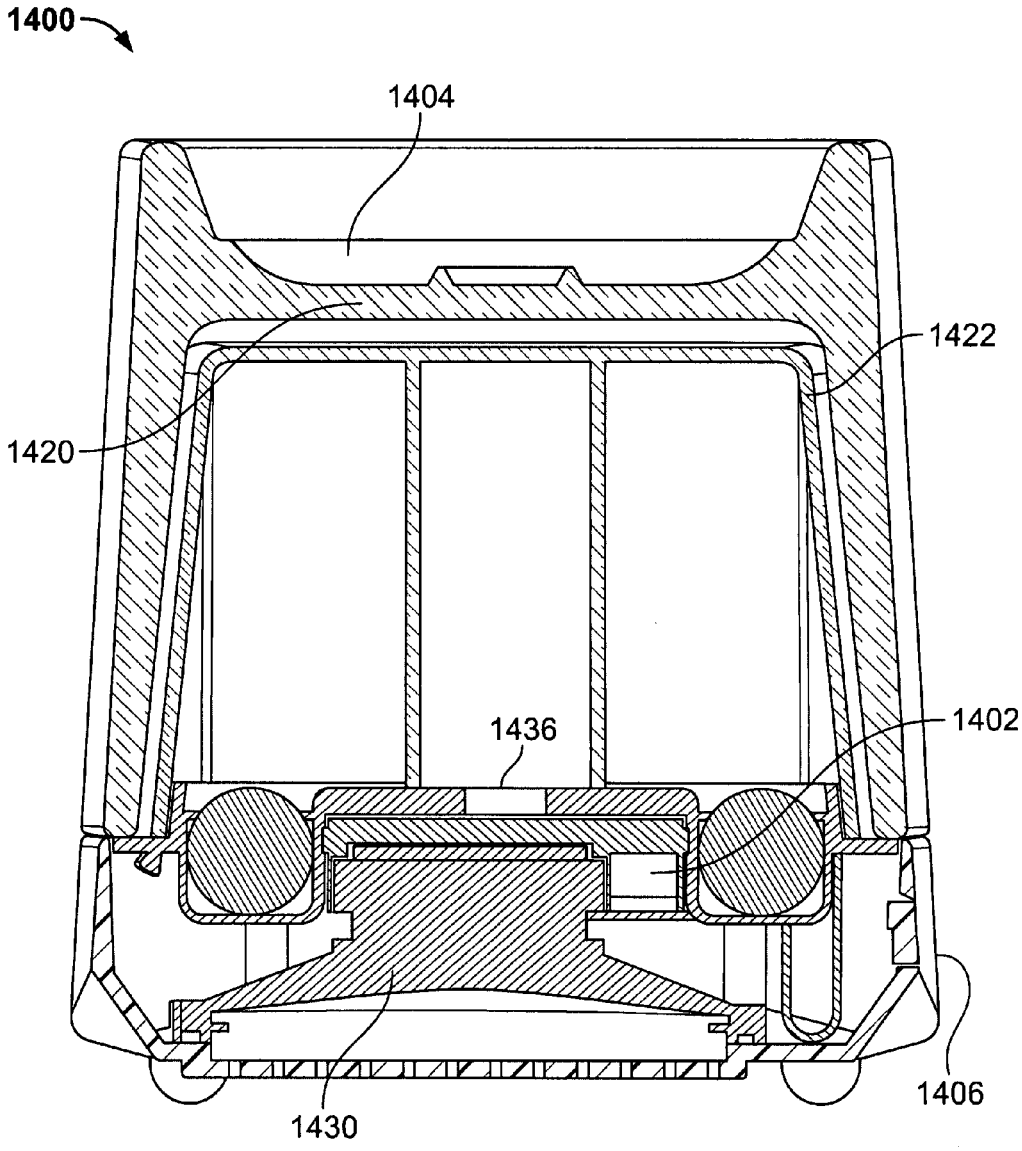
FIG. 44 is another cross-sectional view of a candle assembly according to another embodiment incorporating an electronic communication link in the control unit.
Figure 45:
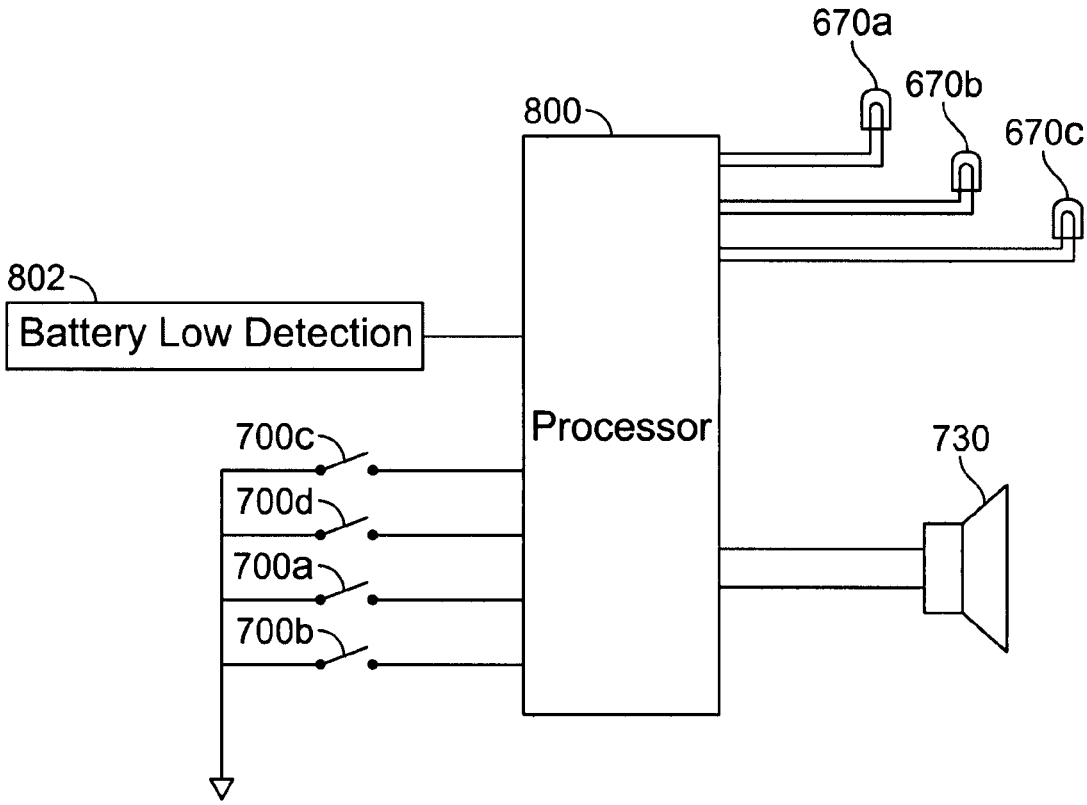
FIG. 45 is a simplified block and schematic diagram of a circuit for operating the LEDs and speaker of FIGS. 14, 15, and 18-21.

Now turning to FIG. 44, a candle assembly 1400 similar to the candle assembly 1300 shown in FIGS. 39-43 has an electrical communication link 1402 incorporated into the control unit 1406 similar to that described above, which allows a user to reprogram electrical components associated with the control unit, such as light effects from the LEDs (not shown but described previously) disposed through a hole 1436 at or above a top surface of the control unit and/or sound effects emitted from a speaker 1430 held within the control unit. In this embodiment, the melting plate 1404 is formed of the surface of the support plate 1420. Further, it is contemplated that the melting plate may be made of any material that sufficiently facilitates the operation of the melting plate as described herein.

The reprogramming the electrical components associated with the control unit 1406 through the electrical communication link 1402 may be performed in any fashion known to those skilled in the art including, for example, at a user's home, over the internet, in a store (for example, at a reprogramming kiosk or display shelf apparatus), and/or from a remote location. Examples of electrical communication links not shown but contemplated for use in this embodiment include, for example, removable data storage media, cables, USB ports, radio frequency sensors, infrared sensors, blue tooth enabled links, inductive communication links, an acoustic switch, a vibration detecting switch, a phono jack (for example, to connect an iPod® or other portable devices), and/or the control unit may be removably docked in a docking bay to facilitate reprogramming of the control unit 1406. Inclusion of the link 1402 could permit seasonal reprogramming (for example, to reprogram a Christmas sound and light theme or a Halloween sound and light theme) and serve to remind the consumer to refill the candle. Any sound or light show is contemplated for programming, including, for example, spoken word, language lessons, books-on-tape, and/or poetry. Since the control unit uses a processor to operate the light and/or sound shows, any common interface (for example, those described herein) could be integrated into the electrical components and software controlling the light and/or sound shows. Further, it is contemplated that establishing an electronic connection with the control unit via the electrical communication link 1402 and/or pressing a button sequence could initiate an interface sequence that would download and/or make available a new light and/or sound program. It is also contemplated that a software-based application program could be provided that allows the user to create a personalized light and/or sound show program that could be input into the control unit via the electrical communication link using, for example, a personal digital assistant, a personal computer, or other devices. Further, the electrical communication link 1402 may be located at any convenient location on the candle assembly 1400 to facilitate the operation thereof.

Figure 54:
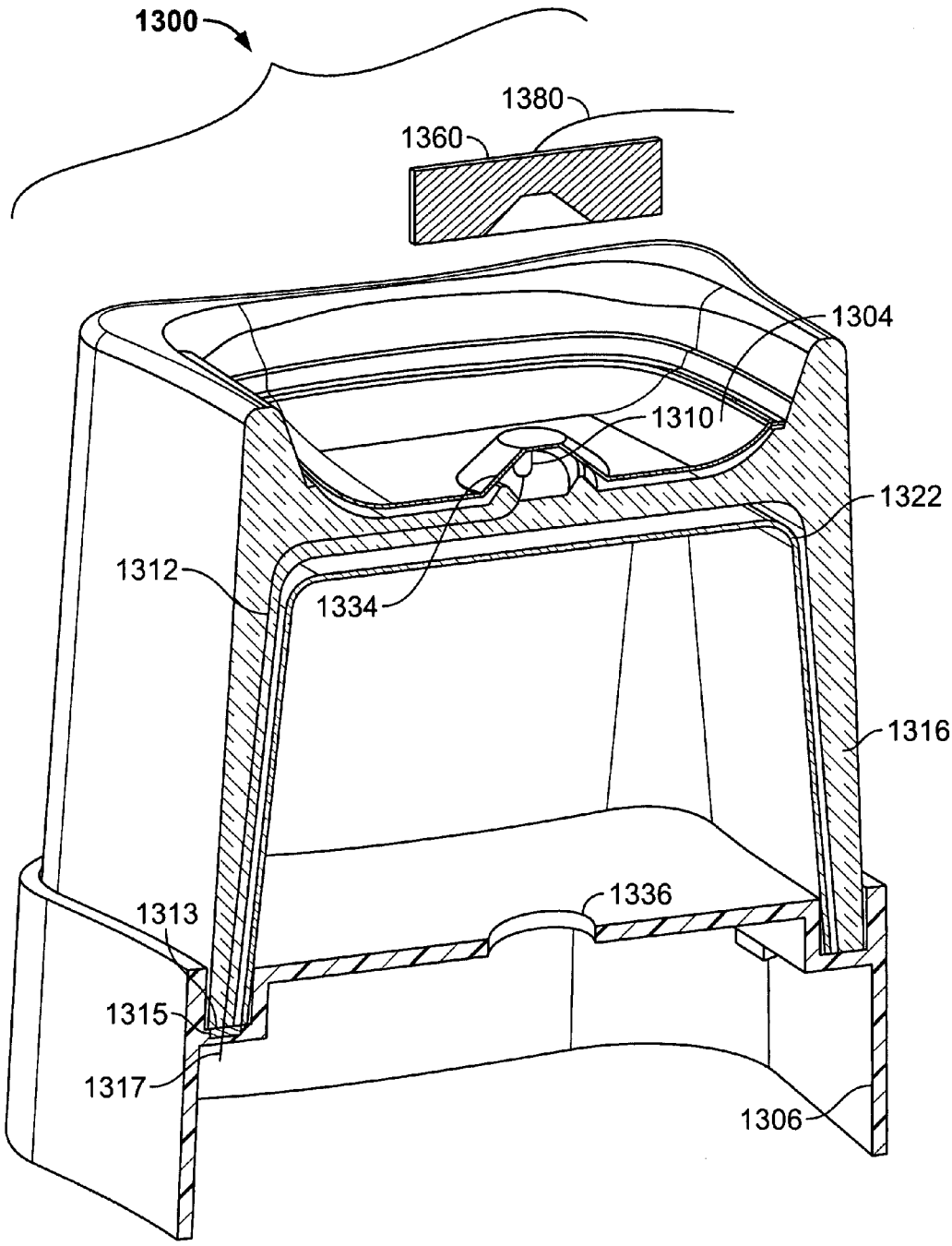
FIG. 54 is another elevated cross-sectional view of a candle assembly according to another embodiment utilizing a Hall effect sensor as a communication link to electrical components within the control unit.

In another embodiment shown in FIG. 54, a candle assembly 1300 includes the Hall effect sensor 1310 that may be used as the communication link to enable reprogramming of the electrical components (not shown) of the control unit 1306. In this embodiment, the user places a wick holder-shaped transducer 1360 that is connected to a computer and/or similar device (not shown) via a connector 1380 onto the capillary lobe 1334 of the melting plate 1304. Through altering a magnetic field in a communicative manner (for example, in a binary manner), information is passed to the electrical components of the control unit 1306 to reprogram (for example, add, delete, and/or change) the encoded programs controlling light and/or sound effects of the candle assembly 1300.

In another embodiment, rechargeable batteries and/or an AC adapter may be included to power the electrical components described herein.

In another embodiment, a candle assembly (not shown) may be placed in a body of liquid wherein the candle assembly floats on the surface of the body of liquid. It is contemplated for the current embodiments that bodies of liquid include, for example, water ponds, lakes, streams, baths, containers of water and/or other liquids, and the like.

In another embodiment, a candle assembly (not shown) is contemplated that incorporates multiple fuel elements that may, for example, incorporate differently scented oils and/or fragrances. The multiple fuel elements may be modular, for example, they may be assembled together to form one fuel element. It is contemplated that when the fuel elements are modular, specific ratios of differently scented fuel elements may be combined to achieve a specific scent and/or fragrance blend when the fuel elements are burned at the same time. Further, the candle assembly may have multiple wick holders to accommodate multiple fuel elements. In the latter embodiment, for example, a consumer may choose to burn differently scented fuel elements simultaneously on the different wick holders in the same candle assembly to create a blend of scents. It is further contemplated that kits including a plurality of differently scented fuel elements be available for the user to be used either as a pre-selected combination of fuel elements or to allow the user to create a personalized fragrance blend according to personal preference.

In another embodiment, removable data storage media (not shown) including, for example, external hard drives, PDA's, cell phones, flash drives, compact flash memory cards, and/or memory sticks removably installed in the control unit may be used to provide variation in light and/or sound shows of the control unit 1406. The removable data storage media could be used in combination with the memory of the control unit installed at the time of manufacture to augment the memory of the control unit to increase the number and/or complexity of light and/or sound shows of the control unit. Further, the removable data storage media could have any conceivable type of sound and/or light information encoded thereon including, for example, spoken word, language lessons, poetry, holiday light and/or sound shows, popular culture light and/or sound shows (for example, those associated with movies or other popular events), international light and/or sound shows, cultural-specific light and/or sound shows, and the like. The removable data storage media could also be reprogrammed with light and/or sound shows through a personal computer or other methods known to those skilled in the art. Such shows could be preprogrammed on the removable data storage media and/or the removable data storage media could be selectively modified to incorporate shows and/or light and/or sound themes from one or more sources for free, for a fee per download, or through a subscription service.

It is contemplated that various combinations of the embodiments described herein may be available to a consumer, for example, in different configurations and/or kits. These configurations and/or kits may include, for example, fuel element refills, candle jar refills, removable data storage media, instructions, software-based application programs (including, for example, those described previously), batteries, replacement parts, customizable elements including, for example, decals, paints, stickers, letters, numbers, figures, and the like and combinations thereof. Further, the configurations and/or kits contemplated may have holiday themes, event themes (such as, for example, birthdays, special days, sporting events, movies, and other popular entertainment), personalized themes, and the like. The kits may have a complete candle assembly and accessories associated with the candle assembly, and/or the kits may be directed toward individual components of the candle assembly (such as, for example, melting plates, batteries, fuel elements, removable data storage media, etc.).

It is contemplated that the various mechanisms disclosed herein for operatively linking the flame to the activation of the various electrical components may be configured to be incorporated into any of the candle assemblies described or any variation thereof. For example, and referring now to FIGS. 45-49, components on the printed circuit boards 666 and 668 (seen in FIGS. 18-21 and representational of all embodiments described herein having a control unit to house electronic components), are interconnected with the speaker 730 and the batteries 664*a*-664*d* (see FIGS. 14 and 15) in a general fashion as illustrated. The circuitry disposed on the printed circuit boards 666 and 668 includes a processor 800 (see FIGS. 45-49), which may be, for example, a microprocessor manufactured by Holtek Semiconductor Inc. under part number HT86192. The processor 800 may be programmed to be responsive to actuation of the switches 700*a*-700*d* or auxiliary switches described below to selectively illuminate the LEDs 670 (including a green LED 670*a*, a red LED 670*b*, and a blue LED 670*c*) and/or reproduce digitally encoded sounds via the speaker 730. In one embodiment, the switch 700*c*, when momentarily closed, causes the processor 800 to operate the LEDs 670 in one of four modes of operation described in greater detail hereinafter. When the switch 700*d* is momentarily closed, the processor 800 develops analog waveforms that are delivered to the speaker 730 to reproduce one of four sound patterns. Closing the switches 700*a* or 700*b* causes the volume of the sounds reproduced by the speaker 730 to increase or decrease, respectively.

The processor 800, in one embodiment, is further responsive to a detection circuit 802 that determines when the combined voltage developed by the series of connected batteries 664*a*-664*d* drops below a predetermined level.

Figure 46:
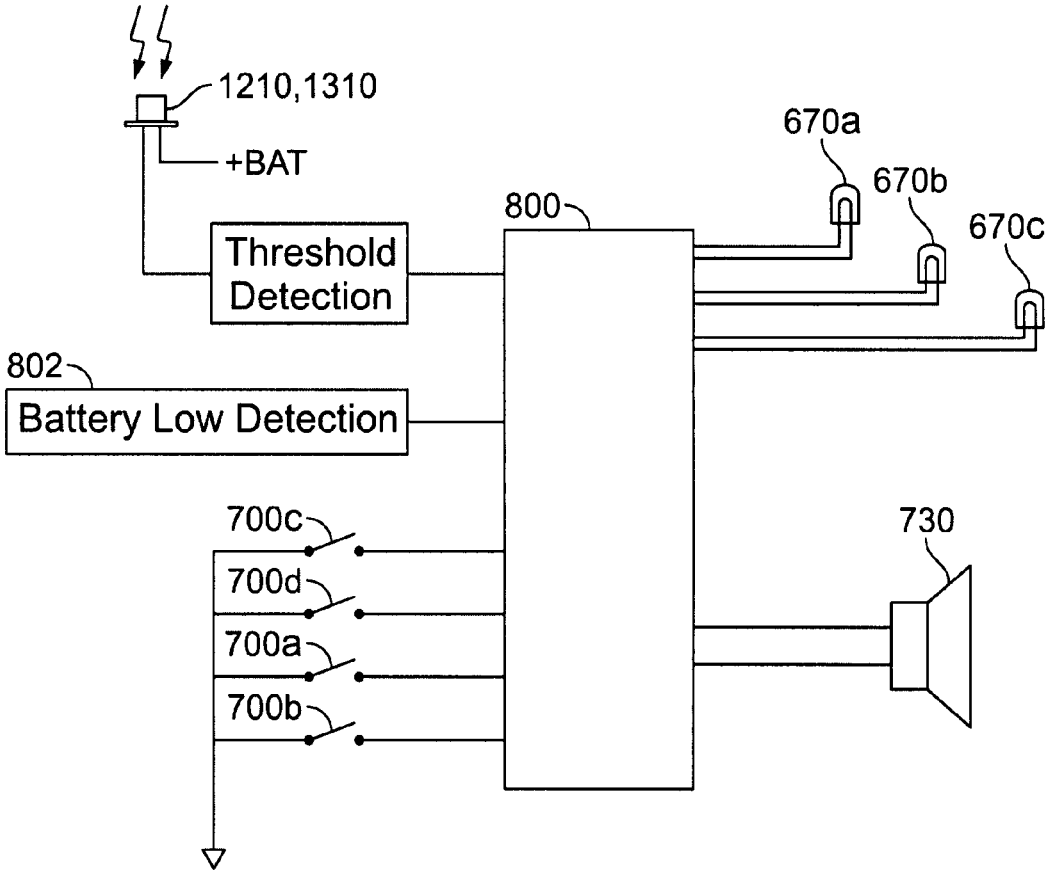
FIG. 46 is a simplified block and schematic diagram of a circuit for operating the LEDs and speaker of a candle assembly according to an embodiment incorporating a light and/or heat sensor.

Referring now to FIG. 46, auxiliary switches incorporated into the circuitry include the photosensitive sensor 1210 and/or the heat sensor 1310. The photosensitive sensor 1210 and/or the heat sensor 1310 interconnect with the electrical components of the control unit through the processor 800 to control the selective illumination of the LEDs 670 and/or to reproduce digitally encoded sounds via the speaker 730 in cooperation with the switches 700*a-d* and the detection circuit 802.

In addition to heat and/or light detecting methods, audio detecting sensors for example, the Clapper® acoustically operated switch, may be employed independent from or in conjunction with any of the embodiments disclosed herein, including the light detecting switching methods disclosed to activate and/or deactivate the electrical components within the control unit 1206. Possible audio detecting sensors could include microphones functionally linked with electronic filters (for example, ASICs and/or digital signal processor) or other combinations of electrical components. Functionally, the audio detecting mechanism could restart the light and/or sound shows from the previous setting or turn current selections on and/or off. In another embodiment, serial coded audio sequences would simulate the operation of each switch 700*a-d*. Acoustic switches useful in the present disclosure include those, for example, described in U.S. Pat. No. 5,493,618. Additional useful acoustic switches include those, for example, described in U.S. Pat. No. 5,615,271.

Figure 47:
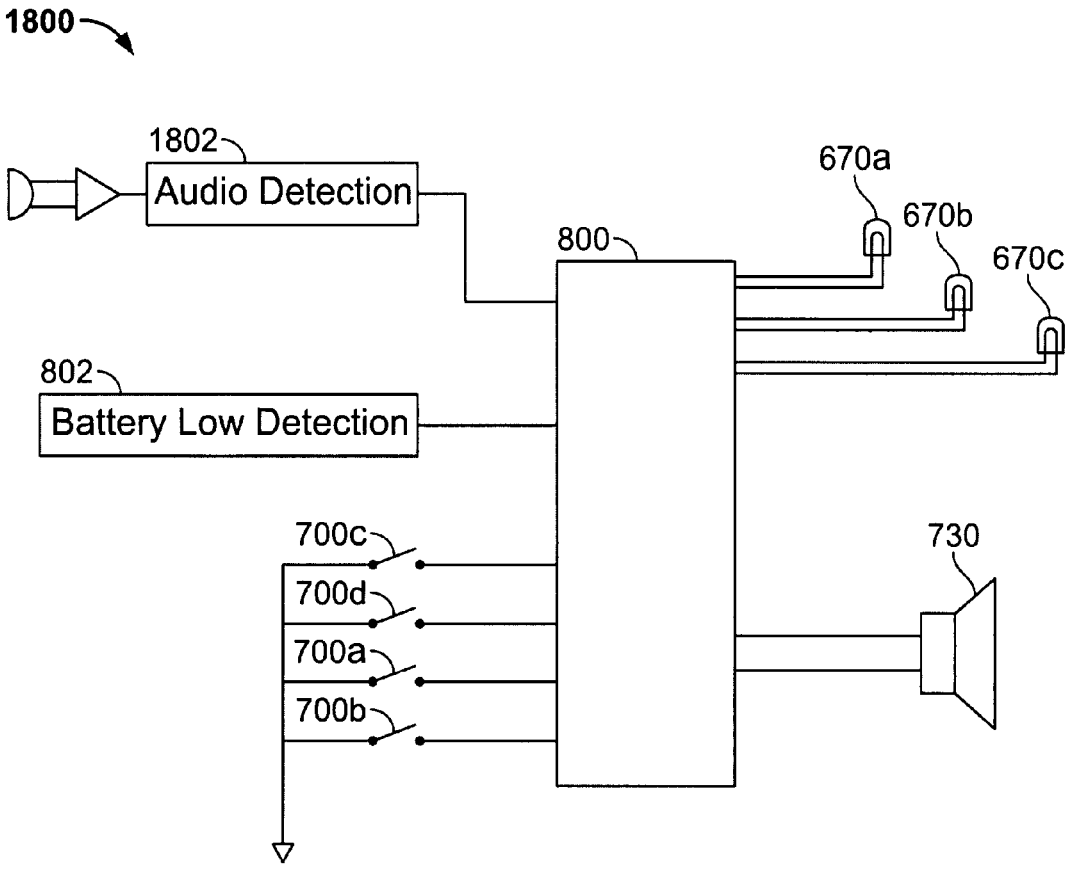
FIG. 47 is a simplified block and schematic diagram of a circuit for operating the LEDs and speaker of a candle assembly according to an embodiment incorporating an audio detecting regulatory sensor.

In one embodiment, an audio detecting sensor 1800 interconnects with the processor 800 in a fashion similar to that of FIG. 46 as illustrated in FIG. 47. In one embodiment, software known to those skilled in the art may perform the audio detection and the indicated audio detection box 1802 would then consist of a signal conditioner (not shown) and an analog to digital converter (not shown).

Figure 48:
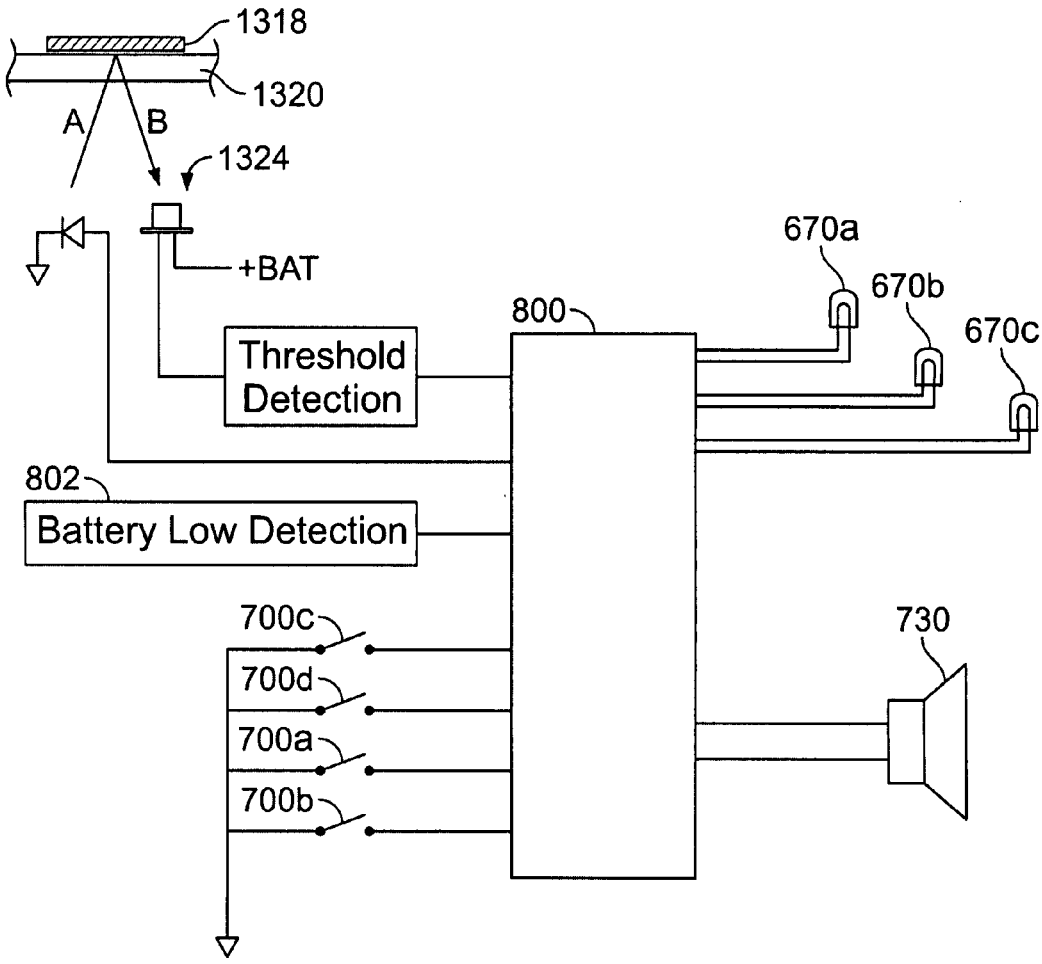
FIG. 48 is a simplified block and schematic diagram of a circuit for operating the LEDs and speaker of a candle assembly according to an embodiment incorporating a light sensor and a thermochromatic strip.

In FIG. 48, a simplified block and schematic diagram of the circuitry for the embodiment shown in FIG. 42 is presented. Here, a photoelectric sensor 1324 emits a beam of light from the LED 1325 in the direction D that passes through the support plate 1320 and reflects off of the thermochromatic strip 1318 in the direction E. The reflected light is detected by the photosensitive cell 1327 within the photoelectric sensor 1324 that cooperatively regulates the processor 800 in conjunction with the switches 700*a-d* and the detection circuit 802.

Figure 49:
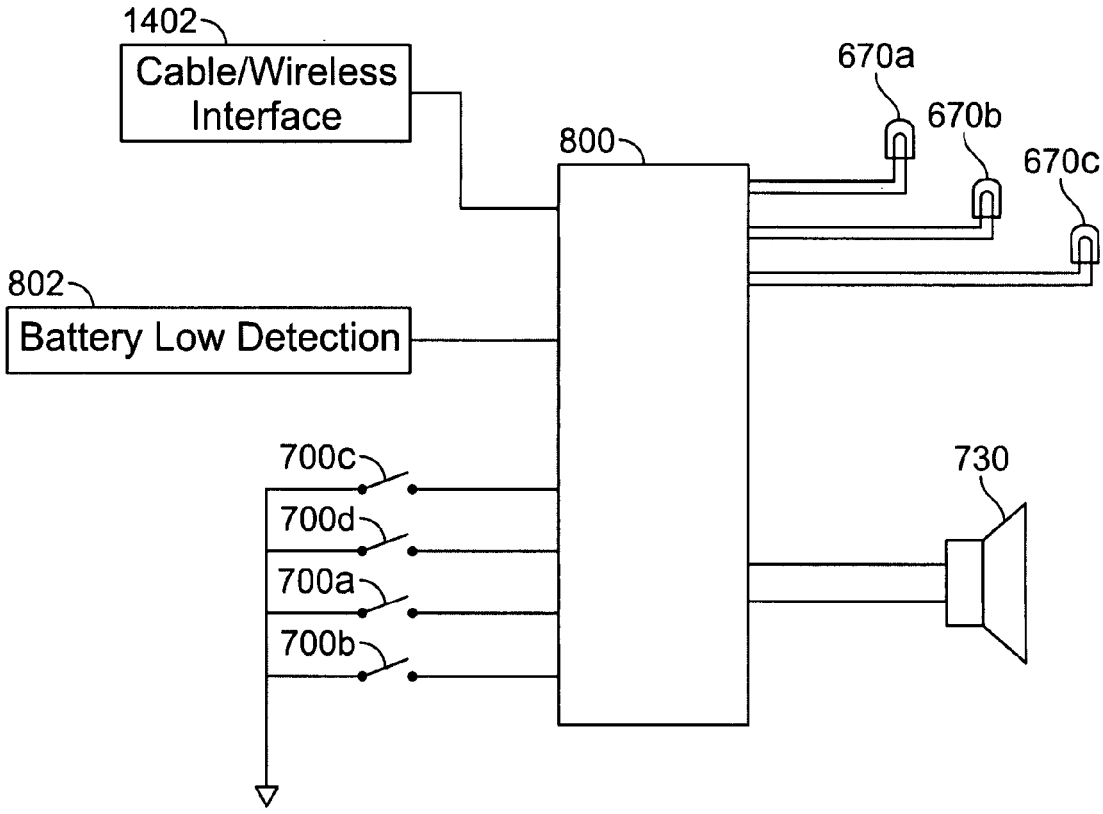
FIG. 49 is a simplified block and schematic diagram of a circuit for operating the LEDs and speaker of a candle assembly according to an embodiment incorporating an electronic communication link.
Figure 50:
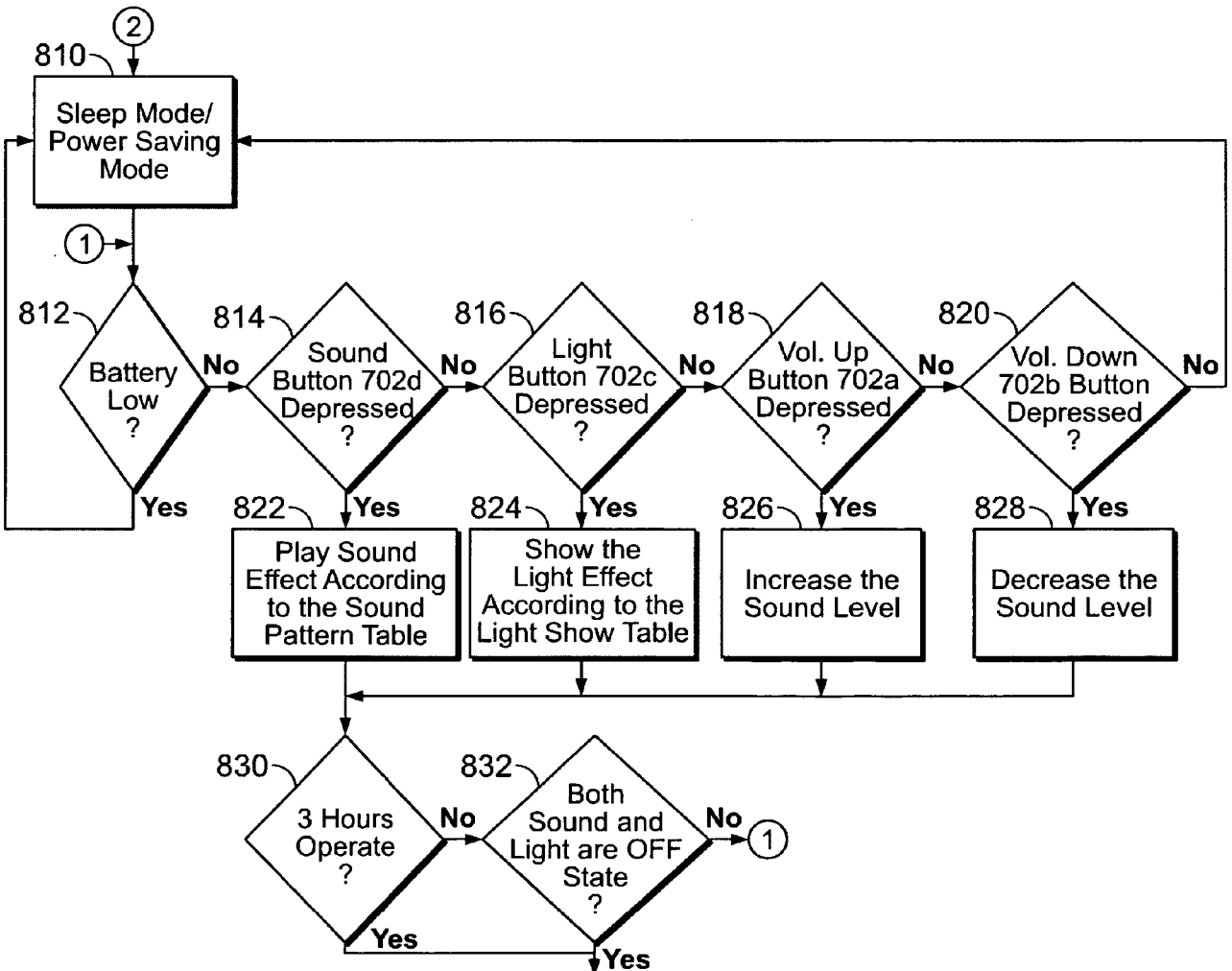
FIG. 50 is a flowchart illustrating programming executed by the processor of FIG. 45.

FIG. 49 illustrates the interconnection of the electronic communication link 1402 with the processor 800 to enable the reprogramming of the processor via the electronic communication link to vary light and/or sound show programs.

The flowcharts of FIGS. 50-53 illustrate the operation of the processor 800 in the response to execution of programming stored therein. A block 810 implements a sleep and/or power saving mode of operation whereby most functions of the processor 800 are shut down, with the exception of circuitry for detecting when the batteries have been replaced and adequate voltage is being developed thereby. This operation is illustrated by a block 812, which checks to determine whether the battery voltage is low. If the battery voltage is low, control returns to the block 810 until the combined battery voltage exceeds a predetermined level. Once the combined battery voltage exceeds the predetermined level, a series of blocks 814, 816, 818, and 820 checks to determine whether any of the buttons 702*a*-702*d* has been depressed. If any of the blocks 814, 816, 818, or 820 determines that one of the buttons 702*a*-702*d* has been depressed, control passes to one of the series of blocks 822, 824, 826, or 828, respectively. Specifically, if the block 814 determines that the sound button 702*d* has been depressed, the block 822 plays an encoded sound effect according to a table stored in the processor 800. If the block 816 determines that the light button 702*c* has been depressed, a light effect, such as a light show as determined by a table stored in the processor 800 is displayed by suitably energizing the LEDs 670.

The sound and light buttons 702*d* and 702*c* operate to cause the processor 800 to step through different sound effects and light effects and no sound and no light conditions. In one embodiment, the light effects are independent of the sound effects in the sense that selection of a particular light effect does not result in selection of a particular sound effect, or vice versa. In one embodiment, each momentary depression of the sound button 702*d* causes the processor 800 to operate as follows:

No sound=>sound 1=>sound 2=>sound 3=>sound 4=>no sound

Similarly, a number of momentary depressions of the light button 702*c* cause the processor 800 to step through the following sequence:

No light=>light sequence 1=>light sequence 2=>light sequence 3=>light sequence 4=>no light It should be noted that the processor need not step through an equal number of sounds and light sequences. Also, there may be a greater or lesser number of sounds and light sequences.

If the volume up button 702*a* or the volume down button 702*d* has been determined to be depressed, the blocks 826 and 828 increase or decrease the level of the sound emanating from the speaker 730, respectively.

Control from the blocks 822, 824, 826, or 828 passes to a block 830 which checks to determine whether the candle assembly control unit 606 has been operating for a predetermined period of time, such as three hours. If this is found to be the case, control returns to the block 810. Otherwise, a block 832 checks to determine whether the sound and light functions are both in the off state. If this is found to be the case, control returns to the block 810; otherwise, control passes to the block 812 which then checks to determine whether the combined voltage of the batteries 664 is above the predetermined level.

In one embodiment, the LEDs 670 are operated to provide a plurality of light shows that may be individually selected by a user. For example, each of the LEDs 670*a*-670*c* may receive one of 256 discrete current levels at any particular time, thereby resulting in the development of one of 256 light intensity levels at that time for the color emitted by the particular LED 670. Because the LEDs 670 are small and closely spaced next to one another, and because the light developed thereby is diffused, the human eye perceives the combination of the colors, as opposed to the individual colors emitted by the LEDs 670. Accordingly, in such embodiment, the LEDs are capable of displaying approximately 16.7 million colors. Obviously, a different energization scheme could be used whereby a greater or lesser number of colors (including an infinite number of colors) may be displayed, if desired.

Illustratively, the processor 800 may be programmed to display a particular number of light shows, wherein the light shows are individually selectable by depressing the button 702*c* until a particular color is displayed, indicating that a desired light show has been selected. Thereafter, the light show may proceed automatically such that the displayed color changes or "morphs" from one color to a next color, with a transition occurring therebetween. For example, a reddish-orange color may be initially displayed for a period of 7 seconds, followed by a transition to an orange color, and thence to a light yellow-orange color and back to the reddish-orange color. Each color may be displayed for a period lasting, for example, 14 seconds, and a 10 second transition interval may occur between the 14 second periods. The intensities of the LEDs may be linearly or non-linearly varied over time during the transition intervals between starting and ending levels wherein the starting and ending levels result in the displays of the colors during each 14 second period. Further, if desired, the 14 second display periods may have a different duration and may, in fact, be constant or vary in length from period-to-period. Also, the 10 second intervals may be shorter or longer in duration and may be constant or vary from interval-to-interval. As a further example, an orange color may be displayed for a first 6 second interval, followed by a fade for 6 seconds to a yellow color that is maintained for 12 seconds. Thereafter, a fade may be undertaken for 6 seconds to a green color that is maintained for 12 seconds. Additional 6 second fades to 12 second color maintenance periods of blue and pink colors in sequence may be followed by a 6 second fade to a 6 second orange color, whereupon the entire cycle repeats. Any other morphing of any number of colors may be undertaken as desired.

The user may be provided with a means to pause or stop color morphing and thereby maintain a currently displayed color by depressing a pause or stop button. For example, two buttons may be provided with a first button configured to activate a light show when initially depressed by the user and to scroll from light show to light show with each subsequent depression. Depressing the first button after advancing through a final light show mode deactivates the light show. A second button may be configured such that when depressed during the color morphing of the light show, the color morphing is paused or stopped at the currently displayed color. When the second button is depressed again, the light show and color morphing may continue from the point at which the light show was paused or the light show may be stopped. Depressing the first button while in the pause or stop mode may advance the light effect to the next light show with continued color morphing, or, if the light effect was operating in the last light show mode, the light effect may be terminated.

Figure 51:
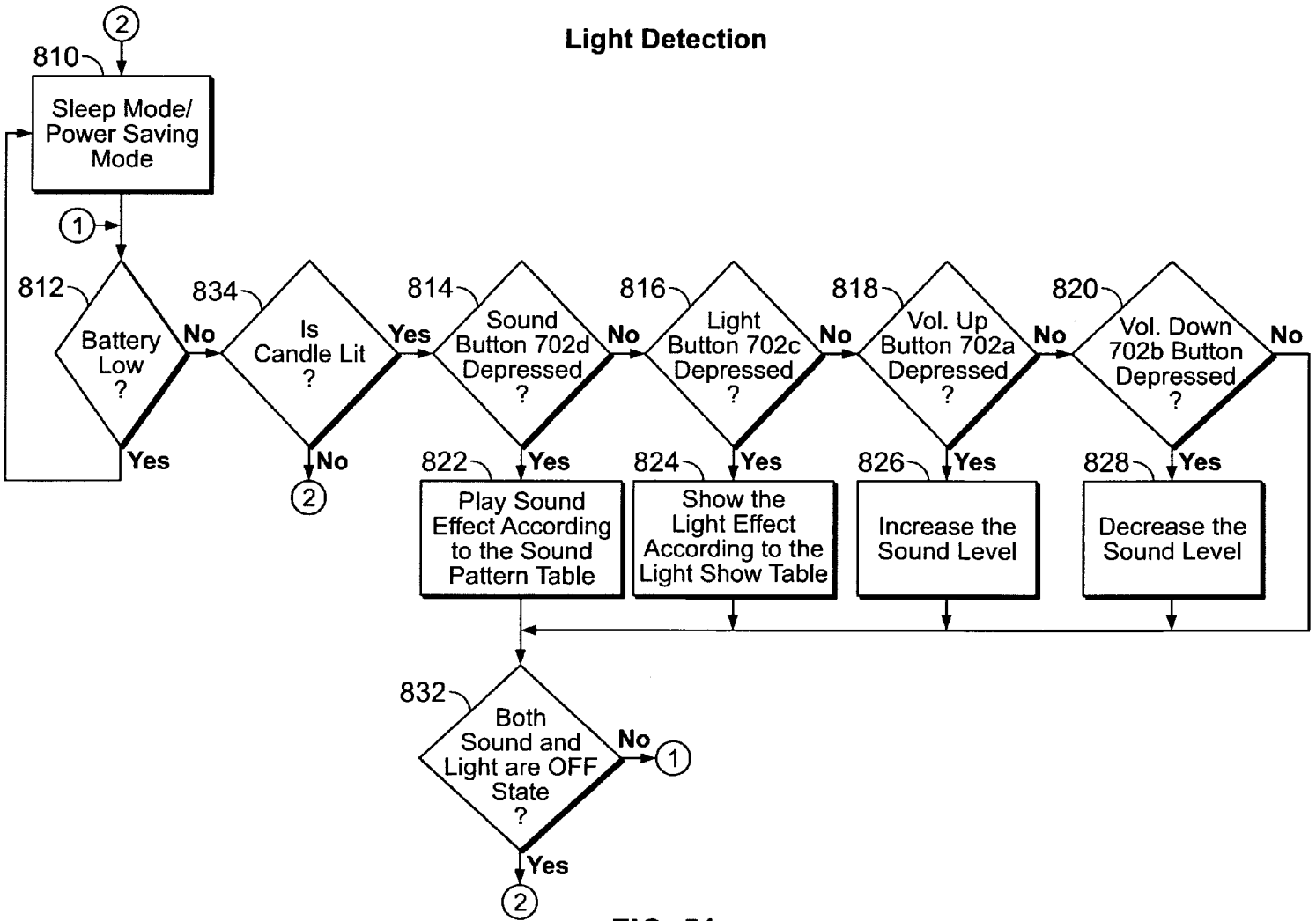
FIG. 51 is a flowchart illustrating programming executed by the processor of the embodiments depicted in FIGS. 35-40.

The flowchart of FIG. 51 illustrates programming executed by the processor 800 for the embodiments incorporating light detecting sensors (FIGS. 33-38) with the exception of the embodiment incorporating the thermochromatic strip, which will be described hereafter. Differing from FIG. 50, a block 834 intercedes between block 812 and 814 to determine whether the candle is lit. If the candle is not lit, then control return to the block 810. Otherwise, if the candle is lit and if any of the blocks 814, 816, 818, or 820 determines that one of the buttons 702*a*-702*d* has been depressed, control passes to one of the series of blocks 822, 824, 826, or 828, respectively. If the candle is lit and none of the blocks 814, 816, 818, or 820 determines that one of the buttons 702*a*-702*d* has been depressed, control passes to block 832.

Figure 52:
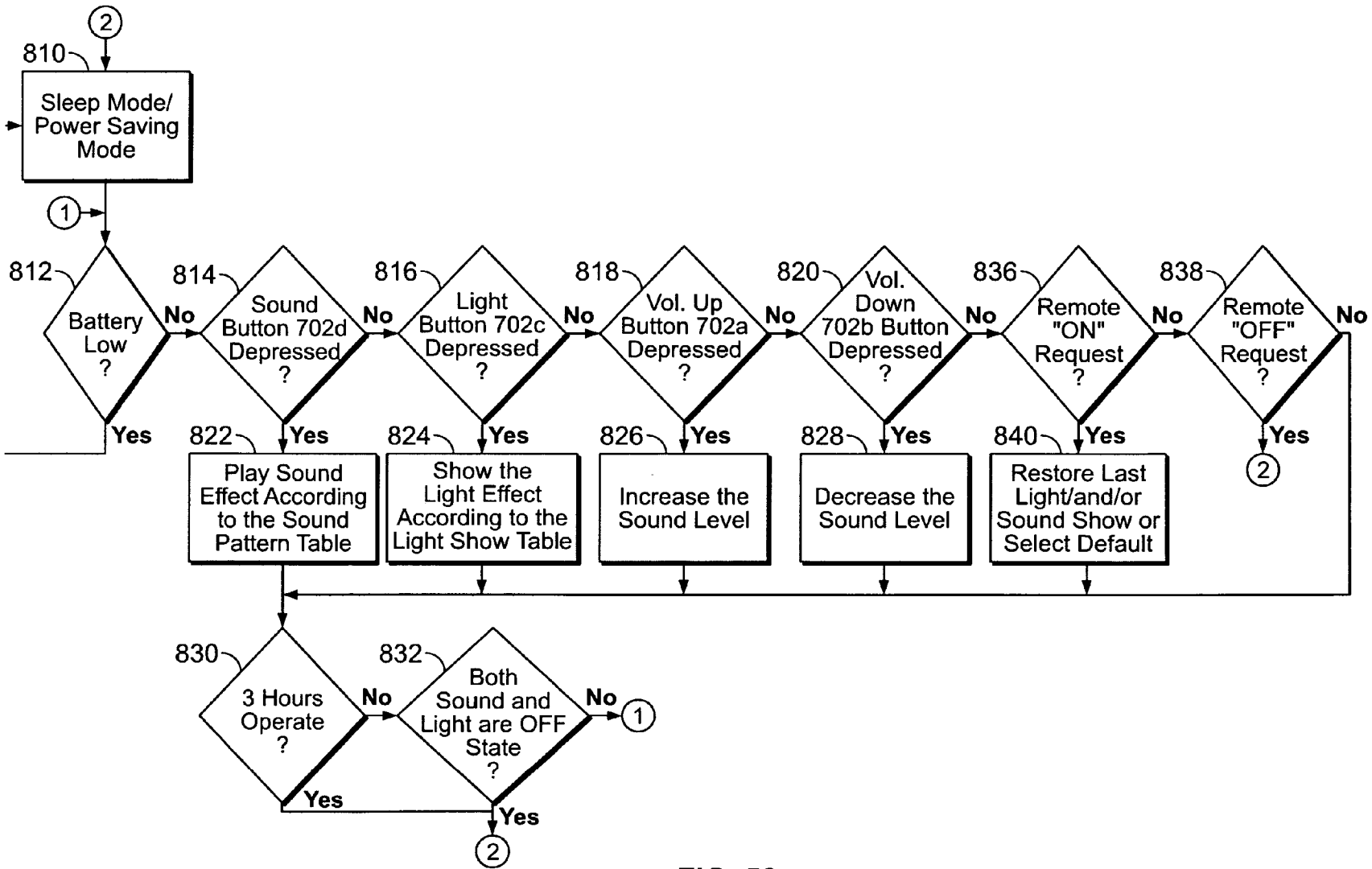
FIG. 52 is a flowchart illustrating programming executed by the processor of the embodiment incorporating an audio detecting sensor.

The flowchart of FIG. 52 illustrates the operation of the audio detecting sensors in the control of the light and/or sound shows. A block 836 determines whether a remote "on" request (for example, an audible command or other audio signal) has occurred. If the remote "on" request has occurred, control passes to block 840, which restores the last light and/or sound show or initiates a default light and/or sound show that may be preprogrammed or chosen by a user. If a remote request "on" has not occurred, control passes to block 838, which determines whether a remote request "off" has occurred. If a remote request "off" has occurred, then control reverts to block 810. If a remote request "off" has not occurred, then control passes to block 830. Further, if none of the blocks 814, 816, 818, or 820 determines that one of the buttons 702*a*-702*d* has been depressed, control passes to block 836 rather than to block 810 as in FIG. 50.

Figure 53:
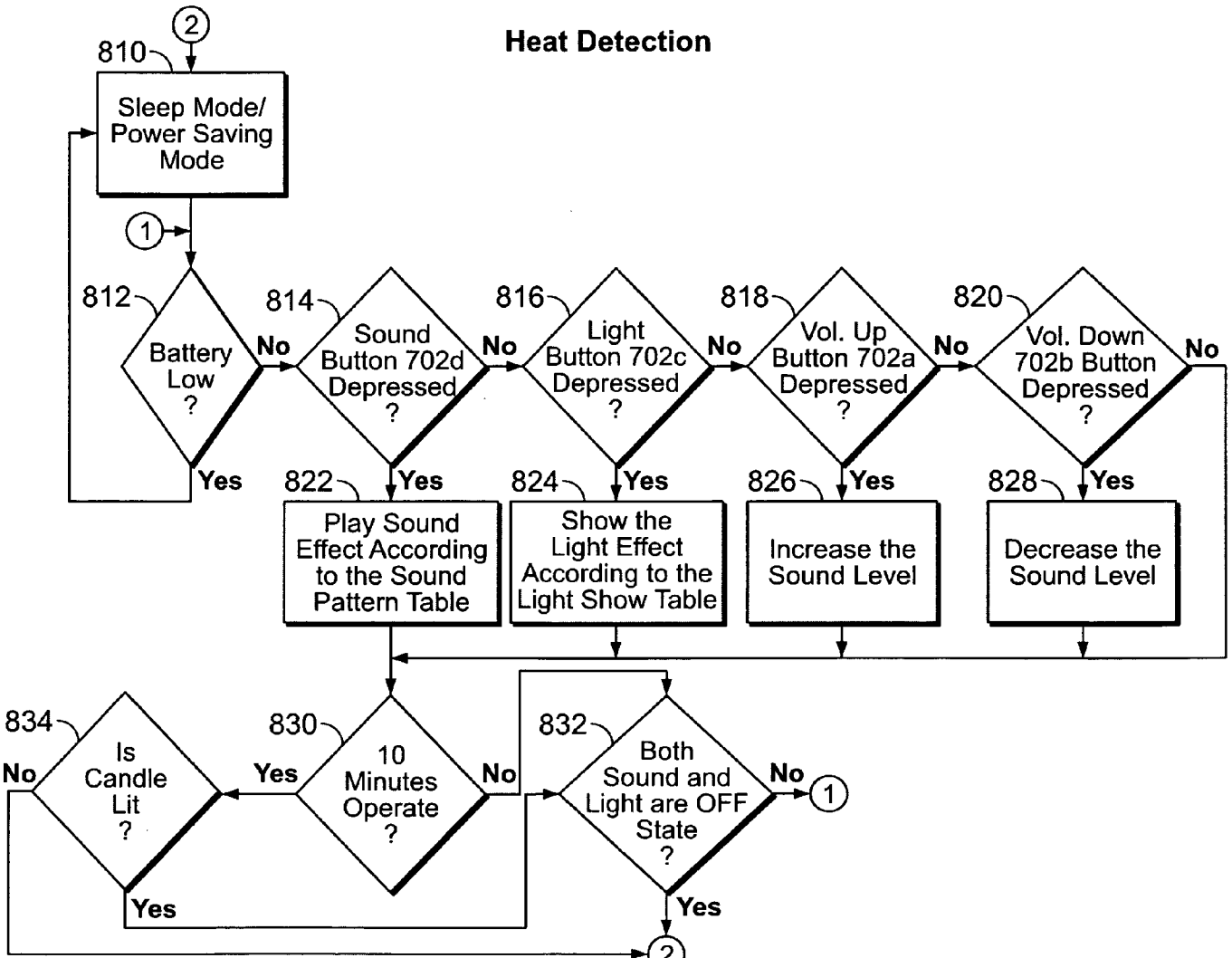
FIG. 53 is a flowchart illustrating programming executed by the processor of the embodiments depicted in FIGS. 42-45.

The flowchart of FIG. 53 illustrates the operation of heat sensors (for example, those described above), as well as the operation of the photosensitive sensor 1324 used in combination with the thermochromatic strip 1318. This flow chart is similar to FIG. 50 with the exception that if none of the blocks 814, 816, 818, or 820 determines that one of the buttons 702*a*-702*d* has been depressed, control reverts to block 830, which determines if the system has been in operation (playing a light and/or sound show) for 10 minutes. If a 10 minute operation has not occurred, then control reverts to block 832. Block 832 determines whether any control button has been depressed, with control reverting to block 810 if not and control reverting to block 812 if so. If a 10 minute operation has occurred as determined by block 830, control reverts to block 834, which tests for the condition of whether the candle is lit. If the candle is lit, then control reverts to block 832, if not, then control reverts to block 810. This 10 minute operation time out feature is provided by way of an example, and it is contemplated that this time out duration may be of any length of time appropriate for the desired operation of the control unit in conjunction with the flame sensors or other control mechanism.

Similar to the embodiments shown in FIGS. 39-43, FIGS. 55-59 show an additional embodiment of a candle assembly 2000 with a support base 2002 that supports a melting plate 2004 and is disposed atop a control unit 2006, which houses electrical components (not shown but similar to those described above). A translucent diffuser 2008 disposed beneath the support base 2002 and atop the control unit 2006 diffuses light emitted from a multi-color LED 2010 that is controlled by the electrical components. In one embodiment, the multi-color LED 2010 may be a tri-color LED. Control buttons 2012*a* and 2012*b* disposed on a side of the control unit 2006 are operatively connected to the electrical components to control light shows emitted from the tri-color LED 2010. Examples of tri-color LEDs useful in the present disclosure include those available from Waitrony Co. Ltd., Tsuen Wan, Hong Kong. Multi-color LEDs useful in the present disclosure include those having characteristics such as wide angle light dispersions and tinted plastic covers that reduce the occurrence of visible hot spots so to create a glow effect within the candle assembly 2000.

Figure 55:
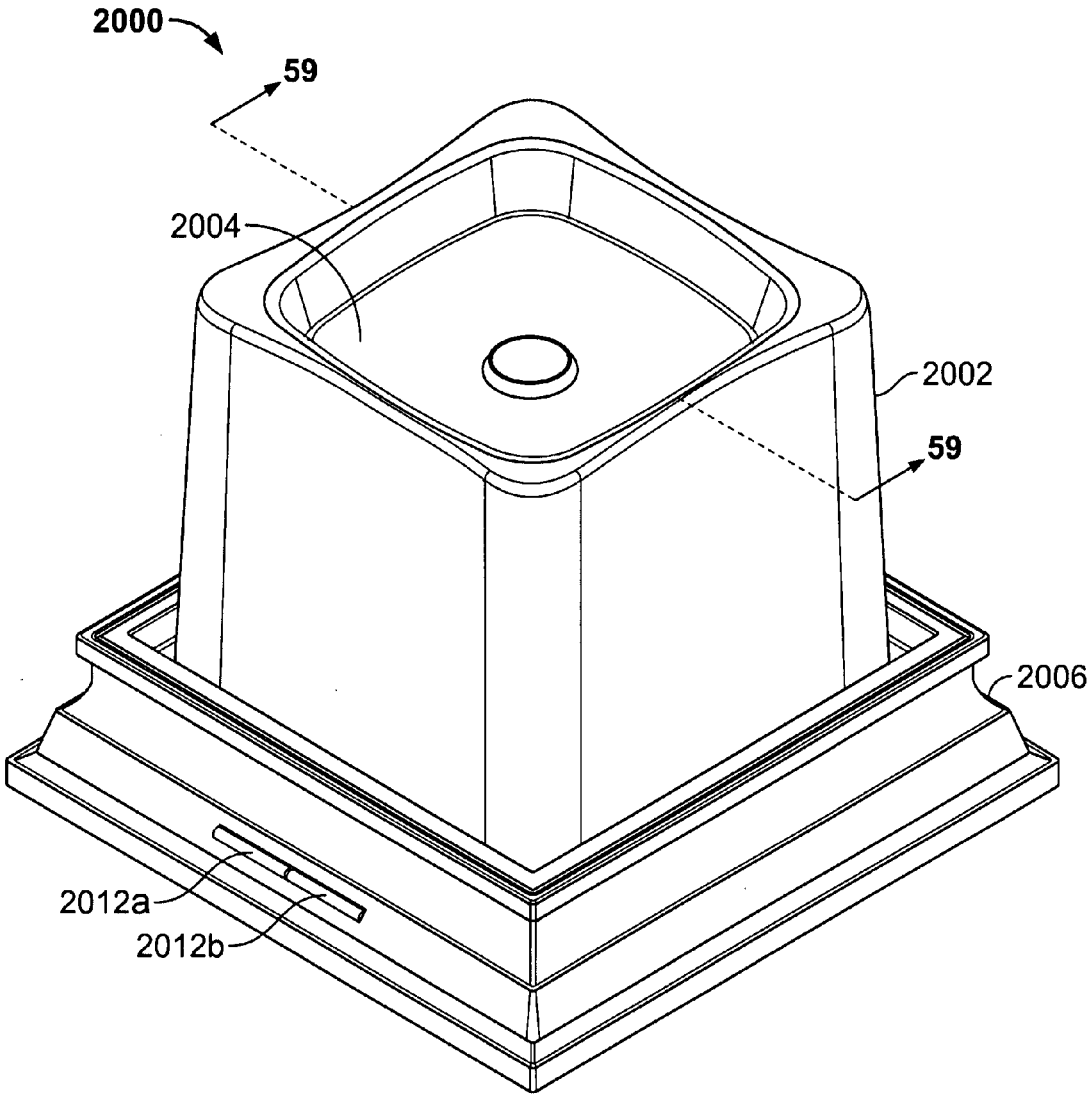
FIG. 55 is an isometric view of a candle assembly according to yet another embodiment.
Figure 56:
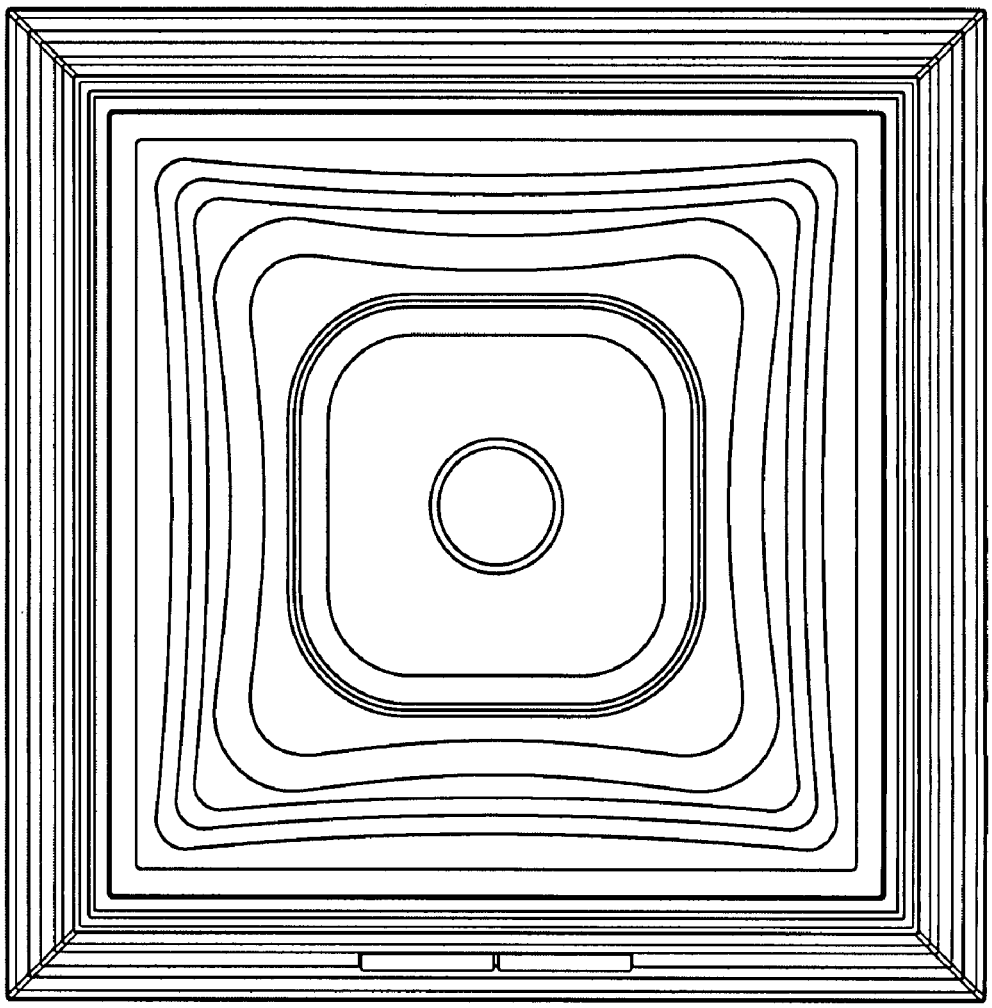
FIG. 56 is a plan view of the candle assembly of FIG. 55.
Figure 57:
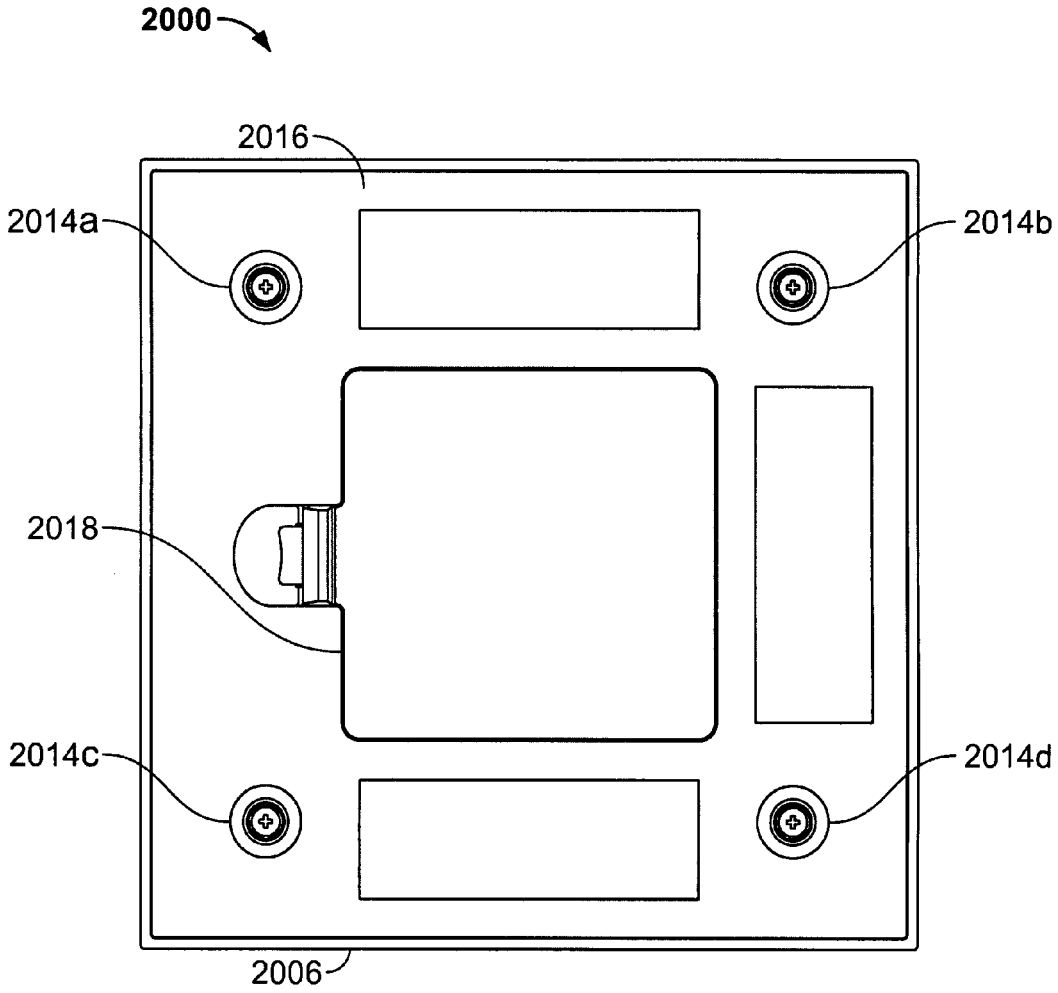
FIG. 57 is a bottom elevational view of the candle assembly of FIG. 55.

FIGS. 56 and 57 show a plan view and bottom elevational view of the candle assembly of FIG. 55, respectively. FIG. 56 shows the support base 2002 centrally disposed atop the control unit 2006. The control unit 2006 further includes four feet 2014*a*-2014*d* (FIG. 57) that provide support for the candle assembly 2000 and which space the bottom surface 2016 of the control unit from a support surface. The bottom surface 2016 of the control unit 2006 includes a battery door 2018 through which batteries that power both the electrical components and the tri-color LED 2010 may be accessed (as described above).

Figure 58:
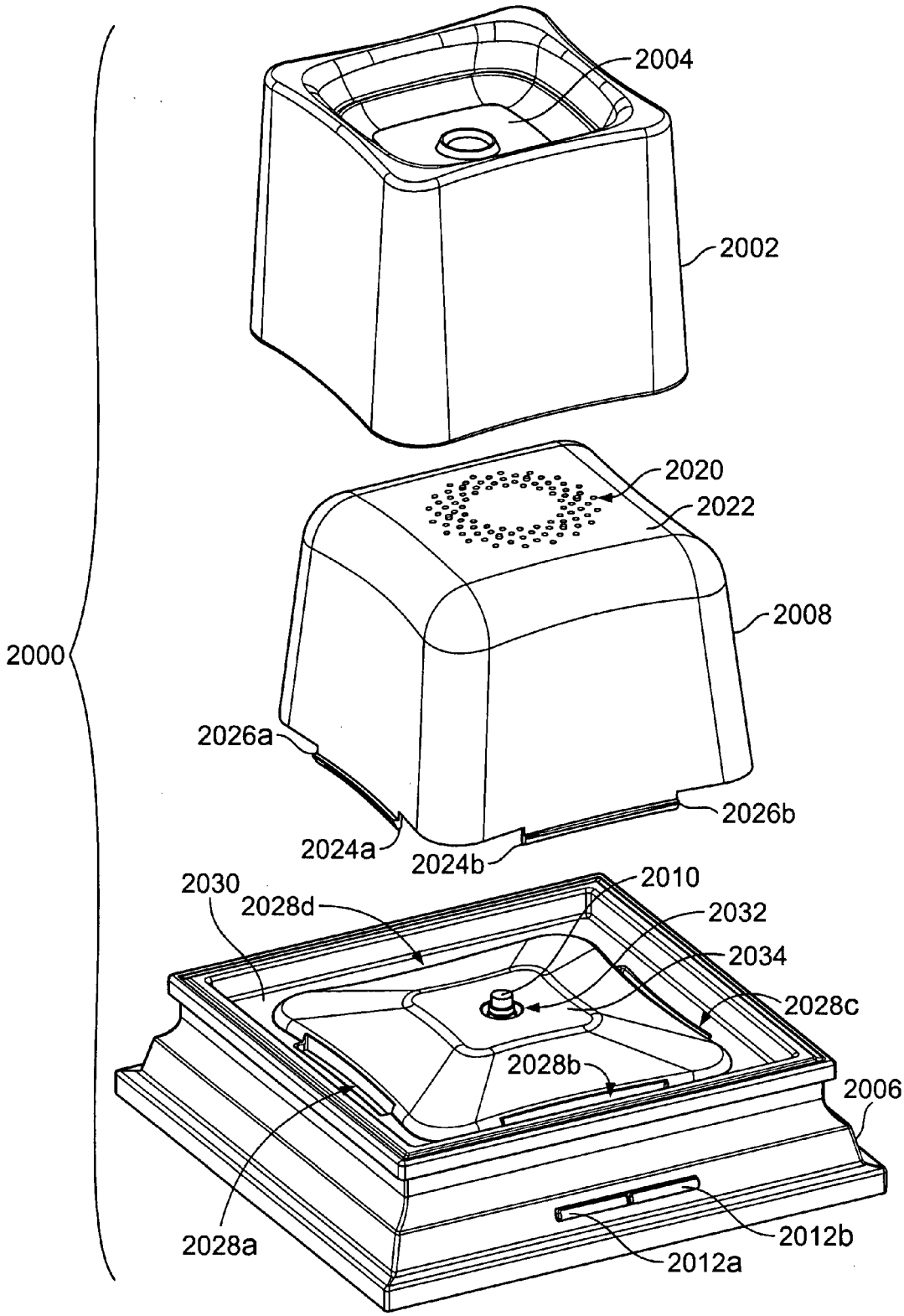
FIG. 58 is an exploded isometric view of the candle assembly of FIG. 55.

FIG. 58 shows a partially disassembled candle assembly 2000 revealing the diffuser 2008 and tri-color LED 2010. The diffuser 2008 includes surface geometric features, such as cutout portions 2020 in a top surface 2022 thereof that enable the use of adhesives to bond the diffuser to other objects including, for example, the support base 2002. The diffuser 2008 further includes tabs 2024*a*, 2024*b*, and 2024*c* (2024*c* is visible in FIG. 59) each having an outturned flange 2026 (only flanges 2026*a* and 2026*b* are shown, 2026*c* is visible in FIG. 59). The tabs 2024*a*, 2024*b*, and 2024*c* and flanges are inserted into corresponding slots 2028*a*, 2028*b*, and 2028*c* in a recessed surface 2030 of the control unit 2006 to attach the diffuser 2008 to the control unit 2006 in a fashion similar to that previously described. A fourth tab, flange, and slot are not shown. The tri-color LED 2010 is disposed through a cutout 2032 above a top surface 2034 of the control unit 2006.

Figure 59:
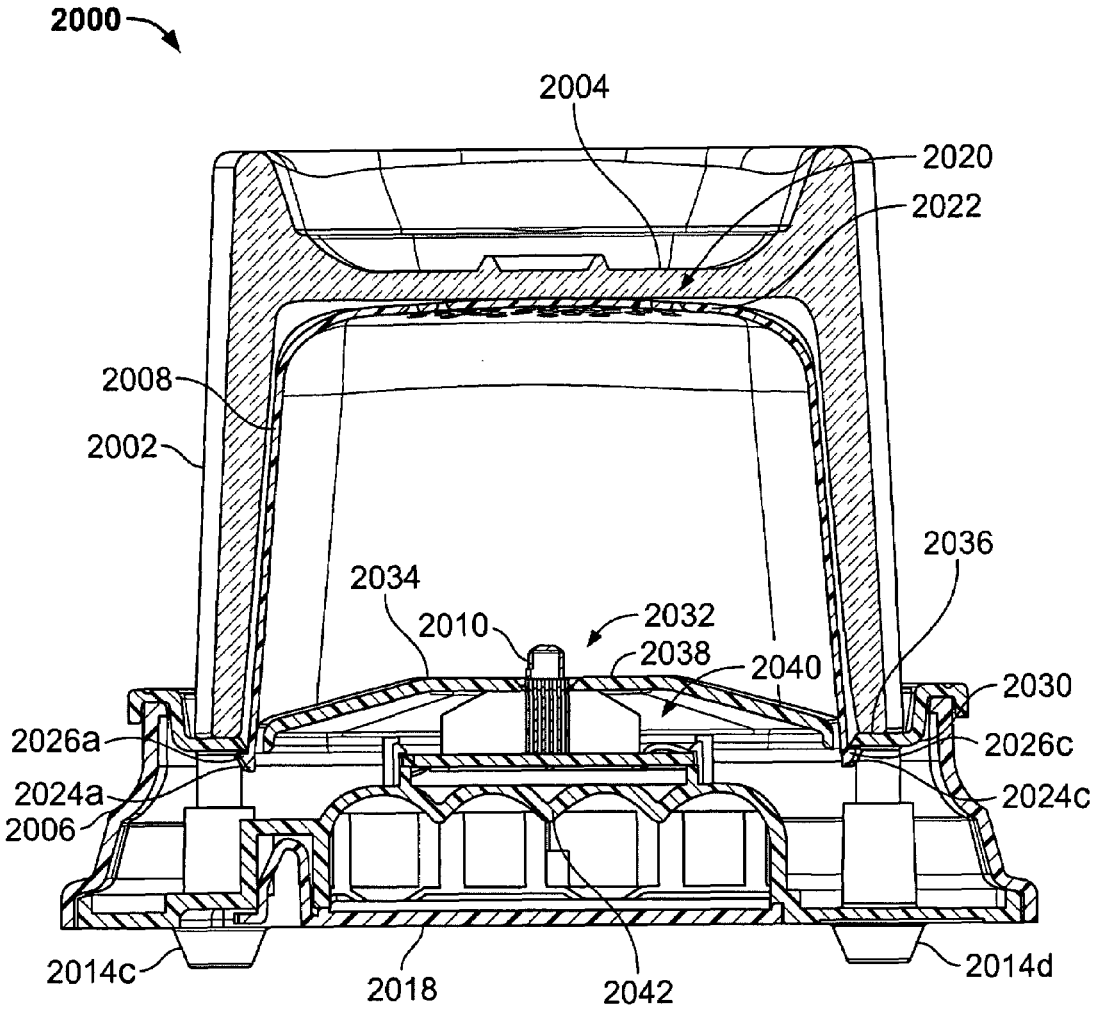
FIG. 59 is a cross-sectional view of the candle assembly of FIG. 55 taken generally along lines 59-59 of FIG. 55.

Now turning to FIG. 59, the bottom 2036 of the support base 2002 rests on the recessed surface 2030 of the control unit 2006. The support base 2002 may be attached to the diffuser 2008 via an adhesive or by any other appropriate method. The diffuser 2008 (shown without an optional central diffusion core) is secured to the control unit 2006 by means of outturned flanges 2026*a*, 2026*b*, and 2026*c* that are hooked underneath the recessed surface 2030 of the control unit. The tri-color LED 2010 is supported by a holder 2038, which extends through the cutout 2032 to the electrical components 2040 held within the control unit 2006. Located beneath the electrical components 2040 is a battery holder 2042 accessible via the battery door 2018, wherein the batteries are omitted for purposes of clarity. In addition, an electrical power cord may be used in place of or in addition to the batteries to power the control unit.

Operationally similar to embodiments previously described, the electrical components 2040 of the control unit 2006 may be programmed to display a particular number of light shows, wherein the light shows are individually selectable by depressing a control button 2012*a* until a particular color is displayed, indicating that a desired light show has been selected. Thereafter, the light show may proceed automatically such that the displayed color changes or "morphs" from one color to a next color, with a transition occurring therebetween. Examples of possible light shows that may vary are shown in Table 1.

TABLE 1

Light Shows.

Pause = 5 seconds Transition = 10 seconds

| | Time (sec) | | | | | | | | | | | |
|---|---|---|---|---|---|---|---|---|---|---|---|---|
| | 0 | | | 15 | | | 30 | | | 45 | | |
| LED Color % | R | G | B | R | G | B | R | G | B | R | G | B |
| Light Show A | 73 | 5 | 5 | 100 | 34 | 0 | 71 | 100 | 0 | 100 | 58 | 0 |
| Light Show B | 2 | 0 | 40 | 29 | 32 | 100 | 0 | 20 | 82 | 0 | 80 | 83 |
| Light Show C | 0 | 90 | 51 | 0 | 0 | 100 | 2 | 39 | 86 | 31 | 100 | 87 |

Pause = 4 seconds Transition = 8 seconds

| | Time (sec) | | | | | | | | | | | | | | |
|---|---|---|---|---|---|---|---|---|---|---|---|---|---|---|---|
| | 0 | | | 12 | | | 24 | | | 36 | | | 48 | | |
| LED Color % | R | G | B | R | G | B | R | G | B | R | G | B | R | G | B |
| Light Show D | 100 | 50 | 0 | 59 | 100 | 0 | 6 | 100 | 16 | 2 | 12 | 100 | 31 | 29 | 39 |

As indicated above, each color may be displayed for a period lasting 4-5 seconds, and an 8-10 second transition interval may occur between each of the 4-5 second periods. Further, the durations for maintaining any particular color combination or transitioning between color combinations may be shorter or longer. The intensities of the LEDs may be linearly or non-linearly varied over time during the transition intervals between starting and ending levels wherein the starting and ending levels result in the displays of the colors during each 4-5 second period. Upon completion of each light show cycle, the entire cycle repeats. Any other morphing of any number of colors may be undertaken as desired including, for example, a random pattern.

The control button 2012*a* activates, selects, and deactivates the control unit. The user is also provided with a means to pause or stop color morphing and thereby maintain a currently displayed color by depressing a pause or stop button 2012*b*. Illustratively, a light show is activated when 2012*a* is initially depressed by the user, and subsequent scrolling from light show to light show occurs with each subsequent depression until reaching a final light show when a subsequent depression deactivates the light show and the control unit reverts back to a sleep mode. The second button 2012*b* may be configured such that when depressed during the color morphing of the light show, the color morphing is paused or stopped at the currently displayed color. When the second button is depressed again, the light show and color morphing may continue from the point at which the light show was paused or the light show may be stopped. Depressing the first button while in the pause or stop mode may advance the light effect to the next light show with continued color morphing, or if the light effect was operating in the last light show mode, the light effect may be terminated. Once activated, a light show may cycle continuously until the user turns off the light show, until no battery power remains, or until a time out limit is reached, for example, a preprogrammed duration of 1 hour.

In a further embodiment, it is contemplated that the control unit 2006 may be configured to display a light show at more than one brightness level, such as, for example, a low brightness level, a medium brightness level, and/or a high brightness level. Each brightness level may have the same light shows as described in Table 1, above, or may have additional light shows associated with one brightness level compared to another brightness level or a baseline brightness level, which may be, for example, the medium brightness level. In this way, the user may select a low brightness level light show that has an overall mean brightness level diminished by, for example, about 25% or more, or about 30% or more, or about 50% or more, and the like as compared to the same light show displayed at the baseline brightness level. Similarly, the user may choose to select a high brightness level light show that compared to the light show displayed at the medium brightness level and/or baseline level may be increased by about 25% or less, or about 30% or less, or about 50% or less, and the like.

In one embodiment, a candle assembly may have a control unit 2006 with an additional switch (not shown), for example, disposed on the bottom of the control unit that enables the user to select a desired brightness level. Further, referring to FIG. 55, control buttons 2012*a*, 2012*b* may be configured to enable the user to select a desired brightness level in addition to controlling light shows as described elsewhere herein. For example, the user may depress control button 2012*a* for a predetermined period of time after which the functional mode of control button 2012*b* is changed to allow adjustment of brightness levels. For example, after depressing control button 2012*a* (or control button 2012*b*) for a period of about 5 seconds or longer or shorter, depressing control button 2012*b* (or control button 2012*a*) once may activate a low brightness level, twice may activate a high brightness level, and three times may revert back to a baseline level, such as a medium brightness level. Upon activating any brightness level, the control buttons 2012*a*, 2012*b* behave as described previously with regard to light show control. It is further contemplated herein that after depressing a control button 2012*a*, 2012*b* for a predetermined period of time, additional depressions of the same control button may cause the change in brightness level until an addition depressing of the same control button for an extended period of time, or depressing of the opposite control button causes the control button to revert to normal functioning mode, as described above. Additional methods for choosing light show brightness levels are further contemplated herein as are known to one skilled in the art.

Figure 60:
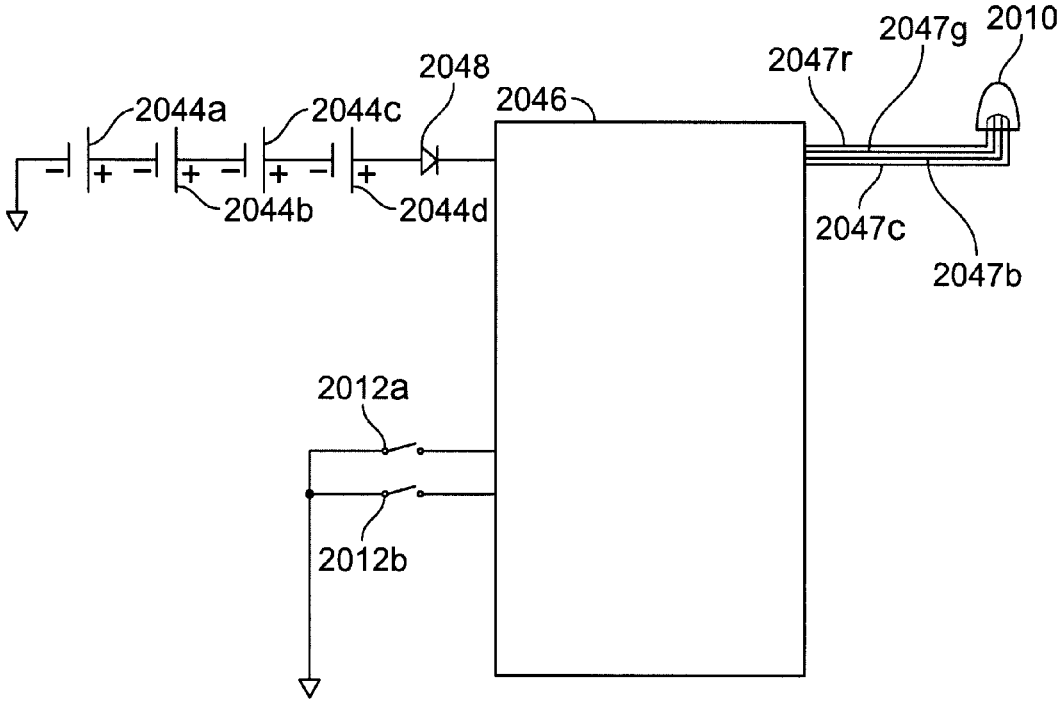
FIG. 60 is a simplified block and schematic diagram of a circuit for operating the candle assembly according to FIGS. 55-59.

Similar to the functional system diagrams previously discussed, FIG. 60 illustrates the functional interconnectivity of electrical components included in the embodiment illustrated in FIGS. 55-59. For example, one or more batteries 2044*a*, 2044*b*, 2044*c*, and 2044*d* of suitable capacity and type provide power to a digital processing unit 2046 (for example, a programmable microprocessor or an application specific integrated circuit ((ASIC)). The power provided by the batteries may be conditioned as required and may be supplied via a diode 2048 that acts as a battery reversal protection device. The diode 2048 protects the processing unit 2046 and/or other components from damage if one or more batteries 2044*a*, 2044*b*, 2044*c*, and 2044*d* is inserted into the battery holder 2042 in reverse orientation. The digital processing unit 2046 may include, for example, a PWM generator, a lamp driver, and pattern storage and program storage capabilities to implement the one or more light shows emitted by the tri-color LED 2010 upon depressing control buttons 2012*a* and 2012*b*. In this regard, the processing unit 2046 has three independent output terminals coupled by lines 2047*r*, 2047*g*, and 2047*b* to red, green, and blue terminals of the LED 2010 and a fourth terminal coupled by a line 2047*c* to a common terminal of the LED so that the red, green, and blue portions of the LED can be independently controlled.

Figure 61:
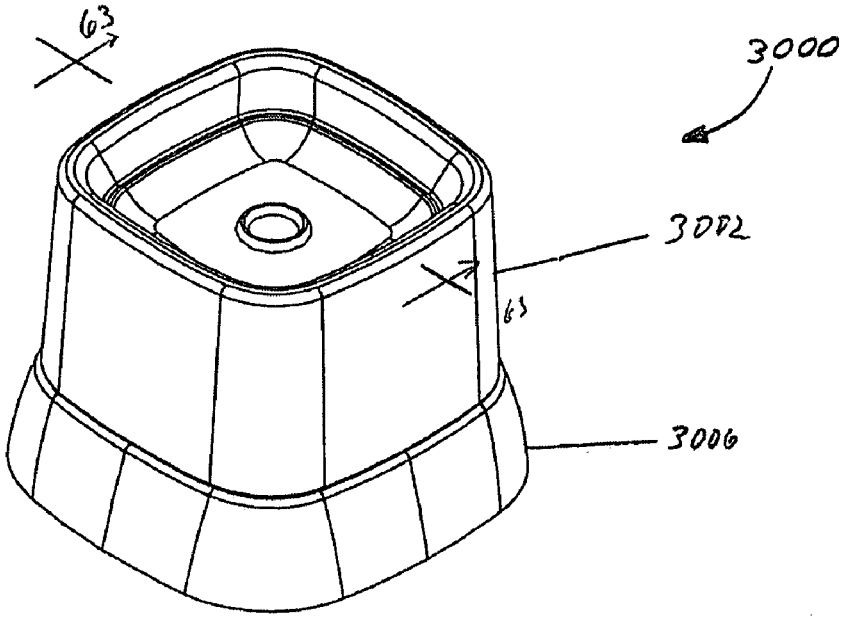
FIG. 61 is an isometric view of a candle assembly according to another embodiment.
Figure 62:
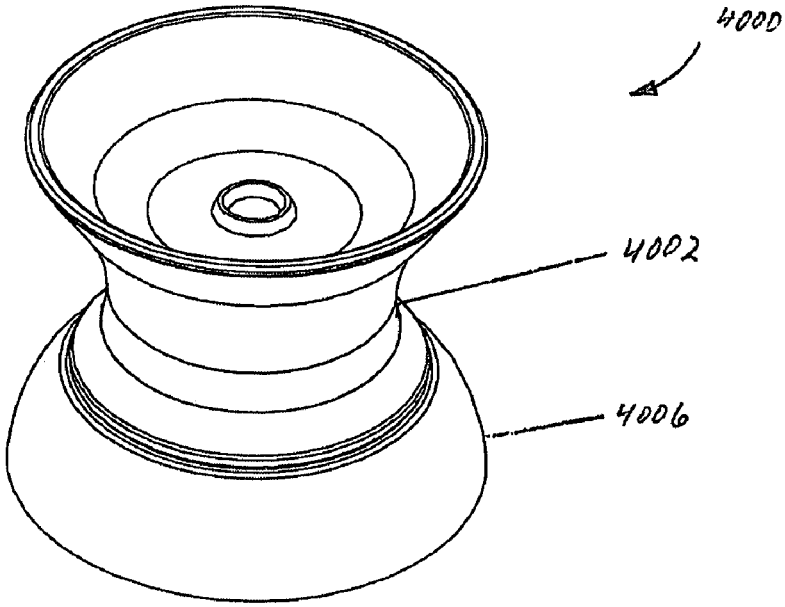
FIG. 62 is an isometric view of a candle assembly according to a further embodiment.

Now turning to FIGS. 61 and 62, additional embodiments of candle assemblies 3000, 4000 are shown that have a generally square configuration 3000 and a generally round and/or hour-glass shaped configuration 4000. Each candle assembly 3000, 4000 includes a support base 3002, 4002 that may be frosted or clear glass or other light permissive material, an optional light diffuser (not shown), and a control unit 3006, 4006. In one embodiment, the base 3002, 4002 is similar or identical to the bases described previously, and a melting plate (not shown) is secured therein, again as described in connection with the preceding embodiments. Although not shown, a magnet may be disposed below a pedestal of the melting plate and a wick clip, wick, and fuel element may be removably disposed on the pedestal may be retained thereon by magnetic forces developed by the magnet.

Figure 63:
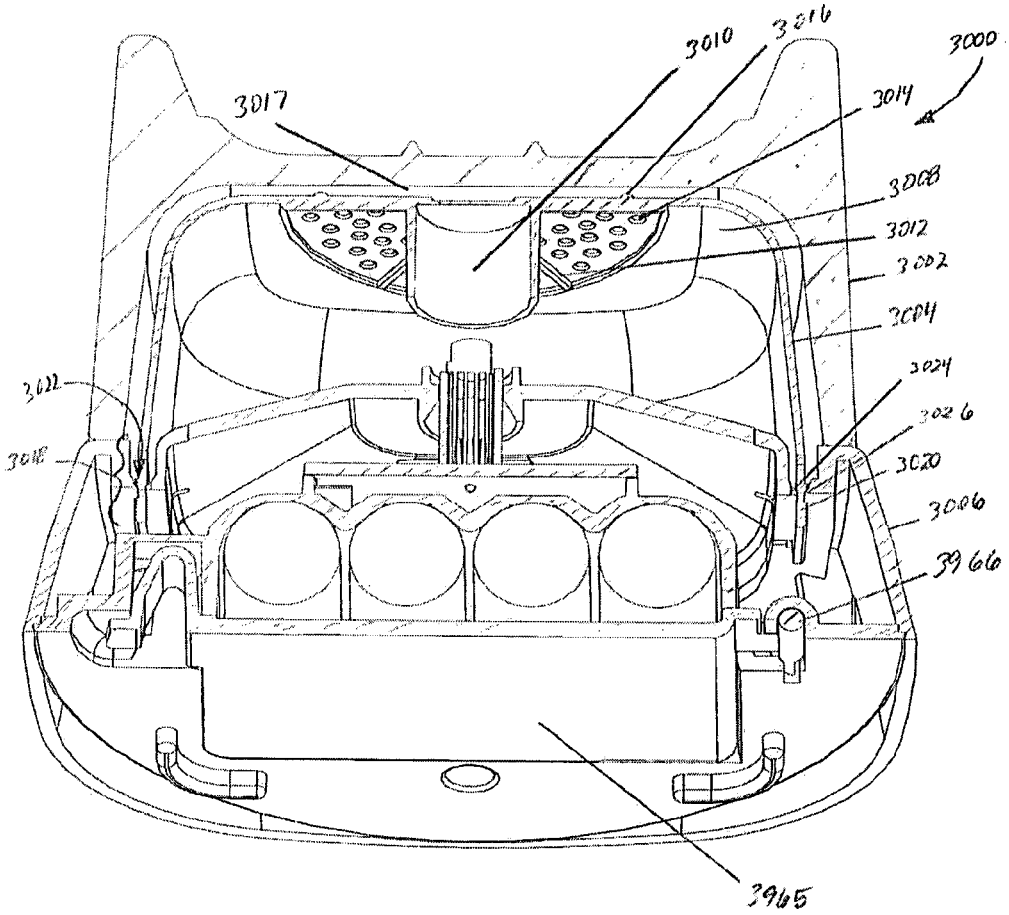
FIG. 63 is a cross-sectional view of the candle assembly of FIG. 61 taken generally along lines 63-63 of FIG. 61 viewed from beneath.

In a further embodiment, shown in FIG. 63 and descriptive of the candle assembly 4000 though not shown, a cross-section of the candle assembly 3000 from FIG. 61 reveals a diffuser 3004 with a top surface 3008 that includes a downwardly extending de-nesting column 3010 that assists in the separation of stacked diffusers 3004 during the manufacturing of the candle assembly 3000. The diffuser 3004 further includes radial spokes 3012 that extend radially from the de-nesting column 3010 and serve as structural stabilizers to the top surface 3008 of the diffuser. Similar to previously presented embodiments above, the diffuser 3004 may include geometric surface features 3014, such as holes, which may be included in the diffuser to enable the use of adhesives to bond the diffuser to the support base 3002. In addition, adhesive spacers 3016 may be included on the top surface 3008 of the diffuser 3004 facing the support base 3002 to provide a minimal space required by the adhesive between the diffuser and a facing surface 3017 of the support base to ensure adequate adhesion. In one aspect, the height of the adhesive spacers 3016 may be a function of the minimal thickness required by an adhesive to provide sufficient bond strength between the diffuser 3004 and the support base 3002.

In addition, as shown in FIG. 63, the battery door 3965 is attached to the control unit 3006 in such a way, so that the battery door may not be removed from the candle assembly 3000. Further, while the attachment 3966 prevents removal and potential loss of the battery door 3965, such as for example, via a hinging action, the attachment permits easy access to the battery holder 3662 for occasional battery replacement.

As an additional feature of the current embodiment, the candle assembly 3000 includes a retention mechanism 3018 through which the diffuser 3004 attaches to the control unit 3006. The retention mechanism 3018 includes a first retention member such as retention tab 3020 depending from the diffuser 3004 that inserts into a second retention member such as a retention slot 3022 defined by a spring finger 3024 located inwardly from and opposite a retention tooth 3026. In other embodiments not shown, the retention tabs 3020 may be disposed on the control unit 3006 and insert into retention slots 3022 disposed on the diffuser 3004 and/or the support base 3002.

Figure 64:
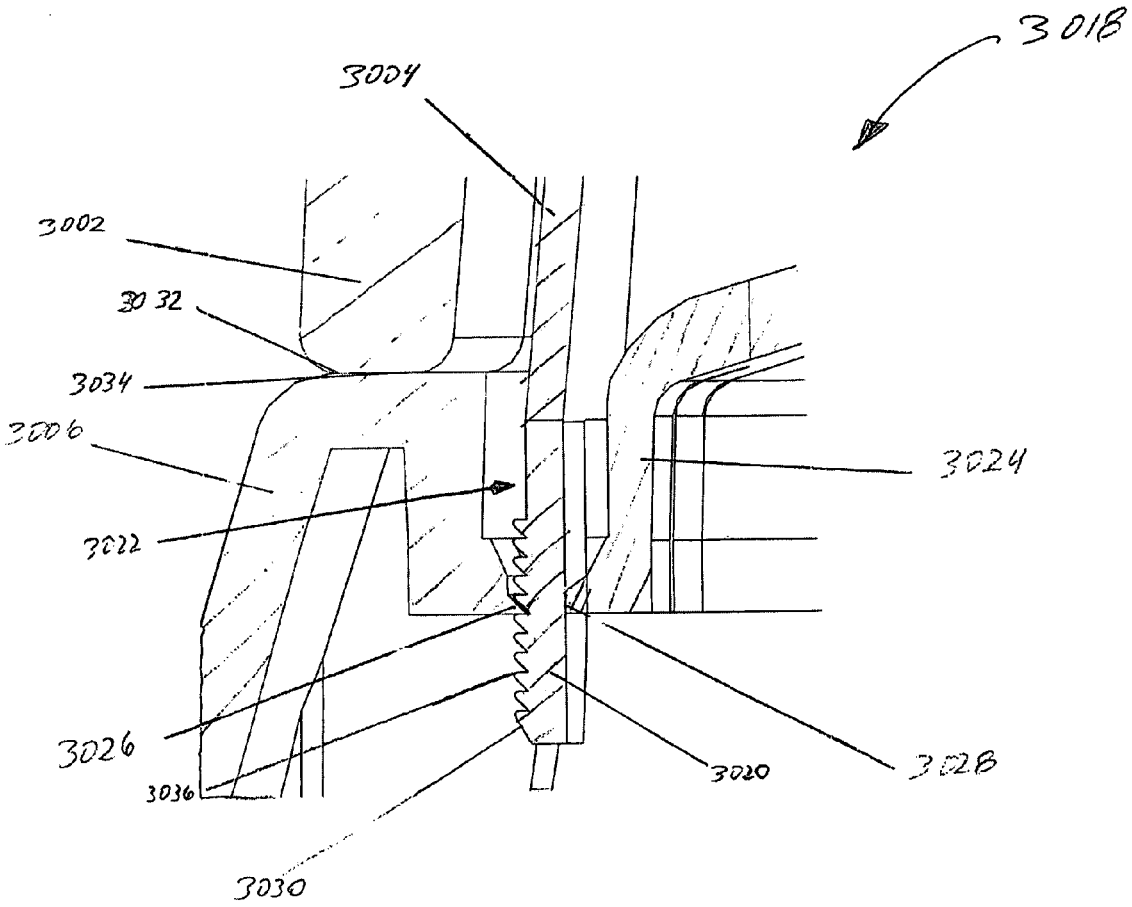
FIG. 64 is an enlarged partial cross-sectional view of the candle assembly of FIG. 61 taken generally along lines 63-63 of FIG. 61.

FIG. 64 shows a close-up on the retention mechanism 3018 seen in FIG. 63. In one embodiment of assembly of the candle assembly 3000, the diffuser 3004 is secured initially to the support base 3002 via one or more adhesives, after which the diffuser/support base assembly is attached to the control unit 3006 via the retention mechanism 3018. The retention tab 3020 is inserted into the retention slot 3022, and the tip 3030 of the retention tab contacts the retention tooth 3026 and the tip 3028 of the spring finger 3024. Upon application of pressure downward onto the support base 3002, the retention tab 3020 passes downward between the retention tooth 3026 and the tip 3028 of the spring finger 3024 until the bottom surface 3032 of the support base meets the top surface 3034 of the control unit 3006. Teeth 3036 on the retention tab 3020 lockingly engage the retention tooth 3026 to tightly secure the diffuser 3004 to the control unit 3006, as well as prevent the diffuser from being removed from the control unit. The spring finger 3024 applies force to the back of the retention tab 3020 to maintain the locking interaction between the teeth 3036 of the retention tab and the retention tooth 3026.

The tip 3030 of the retention tab 3020 may have an angle of greater than 45° to reduce resistance against insertion of the retention tab between the retention tooth 3026 and the spring finger 3024, however, any angle is contemplated within the present disclosure. Further, the tips of the teeth 3036 may be slightly rounded to preserve the structure of the teeth during the insertion process, therefore promoting greater resilience of the teeth against removal from between the retention tooth 3026 and spring finger 3024.

Figure 65:
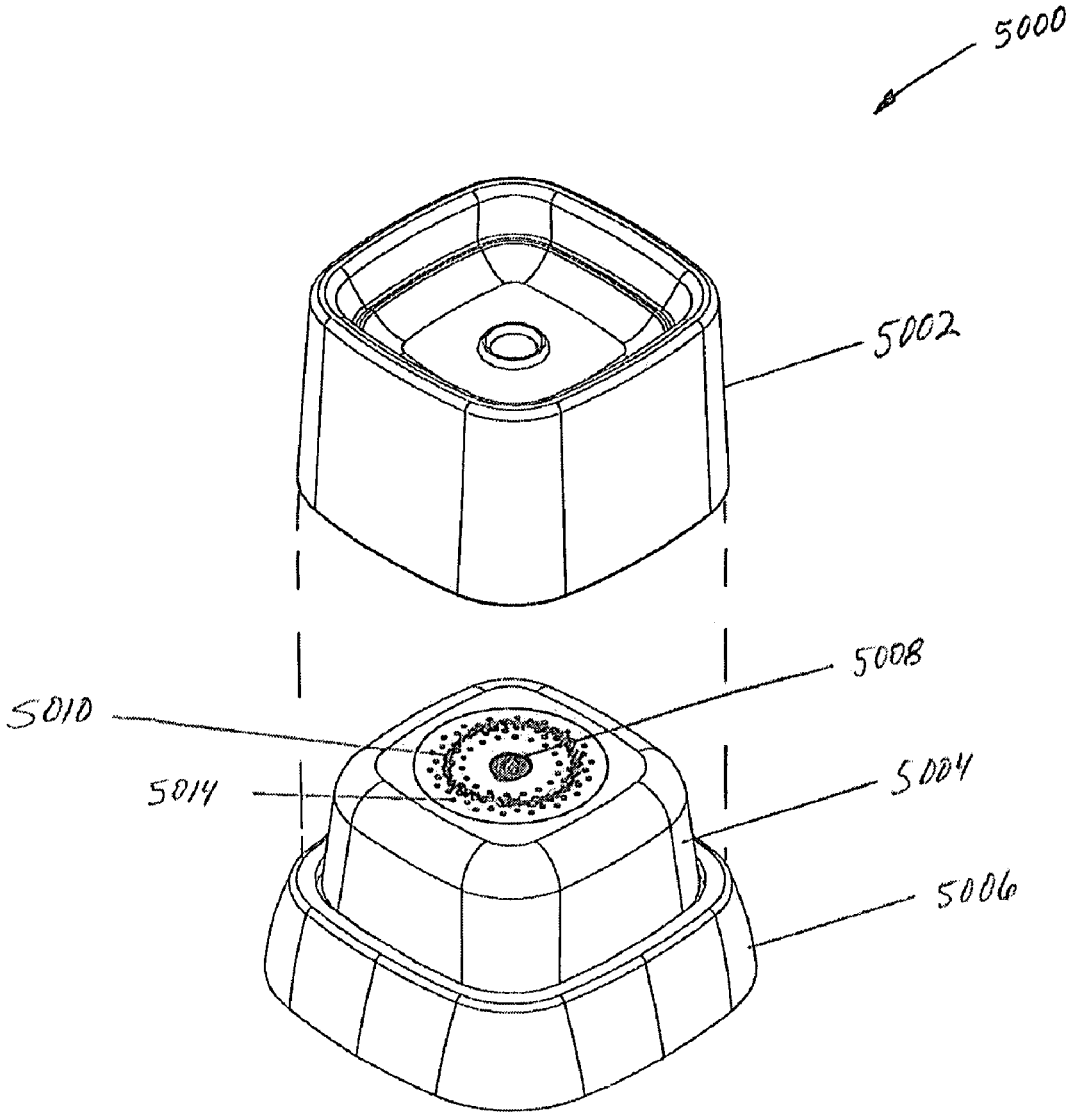
FIG. 65 is a partially exploded isometric view of the candle assembly of FIG. 61.

In another embodiment seen in FIG. 65, a candle assembly 5000 includes a support base 5002 exploded from a diffuser 5004 attached to a control unit 5006. In this embodiment, attachment of the support base 5002 to the diffuser 5004 may be accomplished using one or more adhesives as known to those skilled in the art. For example, to assist in the manufacture of the candle assembly 5000, an amount of a first adhesive 5008 may be applied to the diffuser 5004 and/or support base 5002. This first adhesive 5008 may include, for example, a quick setting and/or hot-melt adhesive, or other appropriate adhesive and/or adhesive blends to provide a temporary, semi-permanent, or permanent bond between the diffuser 5004 and the support base 5002 that has a relatively fast curing rate. It is further contemplated that an amount of a second adhesive 5010 may be applied to the diffuser 5004 and/or support base 5002 that has a relatively slow curing rate and/or requires addition of energy to cure, such as, for example an ultraviolet cure silicone adhesive. In this way, the combination of a fast cure adhesive 5008 and a slow cure adhesive 5010 facilitates the assembly of candle assemblies contemplated herein by providing early to immediate stability of the assembled candle assembly units via the fast cure adhesive and long-term durability of the bond between the diffuser 5004 and the support base 5002 via the slow cure adhesive.

Furthermore, the one or more adhesives used to attach the support base 5002 to the diffuser 5004 may interact with geometric surface features 5014, such as holes, disposed on the diffuser, as well as the facing surface (not shown) of the support base 5002 to bond the diffuser to the support base. Without wishing to be bound by theory, when an adhesive is applied to the diffuser 5004 and/or the facing surface of the support base 5002, the adhesive partially penetrates the holes in the diffuser to form mushroom-shaped formations that have a hardened skin. The mushroom-shaped formations then serve as "rivets" to mechanically bond the diffuser 5004 to the support base 5002 until sufficient time has passed to allow the remainder of the adhesive to completely cure. In this way, the holes 5014 and the facing surface of the support base 5002 each act as retention members that provide adhesive anchor points and are lockingly engaged together by the one or more adhesives.

Figure 66:
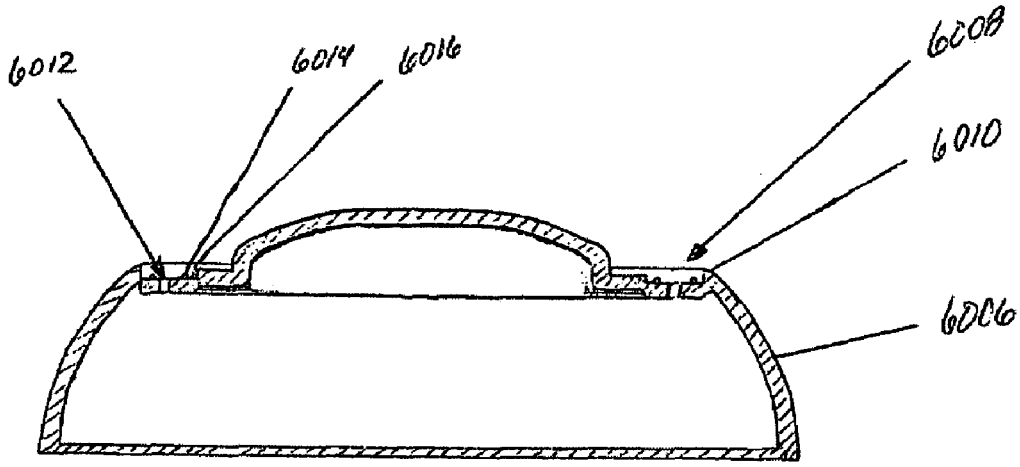
FIG. 66 is a cross-sectional view of a control unit according to one embodiment having a channel disposed thereon.

Another embodiment shown in FIG. 66 illustrates a control unit 6006 having a channel 6008 set inside of a rim 6010 that surrounds the upper surface of the control unit. The channel 6008 is designed to receive the walls (not shown) of a support base (not shown) therein so that from a side perspective, the bottom surface of the wall of the support base is not visible. Further, the channel 6008 provides an additional site for attachment of the support base to the control unit 6006 via, for example, one or more adhesives. In a manner similar to that described with respect to FIG. 63 and previously presented embodiments above, the channel 6008 may include geometric surface features 6012, such as holes, to promote the tack of adhesives used to bond the support base to the control unit 6006. In addition, adhesive spacers 6014 may be included on the top surface 6016 of the channel 6008 to provide a minimal space required by an adhesive between the control unit and the support base to ensure adequate adhesion. In this regard, the rim 6010 furthers aesthetic appearances by hiding excess adhesive. The height of the adhesive spacers 6014 is a function of the minimal thickness required by an adhesive to provide sufficient bond strength between the control unit 6006 and the support base.

Figure 67:
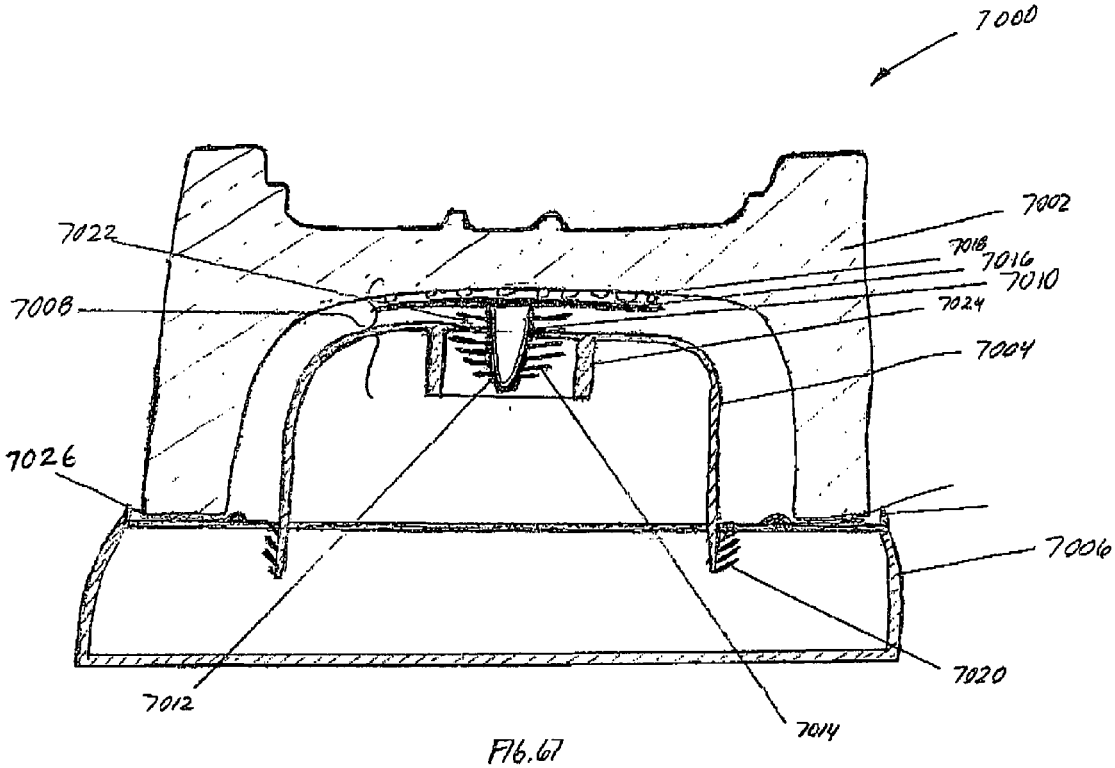
FIG. 67 is a cross-sectional view of a candle assembly according to a further embodiment having a retention mechanism.

A further embodiment is shown in FIG. 67, where a candle assembly 7000 includes a support base 7002, a diffuser 7004, and a control unit 7006. In this embodiment, a retention mechanism 7008 for attaching the diffuser 7004 to the support base 7002 is illustrated. The retention mechanism includes a retention member such as a retention device 7010 that has a retention post 7012 with one or more retainers such as a barb 7014 angling upward with respect to the orientation of use of the candle assembly 7000. The retention post 7012 extends downwardly from a support plate 7016 that may be attached to the support base 7002 using one or more adhesives 7018. In one example of use, the retention mechanism 7008 may be initially adhered to the support base 7002 using, for example, a fast cure adhesive and a slow cure adhesive, as previously described. Subsequently, the retention mechanism 7008 and support base 7002 assembly may be attached to the diffuser 7004 and the control unit 7006, which may also be pre-assembled by way of retention tabs 7020 of the diffuser Inserted into the control unit. To attach the support base 7002 to the control unit 7006, the retention post 7012 may be inserted through a retention member, such as an aperture 7022, in the diffuser 7004 surrounded by a de-nesting column 7024 up to the point where the support base is firmly abutted against the bottom surface of a channel 7026 on the control unit. The barbs 7014 on the retention post 7012 may engage irreversibly the diffuser 7004 such that the diffuser 7004 and support base 7002 assembly are permanently attached to the control unit 7006.

It is further contemplated that the retention mechanism 7008 may be made of a transparent or translucent material such that an ultraviolet cure silicone adhesive may be cured over time through normal use of the candle assembly 7000 light source (not shown) or via directed curing of the adhesive using a source of ultraviolet light that may pass through the retention mechanism prior to complete assembly of the candle assembly.

It is understood that the terminology used herein is intended to be in the nature of description rather than of limitation. All patents, published patent applications, and other references disclosed herein are incorporated herein by reference in their entirety. The various components of the various candle assemblies described herein may be packaged as an assembled unit, as an unassembled kit including all or a portion of the components, as individual components, and/or in any combination thereof. Different and various combinations of the herein-mentioned components of the various candle assemblies can also be used in the apparatuses, methods, kits, and combinations herein described.

INDUSTRIAL APPLICABILITY

The candle assemblies disclosed herein may be used to support a votive-type candle, such as the fuel element described herein. Sound and/or light features may be added to provide a pleasing experience for the user and can be controlled.

Numerous modifications will be apparent to those skilled in the art in view of the foregoing description. Accordingly, this description is illustrative only.

What is claimed is:

1. A retention mechanism, comprising:

a first retention member disposed on a support base comprising a melting plate configured to hold a fuel element and engage a wick holder, the melting plate comprising a projecting capillary lobe, the capillary lobe including a first capillary wall extending from the melting plate, the wick holder having a wick and a base portion that includes a second capillary wall, the capillary lobe cooperatively engages the base portion to define a capillary space between the first and the second capillary walls to allow capillary flow of melted fuel from the melting plate to the wick through the capillary space;

a second retention member disposed on a control unit having a light emitting system and configured to lockingly engage the first retention member; and a third retention member disposed on the support base, wherein the third retention member is configured to lockingly engage a fourth retention member disposed on a diffuser.

2. The retention mechanism of claim 1, wherein the first retention member includes a retention tab that projects from the support base.

3. The retention mechanism of claim 2, wherein the second retention member includes a slot configured to receive the retention tab.

4. The retention mechanism of claim 1, wherein the capillary lobe projects upwardly from the support base.

5. A candle assembly, comprising:

a support base comprising an upwardly projecting capillary lobe, the capillary lobe disposed within a recessed base portion of a wick holder, and a capillary space defined between the capillary lobe and the recessed base portion to allow capillary flow of melted fuel to a wick from the support base;

a control unit having a light emitting system; and a retention mechanism to attach the support base to the control unit and comprising a first retention member disposed on the support base and a second retention member disposed on the control unit and configured to lockingly engage the first retention member, wherein the support base further comprises a diffuser to diffuse light emitted from the light emitting system and including the first retention member; and wherein the support base further comprises a third retention member configured to lockingly engage a fourth retention member disposed on the diffuser.

6. The candle assembly of claim 5, wherein the third retention mechanism is attached to the diffuser by a retainer.

7. The candle assembly of claim 5, wherein the third retention mechanism comprises a retention post to lockingly engage the fourth retention member.

* * * * *